US006817668B2

(12) United States Patent
DeKraker et al.

(10) Patent No.: US 6,817,668 B2
(45) Date of Patent: Nov. 16, 2004

(54) SEATING UNIT WITH VARIABLE BACK STOP AND SEAT BIAS

(75) Inventors: Larry DeKraker, Holland, MI (US); Kurt R. Heidmann, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 10/439,409

(22) Filed: May 16, 2003

(65) Prior Publication Data

US 2003/0193227 A1 Oct. 16, 2003

Related U.S. Application Data

(63) Continuation of application No. 10/376,535, filed on Feb. 28, 2003, which is a continuation of application No. 10/214,543, filed on Aug. 8, 2002, now Pat. No. 6,749,261, which is a continuation of application No. 09/921,059, filed on Aug. 2, 2001, now Pat. No. 6,460,928, which is a division of application No. 09/694,041, filed on Oct. 20, 2000, now Pat. No. 6,349,992, which is a continuation of application No. 09/491,975, filed on Jan. 27, 2000, now Pat. No. 6,367,877, which is a continuation of application No. 09/386,668, filed on Aug. 31, 1999, now Pat. No. 6,116,695, which is a continuation of application No. 08/957,506, filed on Oct. 24, 1997, now Pat. No. 6,086,153.

(51) Int. Cl.[7] ..... A47C 7/60
(52) U.S. Cl. ..... 297/300.8
(58) Field of Search ..... 297/300.1–300.2, 297/300.4, 284.4, 301.1, 301.2, 301.5, 303.4, 341–342, 303.1, 303.3, 301.3, 284.1, 300.8, 300.7, 300.6, 303.5, 300.5, 302.5, 302.6, 302.7

(56) References Cited

U.S. PATENT DOCUMENTS

| | | | |
|---|---|---|---|
| 362,796 | A | 5/1887 | Tait |
| 1,590,240 | A | 6/1926 | Gorton |
| 2,471,024 | A | 5/1949 | Cramer |

(List continued on next page.)

FOREIGN PATENT DOCUMENTS

| | | | |
|---|---|---|---|
| DE | 1044354 | | 11/1958 |
| DE | 948544 | | 9/1962 |
| DE | G91099595 | | 10/1991 |
| EP | 0043242 | | 1/1982 |
| EP | 0516341 | A1 | 12/1992 |
| EP | 0680713 | A1 | 8/1995 |
| GB | 761805 | | 11/1956 |
| GB | 794138 | | 6/1958 |
| GB | 1278501 | | 6/1972 |
| JP | S5226229 | | 3/1977 |
| JP | S5283812 | | 7/1977 |
| JP | S5284714 | | 7/1977 |
| WO | WO8700738 | | 2/1987 |
| WO | WO9325121 | | 12/1993 |

OTHER PUBLICATIONS

Exhibit A "The Aeron Chair", Herman Miller flyer by Interior Services Incorporated, undated.
Exhibit B "Aeron Chairs" brochure, dated 1998 Herman Miller, Inc., Zeeland, MI, 4 pages.
Exhibit C Herman Miller Brochure on Aeron Chair (France); copyright date 1994.
Exhibit D Aeron Seat Cover Installation document, 2 pages, 1998 Herman Miller, Inc., Zeeland, MI.

(List continued on next page.)

*Primary Examiner*—Milton Nelson, Jr.
(74) *Attorney, Agent, or Firm*—Price, Heneveld, Cooper, DeWitt & Litton LLP

(57) ABSTRACT

A seating unit includes a seating unit having a base, a seat and a back operably pivoted to the base for synchronous movement including recline of the back and forward movement of the seat, an adjustable variable back stop adjustably engaging the seat for adjustably limiting a rearward tilt of the back, and a handle. The handle and the back stop are supported for independent movement, but are interconnected by a connecting mechanism including a pair of links so that the back stop is selectively adjusted upon rotation of the handle.

68 Claims, 38 Drawing Sheets

U.S. PATENT DOCUMENTS

| | | | | |
|---|---|---|---|---|
| 2,492,107 | A | | 12/1949 | Orton et al. |
| 2,627,898 | A | | 2/1953 | Jackson |
| 2,818,911 | A | | 1/1958 | Syak |
| 3,369,840 | A | | 2/1968 | Dufton |
| 3,934,932 | A | | 1/1976 | Ekornes |
| 3,989,297 | A | | 11/1976 | Kerstholt |
| 4,099,775 | A | | 7/1978 | Mizelle |
| 4,309,206 | A | | 1/1982 | Michaud et al. |
| 4,390,206 | A | | 6/1983 | Faiks et al. |
| 4,449,752 | A | | 5/1984 | Yasumatsu et al. |
| 4,465,317 | A | | 8/1984 | Schwarz |
| 4,595,237 | A | | 6/1986 | Nelsen |
| 4,621,864 | A | | 11/1986 | Hill |
| 4,638,679 | A | | 1/1987 | Tannenlaufer |
| 4,703,974 | A | * | 11/1987 | Brauning ..... 297/285 |
| 4,709,963 | A | | 12/1987 | Uecker et al. |
| 4,720,142 | A | | 1/1988 | Holdredge et al. |
| 4,763,950 | A | | 8/1988 | Tobler |
| 4,779,925 | A | | 10/1988 | Heinzel |
| 4,842,333 | A | | 6/1989 | Meiller |
| 4,880,271 | A | | 11/1989 | Graves |
| 4,889,384 | A | | 12/1989 | Sulzer |
| 4,906,045 | A | | 3/1990 | Hofman |
| 4,915,449 | A | | 4/1990 | Piretti |
| 4,948,198 | A | | 8/1990 | Crossman |
| 4,951,995 | A | | 8/1990 | Teppo et al. |
| 4,968,093 | A | | 11/1990 | Dal Monte |
| 4,981,326 | A | | 1/1991 | Heidmann |
| 4,984,846 | A | | 1/1991 | Ekornes |
| 5,029,940 | A | | 7/1991 | Golynsky et al. |
| 5,056,862 | A | | 10/1991 | May et al. |
| 5,106,157 | A | | 4/1992 | Nagelkirk et al. |
| 5,107,720 | A | | 4/1992 | Hatfield |
| 5,192,114 | A | | 3/1993 | Hollington et al. |
| 5,282,670 | A | | 2/1994 | Karsten et al. |
| 5,328,242 | A | | 7/1994 | Steffens et al. |
| 5,364,162 | A | | 11/1994 | Bar et al. |
| 5,366,274 | A | | 11/1994 | Roericht et al. |
| 5,385,388 | A | | 1/1995 | Faiks et al. |
| 5,472,261 | A | | 12/1995 | Oplenskdal et al. |
| 5,505,520 | A | | 4/1996 | Frusti et al. |
| 5,564,783 | A | * | 10/1996 | Elzenbeck et al. ..... 297/300.2 |
| 5,577,807 | A | | 11/1996 | Hodge et al. |
| 5,630,647 | A | | 5/1997 | Heidmann et al. |
| 5,782,536 | A | | 7/1998 | Heidmann |
| 5,871,258 | A | | 2/1999 | Battey |
| 5,915,788 | A | | 6/1999 | Schneider |
| 6,003,943 | A | | 12/1999 | Schneider |
| 6,035,901 | A | | 3/2000 | Stumpf |
| 6,250,715 | B1 | | 6/2001 | Caruso |
| 6,367,876 | B2 | | 4/2002 | Caruso |

OTHER PUBLICATIONS

Exhibit E "The Aeron Chair: User Adjustments and Ergonomic Guide", 11 pages, 1994 Herman Miller, Inc. Zeeland, MI.

Exhibit F A product brochure entitled *SoHo* disclosing a SoHo product line including an adjustable chair made by Knoll International, which on p. 5, states that the seat and back move, and on p. 9, shows ribes in a shell; the publication date being unknown, but prior to a filing date of the present application.

* cited by examiner

HIGH TORQUE

LOW TORQUE

HIGH TORQUE

LOW TORQUE

SEATING UNIT WITH VARIABLE BACK STOP AND SEAT BIAS

RELATED APPLICATIONS

This application is a continuation of application Ser. No. 10/376,535, filed Feb. 28, 2003, entitled Seating Unit Including Novel Back Construction, which is a continuation of application Ser. No. 10/214,543, filed Aug. 8, 2002 now U.S. Pat. No. 6,749,261, entitled Seating Unit Including Novel Back Construction which is a continuation of application Ser. No. 09/921,059, filed Aug. 2, 2001, entitled Seating Unit Including Novel Back Construction (now U.S. Pat. No. 6,460,928), which is a divisional of application Ser. No. 09/694,041, filed Oct. 20, 2000, entitled Seating Unit Including Novel Back (now U.S. Pat. No. 6,349,992), which is a Continuation of application Ser. No. 09/491,975, filed Jan. 27, 2000, entitled Back for Seating Unit (now U.S. Pat. No. 6,367,877), which is a continuation of application Ser. No. 09/386,668, filed Aug. 31, 1999, entitled Chair Control Having Adjustable Energy Mechanism (now U.S. Pat. No. 6,116,695), which is a divisional of application Ser. No. 08/957,506, filed Oct. 24, 1997, entitled Chair with Reclineable Back and Adjustable Energy Mechanism (now U.S. Pat. No. 6,086,153).

This application is also related to the following co-assigned patents and applications. The disclosure of each of these patents and applications is incorporated herein by reference in its entirety:

TABLE

| TITLE | U.S. PAT. NO. | ISSUE DATE |
|---|---|---|
| Chair Including Novel Back Construction | 5,975,634 | 11/02/99 |
| Chair With Novel Seat Construction | 5,871,258 | 02/16/99 |
| Chair with Novel Pivot Mounts and Method of Assembly | 5,909,923 | 06/08/99 |
| Synchrotilt Chair with Forwardly Movable Seat | 5,979,984 | 11/09/99 |
| Seating Unit with Reclineable Back And Forwardly Movable Seat | 6,394,549 | 05/28/02 |
| Seating Unit with Novel Seat Construction | 6,394,548 | 05/28/02 |
| Seating Unit with Novel Pivot Mounts And Method of Assembly | 6,318,800 | 11/20/01 |
| Back for Seating Unit | 6,394,545 | 05/28/02 |

BACKGROUND

The present invention concerns seating units having a reclineable back, and more particularly concerns seating units having a reclineable back with flexible lumbar region.

A synchrotilt chair is described in U.S. Pat. No. 5,050,931 (to Knoblock) having a base assembly with a control, a reclineable back pivoted to the control, and a seat operably mounted to the back and control for synchronous motion as the back is reclined. This prior art chair incorporates a semi-rigid flexible shell that, in combination with the chair support structure, provides a highly-controlled postural support during the body movements associated with tasks/work (e.g., when the back is in an upright position) and during the body movements associated with recline/relaxation (e.g., when the chair is in a reclined position). This prior art chair moves a seated user's upper body away from the user's work surface as the user reclines, thus providing the user with more area to stretch. In fact, moving around in a chair and not staying in a single static position is important to good back health in workers whose jobs require a lot of sitting.

However, users often want to remain close to their work surface and want to continue to work at the work surface, even while reclining and relaxing their body and while having continued good postural support. Further, workers often want to selectively choose the amount of maximum recline. In other words, workers often want to lean backward (i.e. recline) a small amount in an intermediate recline position, and yet simultaneously stay an appropriate distance from their work surface, also, workers prefer not to "fight" with the chair to stay in the intermediate partial-recline positions.

Modern customers and chair purchasers also demand a wide variety of chair options and features, and a number of options and features are often designed into chair seats. It is important that such options and features be incorporated into the chair construction in a way that minimizes the number of parts and maximizes the use of common parts among different options, maximizes efficiencies of manufacturing and assembling, maximizes ease of adjustment and the logicalness of adjustment control positioning, and yet that results in a visually pleasing design.

Accordingly, a chair construction solving the aforementioned problems is desired.

SUMMARY OF INVENTION

In one aspect of the present invention, a seating unit includes a base. A seat and a back are operably pivoted to the base for simultaneous movement upon recline of the back. A variable back stop adjustably engages the seat for limiting the rearward tilt of the back. A handle is supported on one of the base and the seat for adjusting the back stop, the handle and the back stop being independently supported relative to the base. A connecting mechanism operably interconnects the handle and the back stop so that a position of the back stop is adjusted upon movement of the handle.

In another aspect of the present invention, a chair includes a base assembly including a control housing. An energy source is located within the control housing. A seat is operably supported on the base assembly for generally horizontal movement between forward and rearward positions, with the seat operably interconnected to the energy source. The chair includes a back and a back frame, with the back frame being pivotally coupled to the base assembly for movement of the back support between upright and reclined positions, and with the back frame being pivotally coupled to the seat. The energy source biases the back support into an upright position by urging the seat to move horizontally. The horizontal movement of the seat induces the back support to rotate to a generally upright position. A variable back stop mechanism is supported on the base assembly and operably engages the seat, the variable back stop mechanism being configured to concurrently stop the seat and stop recline of the back support at a plurality of selectable positions between the upright and reclined position.

In another aspect of the present invention, a variable back stop apparatus for a seating unit having a base, a seat, and a back, the seat and back being operably pivoted to the base for simultaneous movement including recline of the back, includes an adjustable variable back stop adapted to adjustably engage the seat for adjustably limiting a rearward tilt of the back. A handle is adapted to be supported on one of the base and the seat for adjusting the back stop, the handle and the back stop being supported for independent movement. A connecting mechanism operably interconnects the handle and the back stop so that the back stop is adjusted upon movement of the handle.

These and other features and advantages of the present invention will be further understood and appreciated by those skilled in the art by reference to the following specification, claims, and appended drawings.

Figure 21:
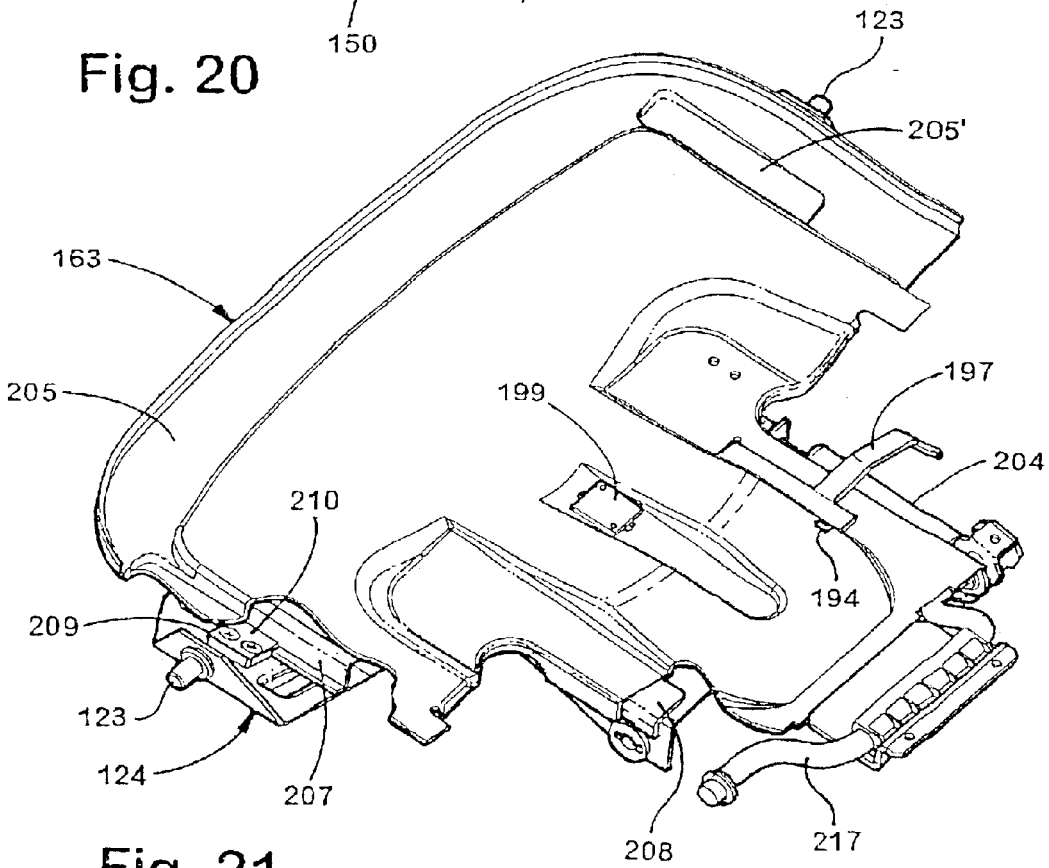
FIG. 21 is a perspective view of the depth-adjustable seat shown in FIG. 4B including the seat carrier and the seat undercarriage/support frame slidably mounted on the seat carrier, the seat undercarriage/support frame being partially broken away to show the bearings on the seat carrier, the seat cushion being removed to reveal the parts therebelow.
Figure 23:
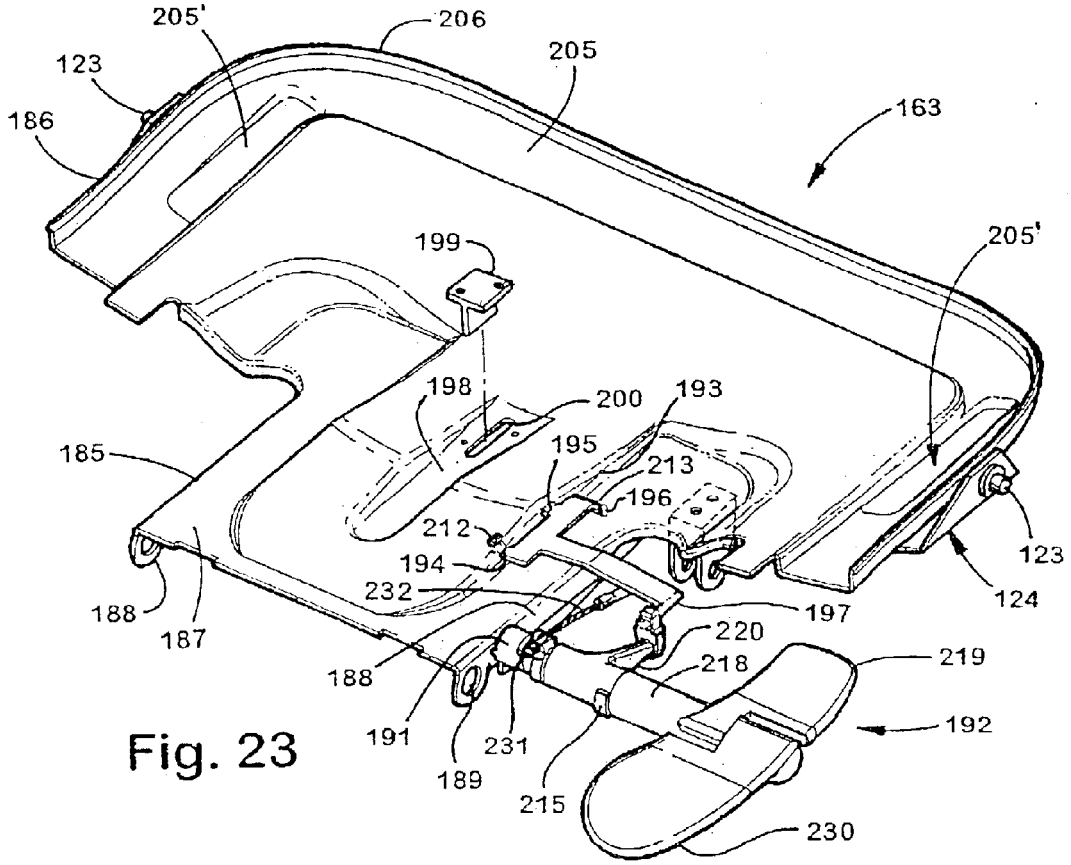
FIG. 23 is a top perspective view of the seat undercarriage/rear frame and the seat carrier shown in FIG.
Figure 22:
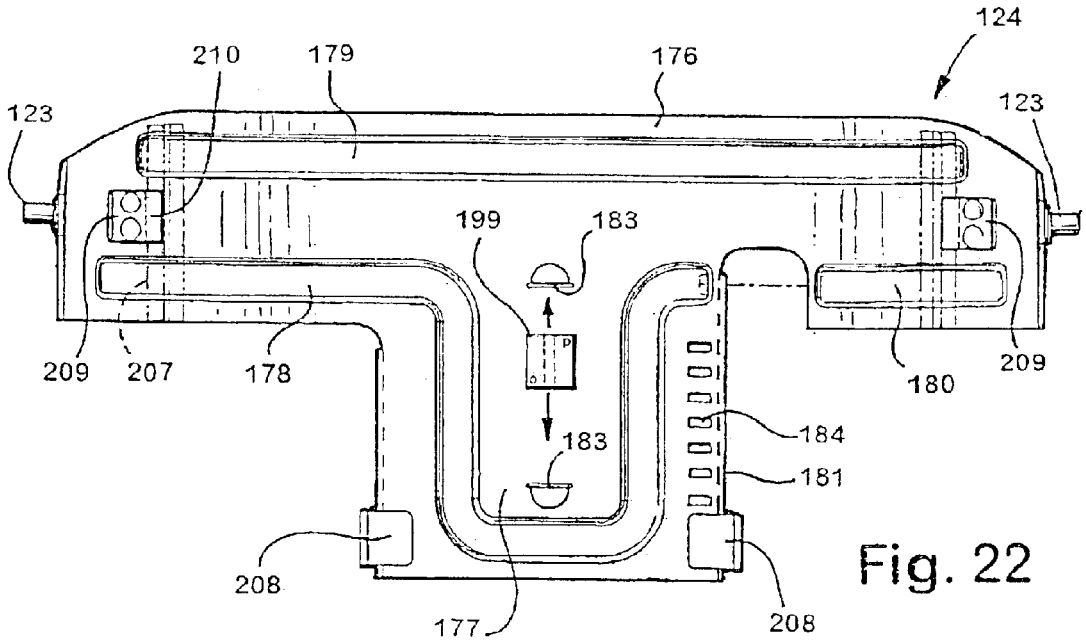
FIG. 22 is a top view of the seat carrier shown in FIG. 21, the seat undercarriage/rear frame being removed but the seat frame slide bearings being shown and the seat carrier depth-adjuster stop device being shown.
Figure 24:
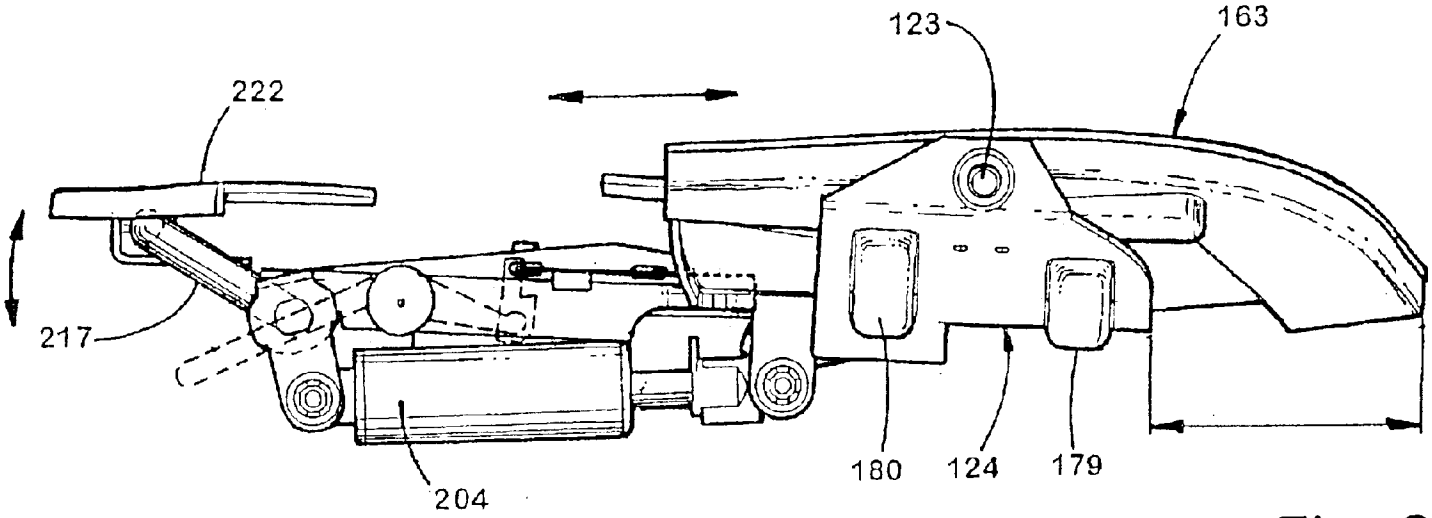
Figure 25:
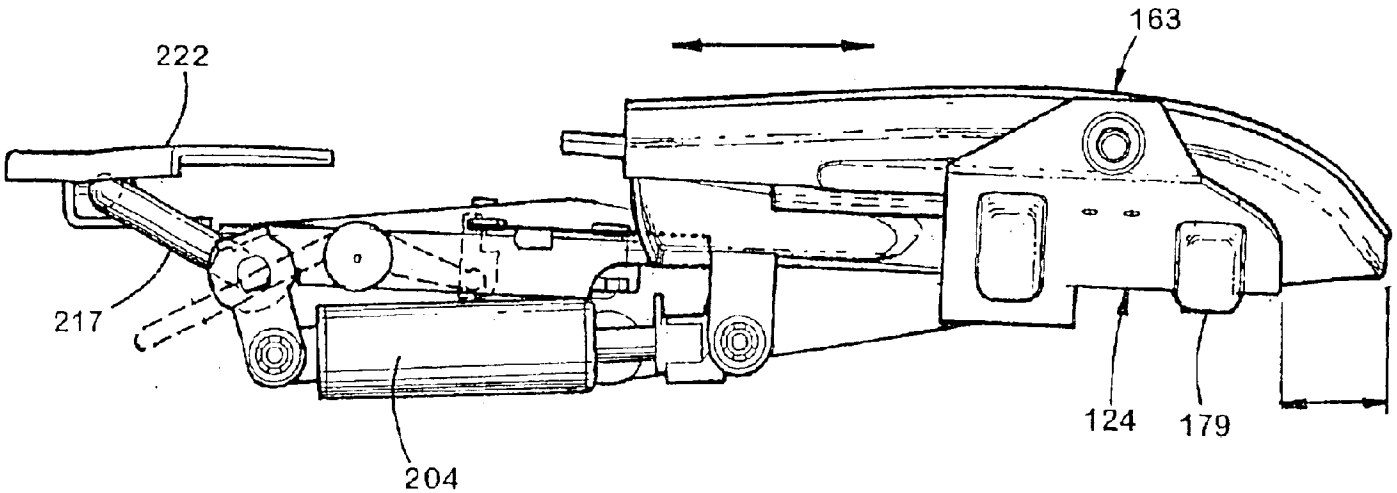
Figure 26:
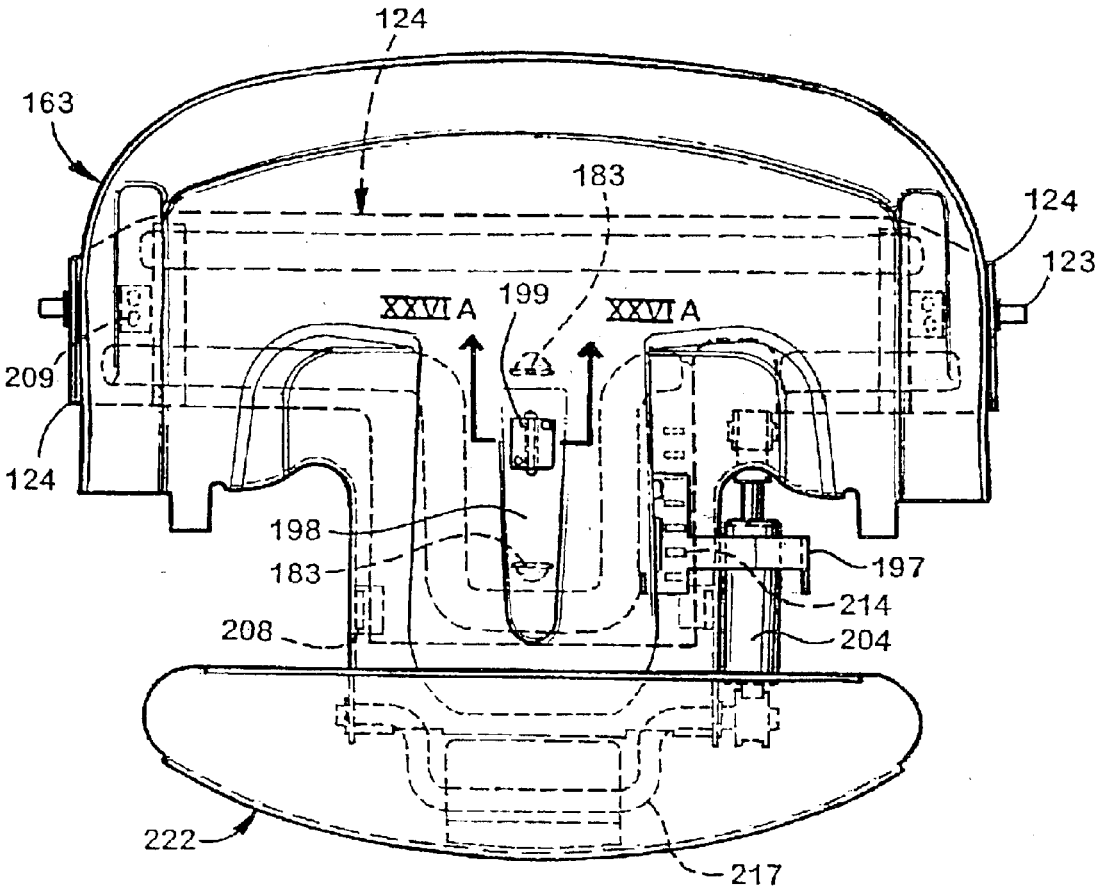
Figure 26A:
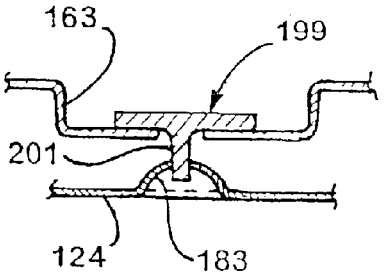
Figure 27:
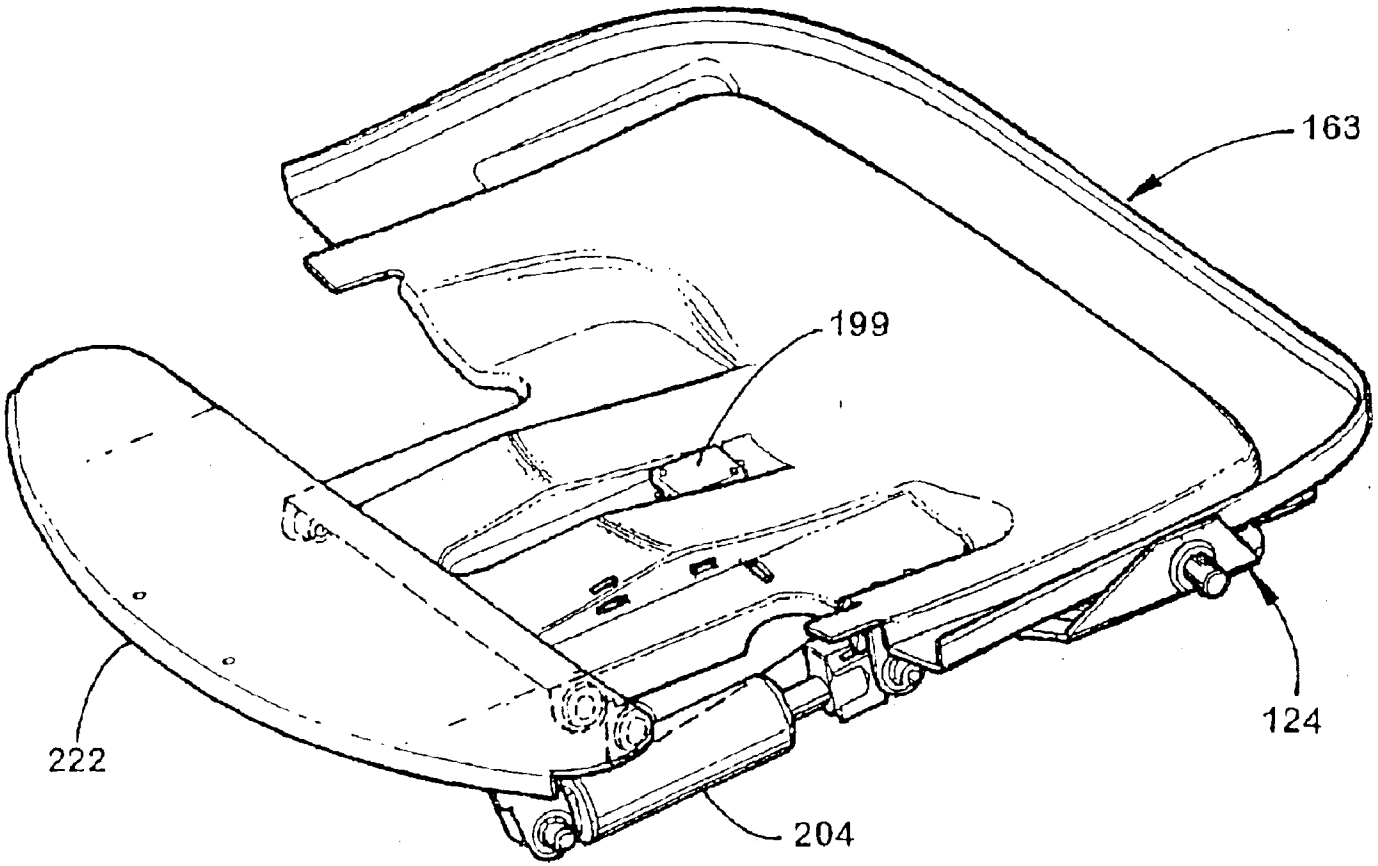
Figure 28:
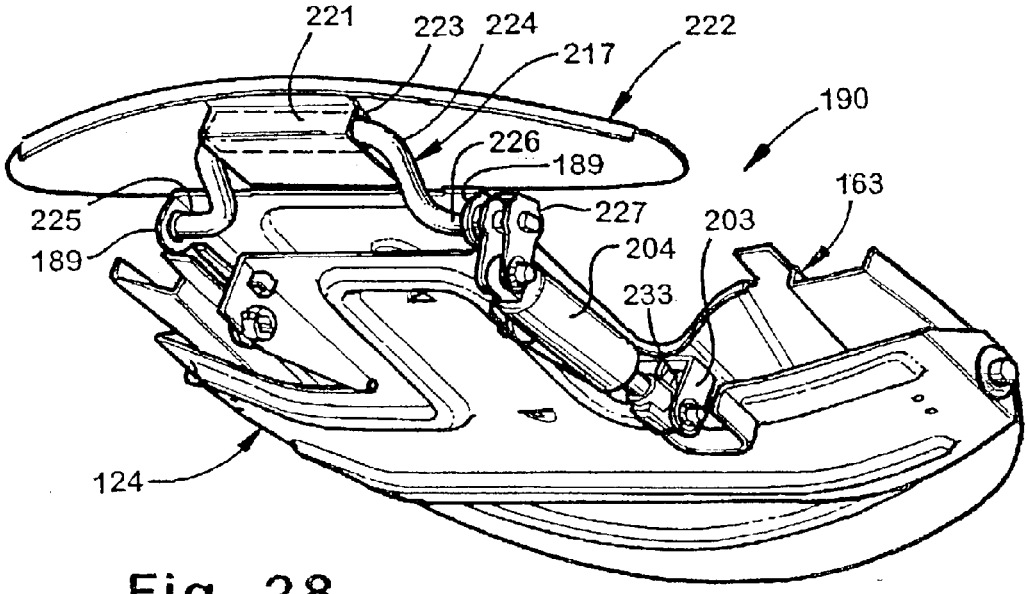
Figure 29:
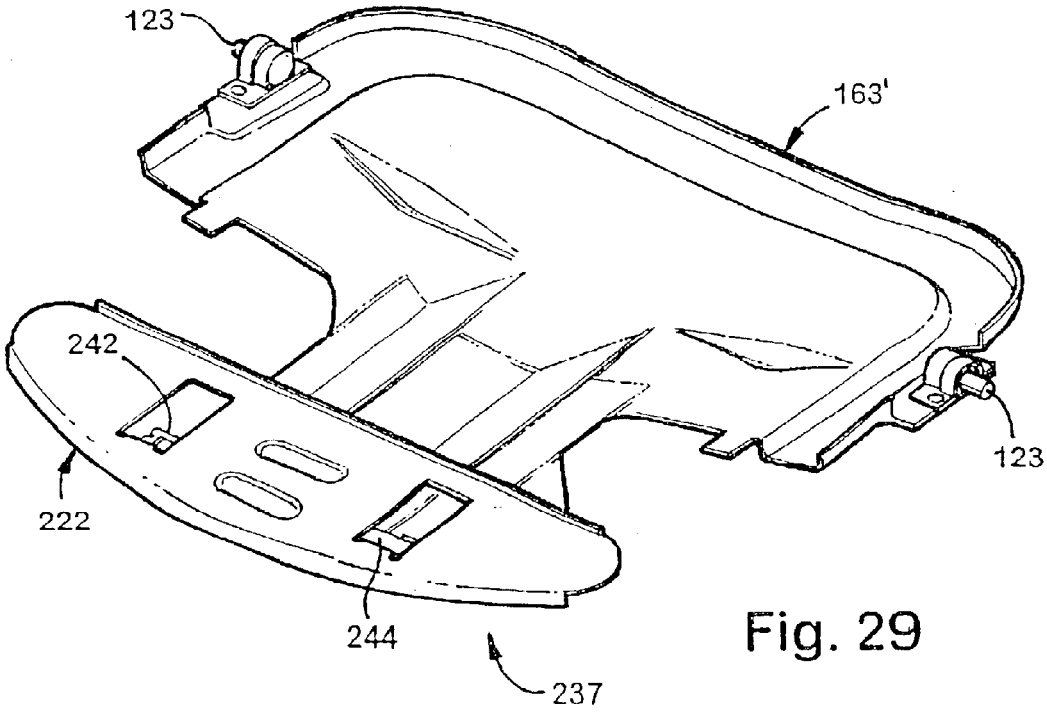
Figure 30:
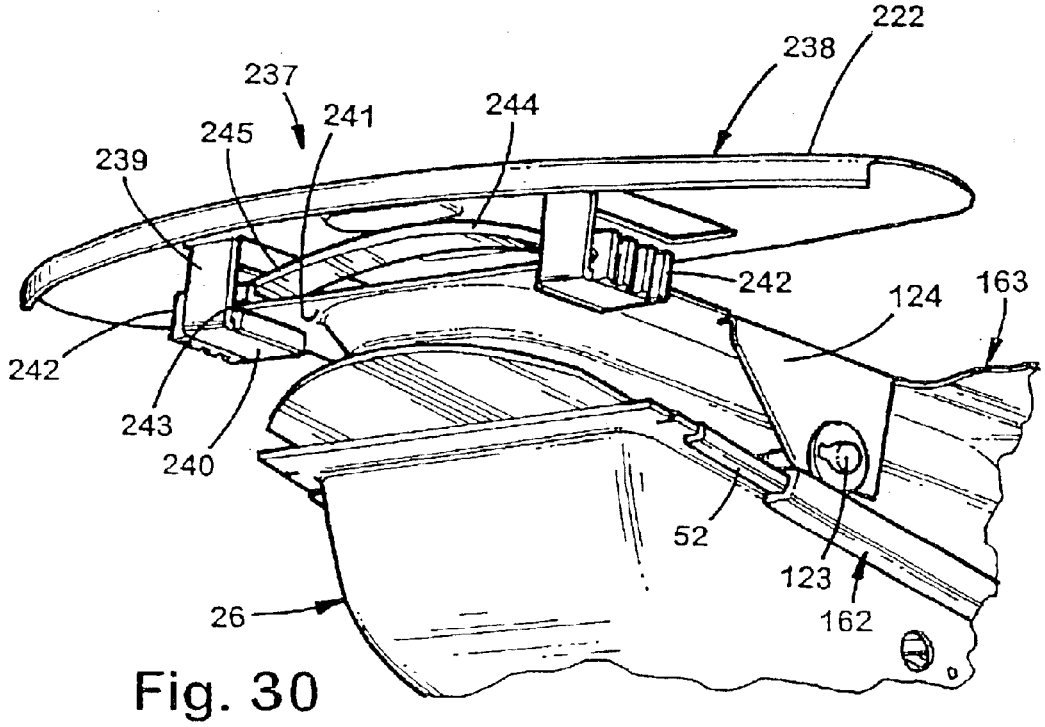
Figure 31:
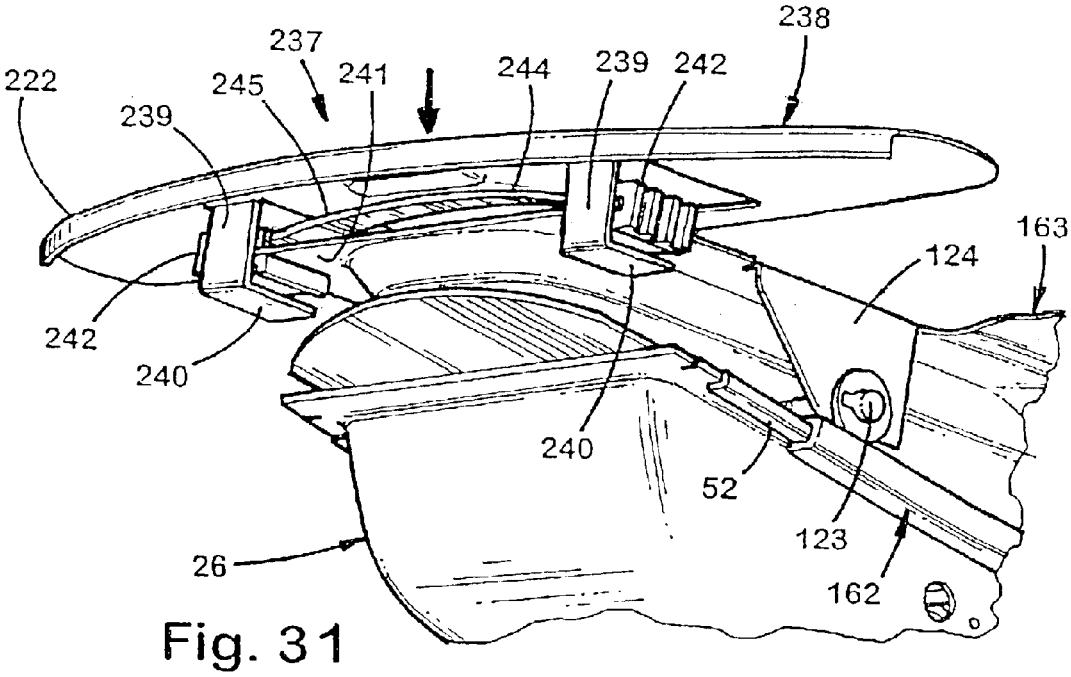

21 including a depth-adjuster control handle, a linkage, and a latch for holding a selected depth position of the seat;

FIGS. 24 and 25 are side views of the depth-adjustable seat shown in FIG. 21, FIG. 24 showing the seat adjusted to maximize seat depth, and FIG. 25 showing the seat adjusted to minimize seat depth; FIGS. 24 and 25 also showing a manually-adjustable "active" thigh support system including a gas spring for adjusting a front portion of the seat shell to provide optimal thigh support;

FIG. 26 is a top view of the seat support structure shown in FIGS. 24 and 25 including the seat carrier (shown mostly in dashed lines), the seat undercarriage/rear frame, the active thigh support system with gas spring and reinforcement plate for adjustably supporting the front portion of the seat, and portions of the depth-adjustment mechanism including a stop for limiting the maximum forward and rearward depth adjustment of the seat and the depth-setting latch;

FIG. 26A is a cross-section taken along line XXVIA—XXVIA in FIG. 26 showing the stop for the depth-adjuster mechanism;

FIGS. 27 and 28 are top and bottom perspective views of the seat support structure shown in FIG. 26;

FIGS. 29 and 30 are top and bottom perspective views of a seat similar to that shown in FIG. 26, but where the manually-adjustable thigh support system is replaced with a passive thigh support system including a leaf spring for supporting a front portion of the seat; and FIG. 31 is a bottom perspective view of the brackets and guide for supporting ends of the leaf spring as shown in FIG. 30, but with the thigh-supporting front portion of the seat flexed downwardly causing the leaf spring to flex toward a flat compressed condition.

DETAILED DESCRIPTION OF PREFERRED EMBODIMENTS

Figure 1:
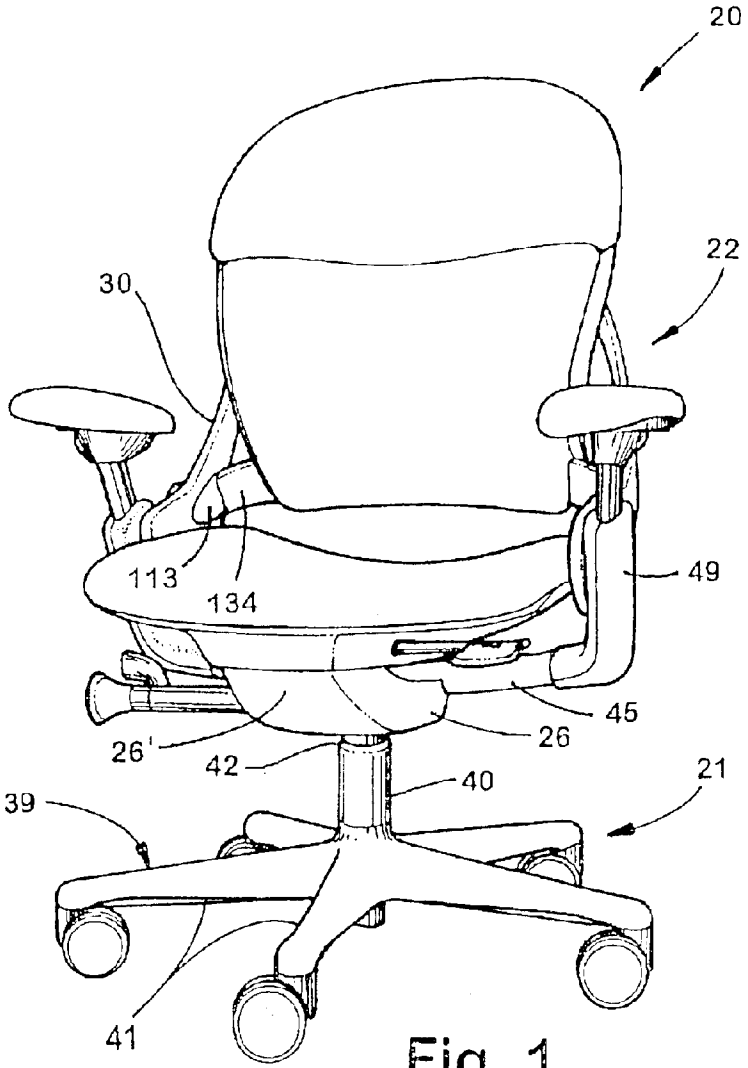

For purposes of description herein, the terms "upper," "lower," "right," "left," "rear," "front," "vertical," "horizontal," and derivatives thereof shall relate to the invention as oriented in FIG. 1 with a person seated in the chair. However, it is to be understood that the invention may assume various alternative orientations, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as unnecessarily limiting, unless the claims expressly state otherwise.

Figure 2:
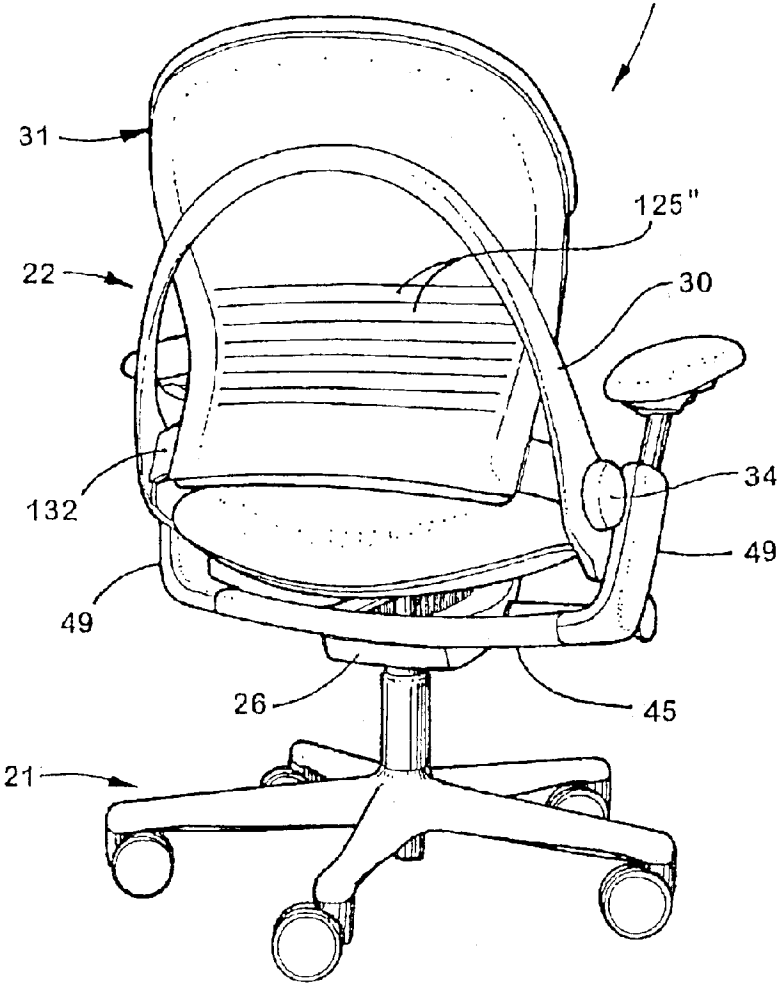
FIGS. 1–3 are front, rear, and side perspective views of a reclineable chair embodying the present invention.
Figure 6:
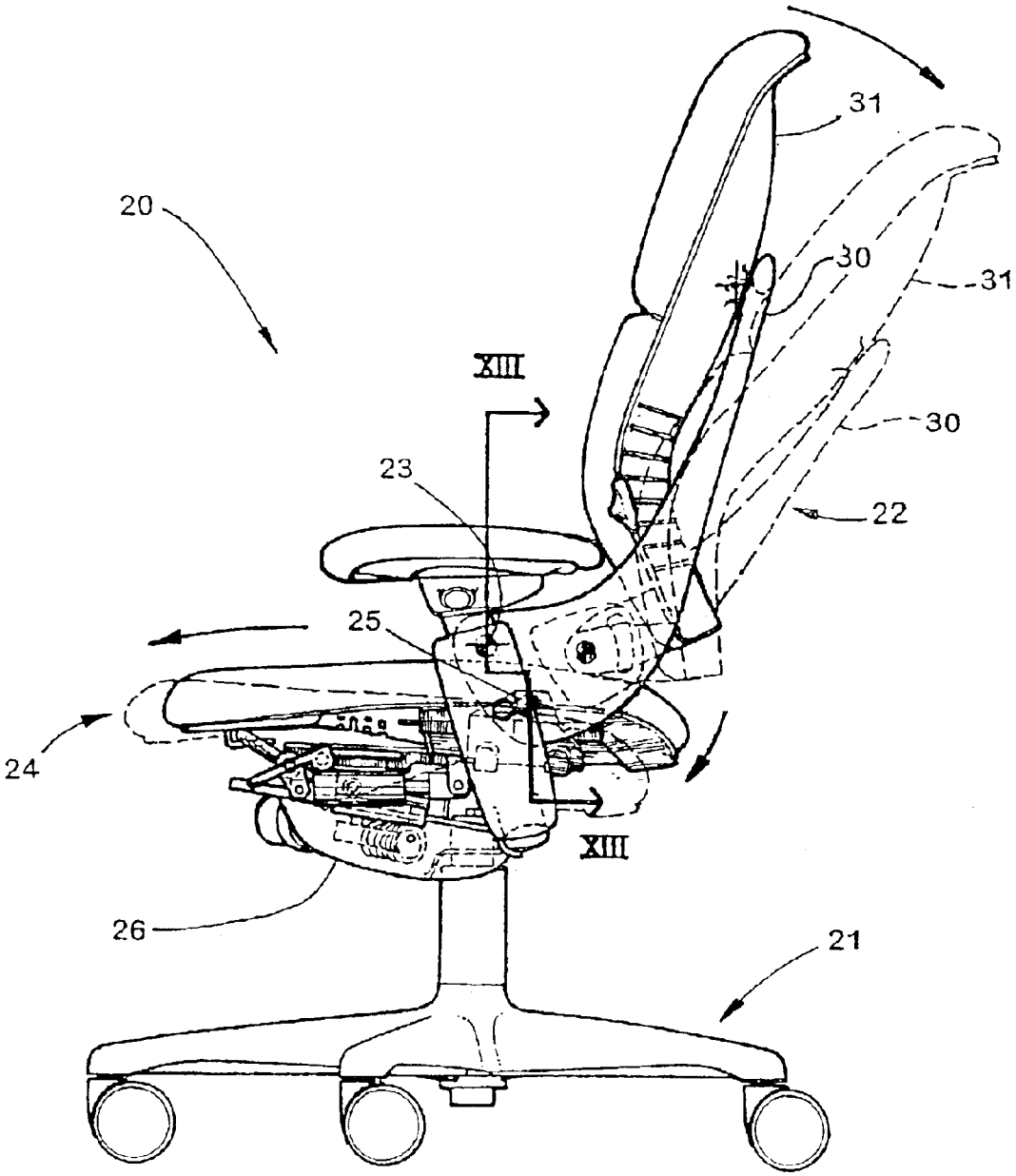
Figure 7:
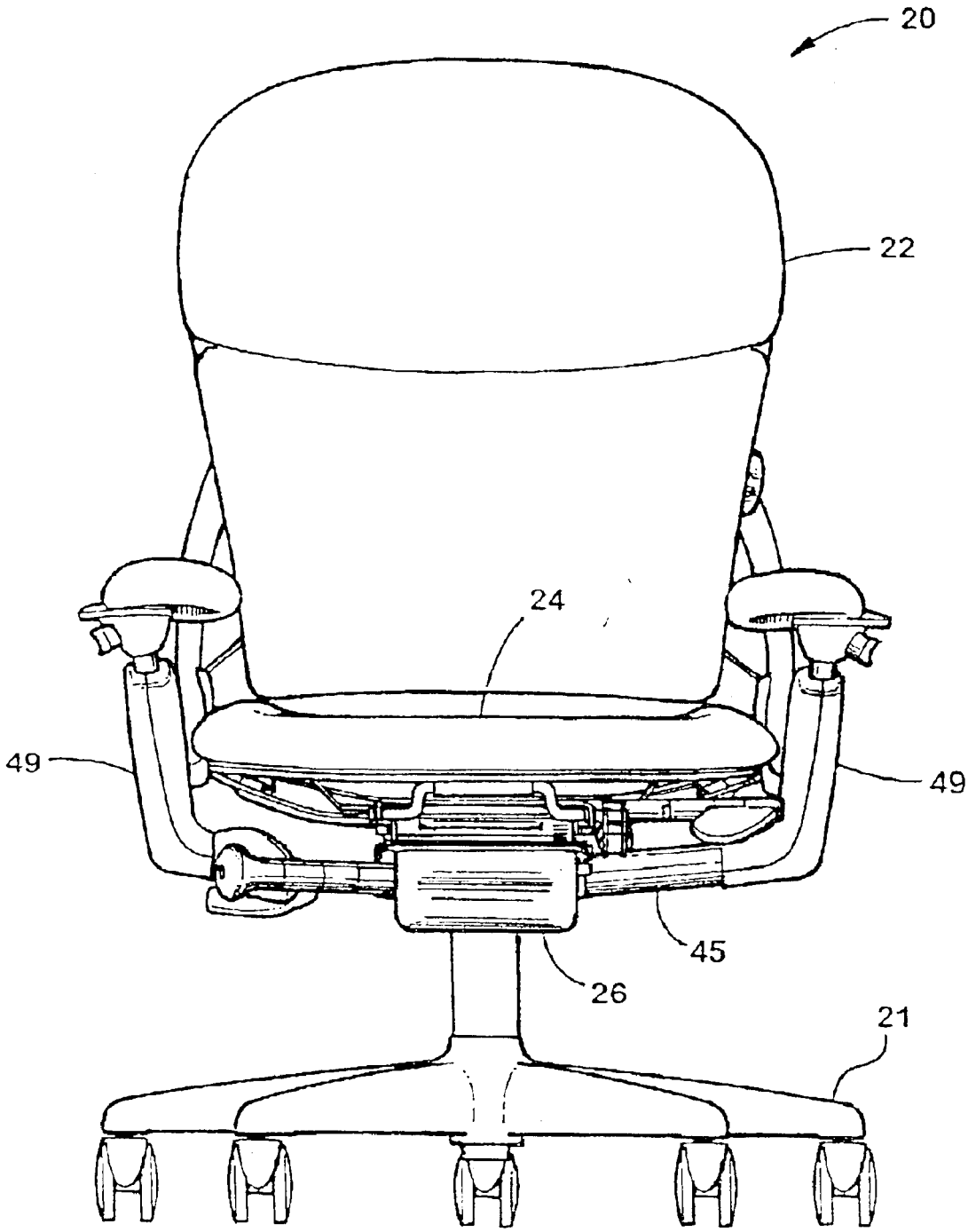
FIG. 7 is a front view of the chair shown in FIG. 1 with an underseat aesthetic cover removed.

A chair construction 20 (FIGS. 1 and 2) embodying the present invention (sometimes referred to herein as a "seating unit") includes a castored base assembly 21 and a reclineable back assembly 22 pivoted to the base 21 for movement about a stationary back-tilt axis 23 between upright and reclined positions. A seat assembly 24 (FIG. 6) is pivoted at its rear to the back 22 for movement about a seat-tilt axis 25. Seat-tilt axis 25 is offset rearwardly and downwardly from the back-tilt axis 23, and the seat 24 is slidably supported at its front on the base 21 by linear bearings, such that the seat 24 slides forwardly and its rear rotates downwardly and forwardly with a synchrotilt movement as the back 22 is reclined (see FIG. 6). The synchronous motion initially moves the back to seat at an angular synchronous ratio of about 2.5:1, and when near the fully reclined position moves the back to seat at an angular synchronous ratio of about 5:1. The seat 24 and back 22 movement during recline provides an exceptionally comfortable ride that makes the seated user feel stable and secure. This is due in part to the fact that the movement keeps the seated user's center of gravity relatively constant and keeps the seated user in a relatively balanced position over the chair base. Also, the forward slide/synchronous motion keeps the seated user near his/her work during recline more than in previous synchrotilt chair constructions, such that the problem of constantly scooting forward after reclining and then scooting rearward when moving toward an upright position is greatly reduced, if not eliminated. Another advantage is that the chair construction 20 can be used close to a wall behind the chair or in a small office, with less problems resulting from interference from office furnishings during recline. Still further, we have found that the spring 28 for biasing the back 22 toward an upright position can be potentially reduced in size because of the reduced rearward shifting of a seated user's weight in the present chair.

The base 21 includes a control housing 26. A primary energy mechanism 27 (FIG. 8) is operably positioned in control housing 26 for biasing the seat 24 rearwardly. Due to the interconnection of the back 22 and the seat 24, the rearward bias of the seat 24 in turn biases the back 22 toward an upright position. Primary energy mechanism 27 (FIG. 8) includes a main spring 28 positioned transversely in the control housing 26 that operably engages a torque member or lever 54. The tension and torque provided by the main spring 28 is adjustable via an adjustable moment arm shift (MAS) system 29 also positioned substantially in the control housing 26. A visual cover 26 (FIG. 1) covers (he area between the control housing 26 and the underside of the seat 24. The back assembly 22 includes a back support or back frame 30 (FIG. 4A) with structure that defies pivots/axes 23 and 25. A flexible/compliant back shell construction 31 is pivoted to back frame 30 at top connections 32 and bottom connections 33 in a manner providing an exceptionally comfortable and sympathetic back support. A torsionally-adjustable lumbar support spring mechanism 34 is provided to bias the back shell 31 forwardly into a forwardly-convex curvilinear shape optimally suited for providing good lumbar pressure. A vertically-adjustable lumbar support 35 (FIG. 16) is operatively mounted on back shell 31 for vertical movement to provide an optimal shape and pressure location to the front support surface on back 22. The seat 24 is provided with various options to provide enhanced chair functions, such as a back-stop mechanism 36 (FIG. 8) which adjustably engages the seat 24 to limit recline of the back 22. Also, the seat 24 can include active and passive thigh support options (see FIGS. 24 and 30, respectively), seat depth adjustment (see FIGS. 28 and 25), and other seat options, as described below.

Base Assembly

The base assembly 21 (FIG. 1) includes a floor-engaging support 39 having a center hub 40 and radially-extending castored legs 41 attached to the center hub 40 in a spider-like configuration. A telescopingly-extendable center post 42 is positioned in center hub 40 and includes a gas spring that is operable to telescopingly extend the post 42 to raise the height of the chair. The control housing 26 is pan shaped (FIG. 11) and includes bottom panels and flanged sidewalls forming an upwardly-open structural member. A notch 43 is formed in one sidewall of the housing 26 for receiving a portion of the adjustable control for the MAS system 29. A front of the housing 26 is formed into an upwardly-facing U-shaped transverse flange 44 for receiving a transverse structural tube 45 (FIG. 8A), and a hole 46 (FIG. 11) is formed generally adjacent flange 44. The transverse tube 45 is welded to the flange 44 and extends substantially horizontally. A reinforcement channel 47 is welded in housing 26 of base assembly 21 immediately in front of transverse structural tube 45. A frustoconical tube section 48 is welded vertically to reinforcement 47 above hole 46, which tube section 48 is shaped to mateably and securely engage the upper end of extendable center post 42. A pair of stiff upwardly-extending side arms 49 (sometimes also called "struts" or "pods") are welded to the opposing ends of transverse tube 45. The side arms 49 each include a stiff plate 50 on their inside surface. The plates 50 include weld nuts 51 that align to define the back-tilt axis 23. The housing 26, transverse tube 45, and side arms 49 form a base frame that is rigid and sturdy. The sidewalls of the housing 26 include a lip or flange that extends along their upper edge to reinforce the sidewalls. A cap 52 is attached to the lips to form a stationary part of a linear bearing for slidably supporting a front of the seat.

Primary Energy Mechanism and Operation

Figure 8:
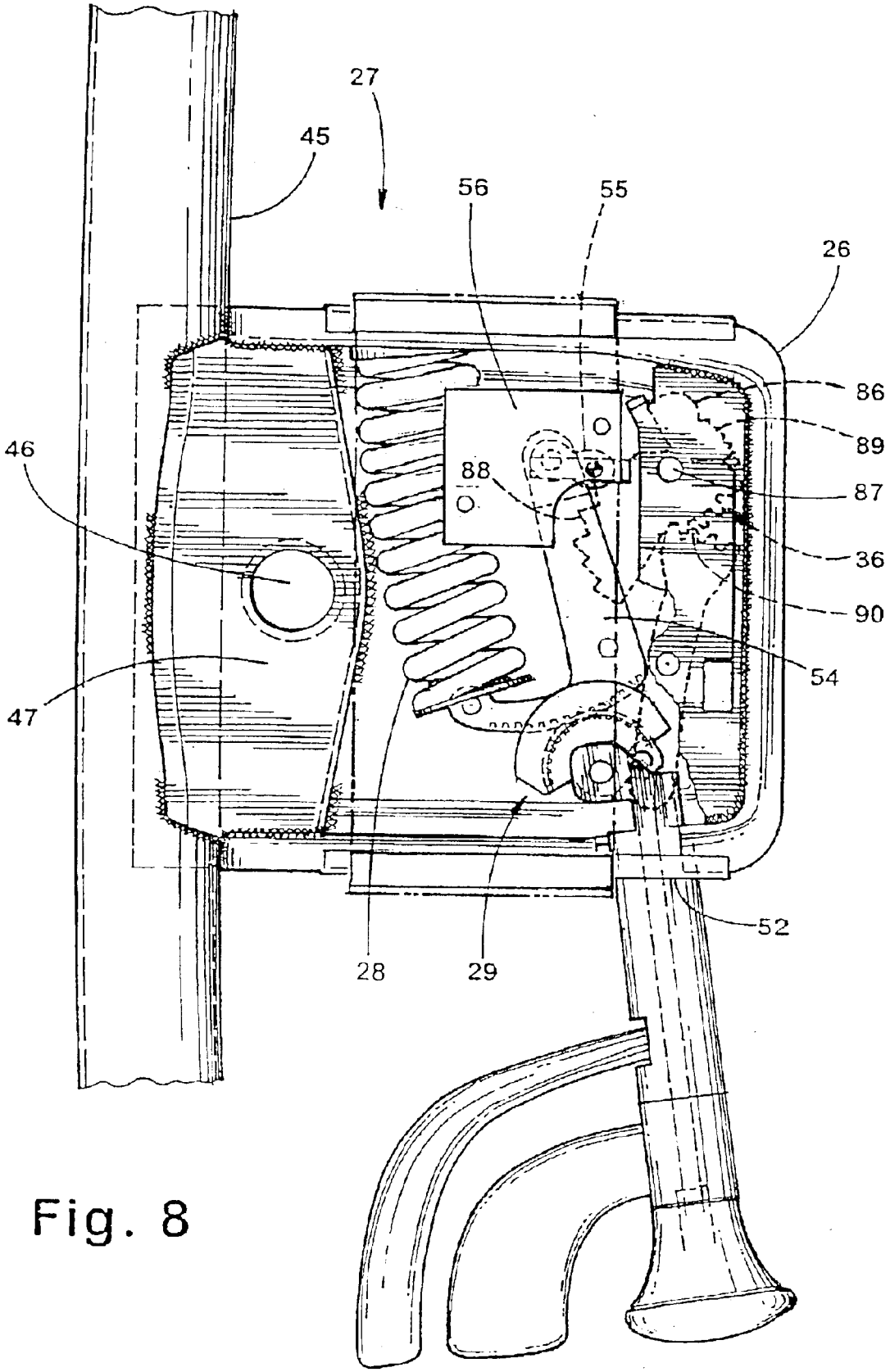
FIG. 8 is a top view of the control including the primary energy mechanism, the moment arm shift adjustment mechanism, and the back-stop mechanism, the primary energy mechanism being adjusted to a relatively low torque position and being oriented as it would be when the back is in the upright position so that the seat is in its rearward at-rest position, the back-stop mechanism being in an intermediate position for limiting the back to allow a maximum recline.
Figure 8A:
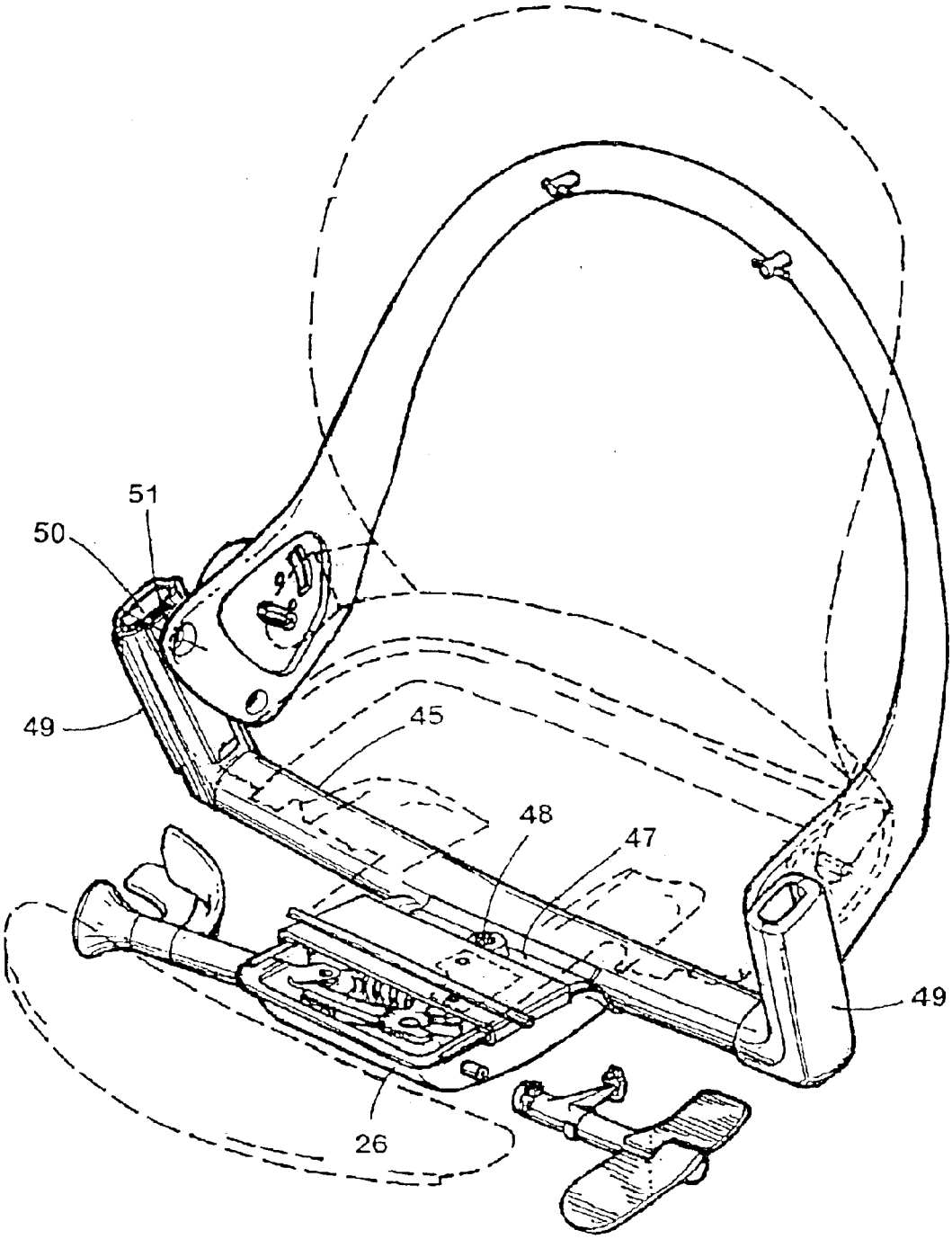
FIG. 8A is a perspective view of the base frame and the chair control shown in FIG. 8, some of the seat and back support structure being shown in phantom lines and some of the controls on the control being shown in solid lines to show relative locations thereof.
Figure 9:
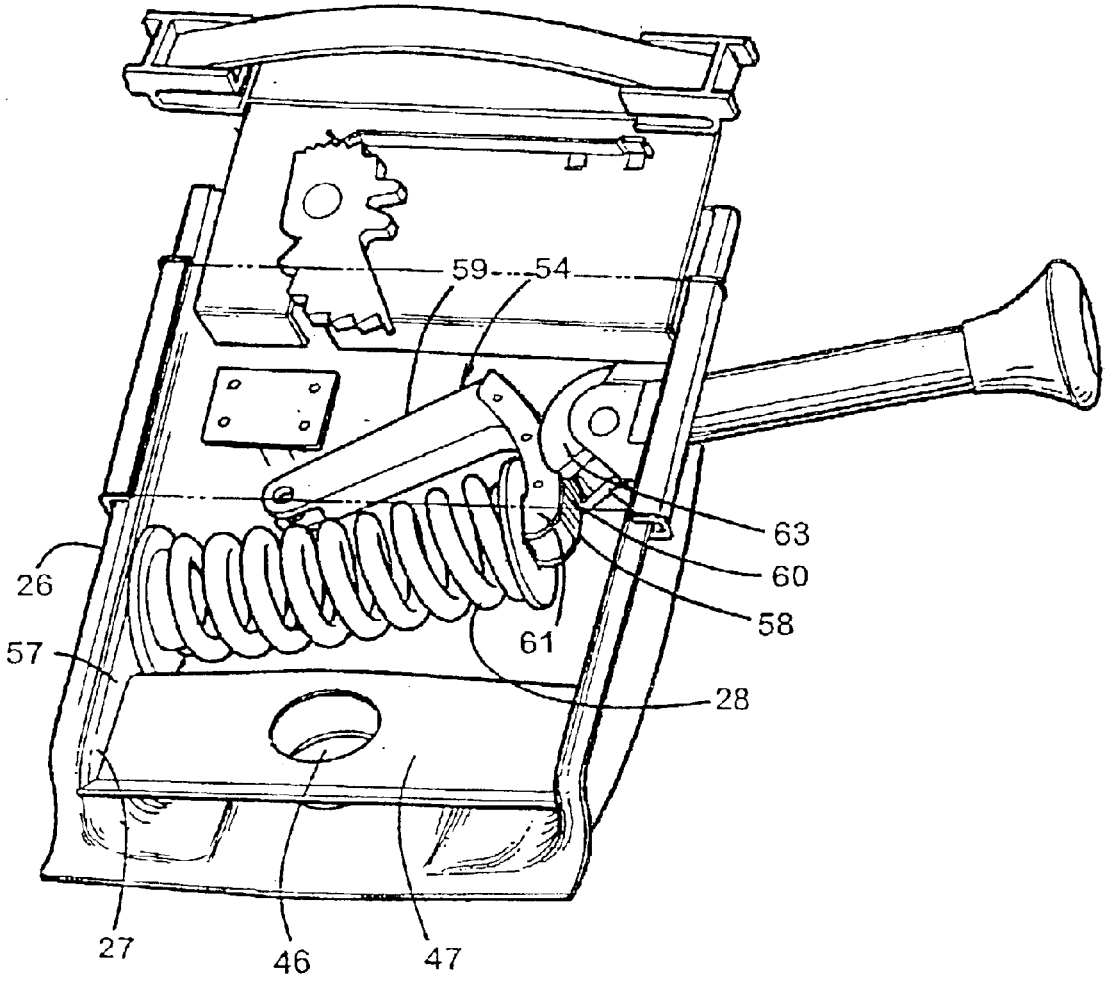
FIG. 9 is a perspective view of the control and primary energy mechanism shown in FIG. 8, the primary energy mechanism being adjusted to a low torque position and shown as if the back is in an upright position such that the seat is moved rearwardly.
Figure 9A:
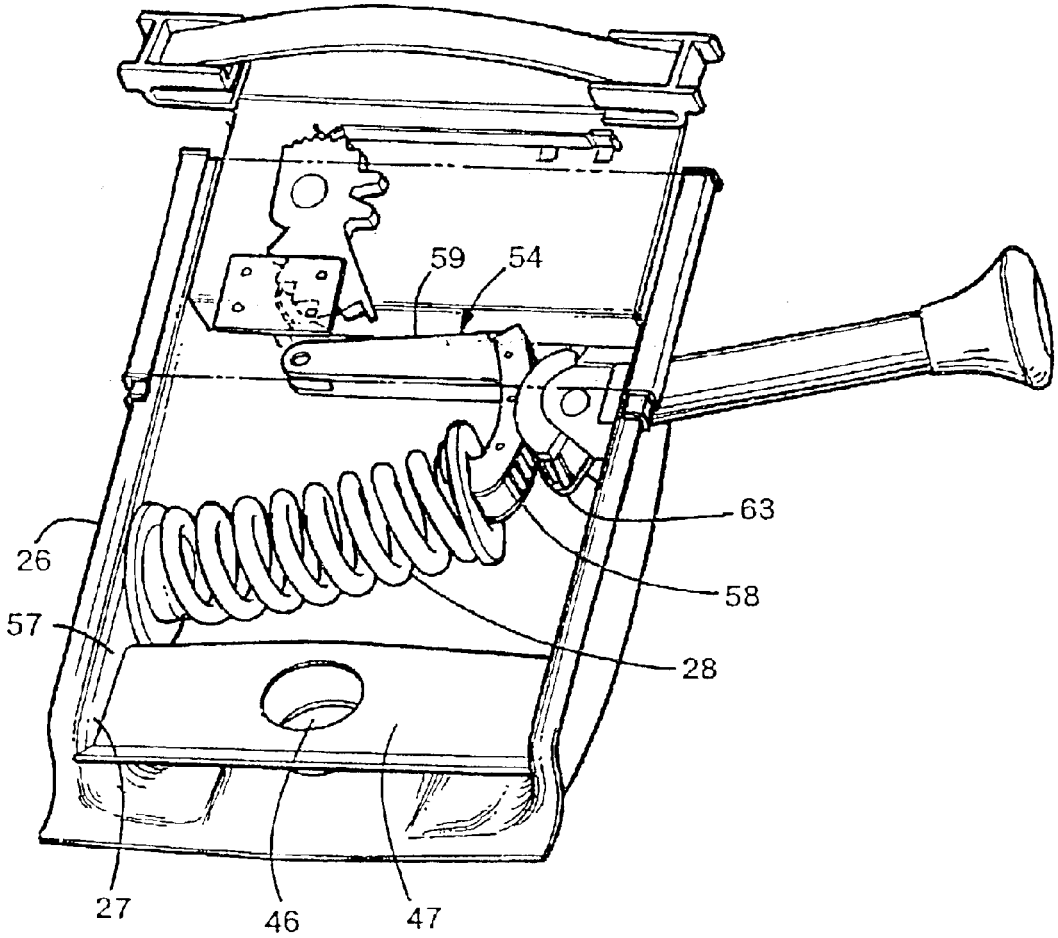
FIG. 9A is a perspective view of the control and primary energy mechanism shown in FIG. 9, the primary energy mechanism being adjusted to the low torque position but shown as if the back is in a reclined position such that the seat is moved forwardly and the spring is compressed.
Figure 9B:
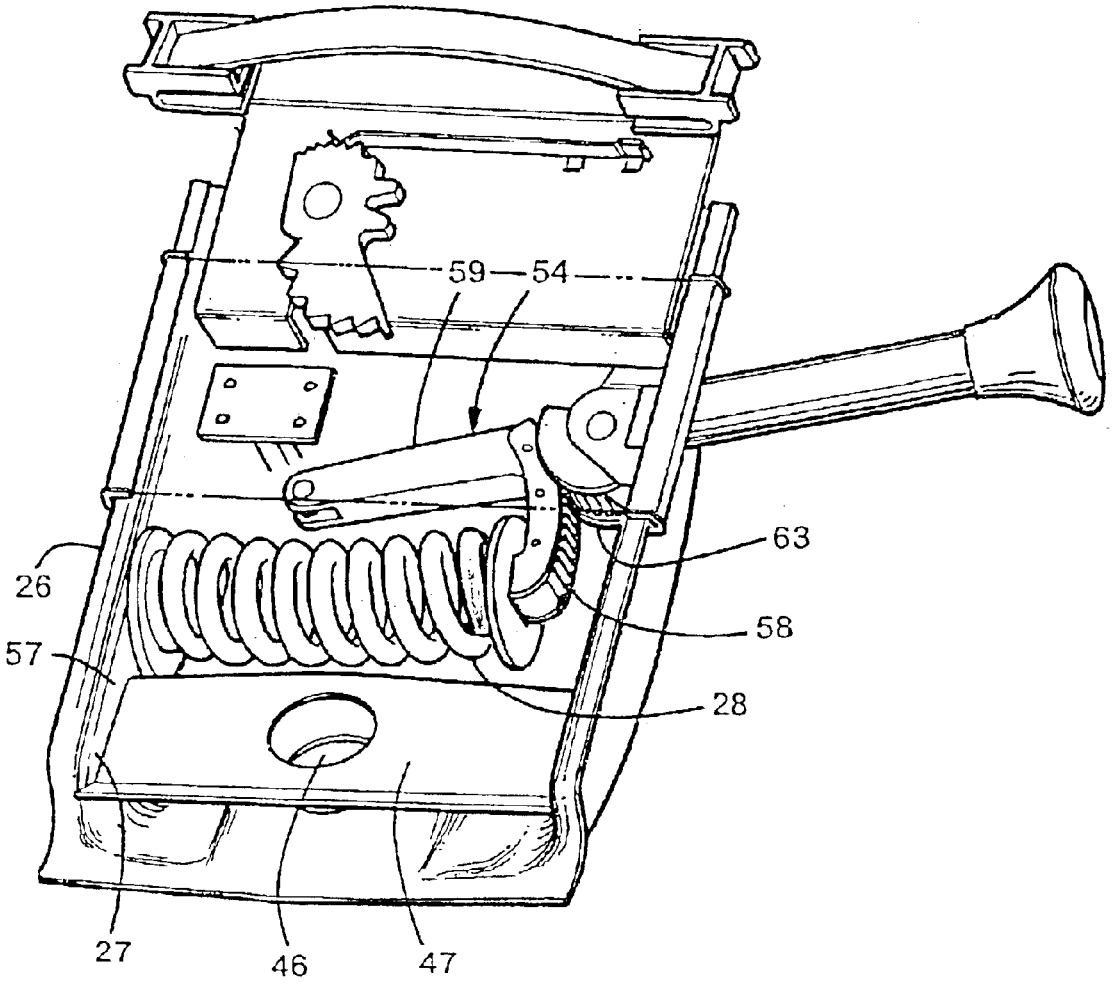
FIG. 9B is a perspective view of the control and primary energy mechanism shown in FIG. 9, the primary energy mechanism being adjusted to a high torque position and shown as if the back is in an upright position such that the seat is moved rearwardly.
Figure 9C:
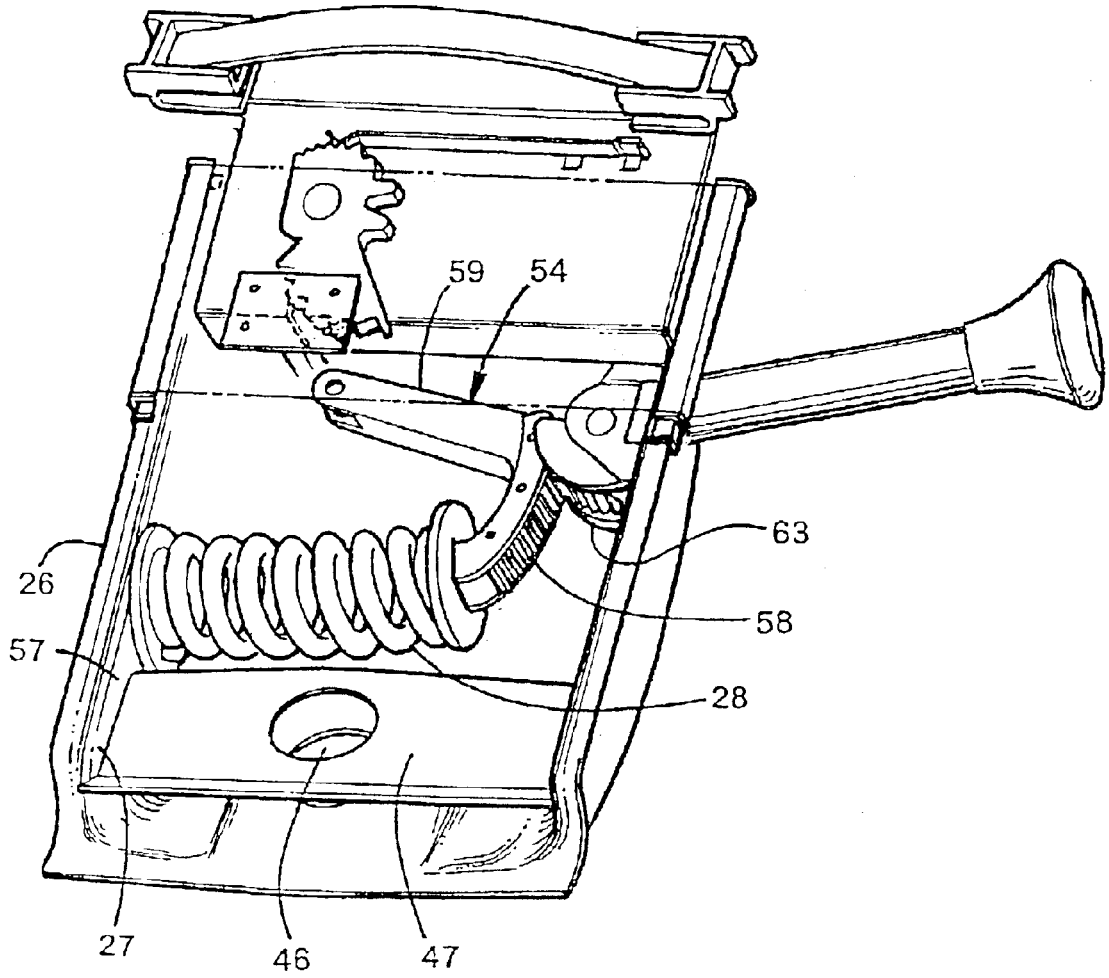
FIG. 9C is a perspective view of the control and primary energy mechanism shown in FIG. 9, the primary energy mechanism being adjusted to the high torque position but shown as if the back is in a reclined position such that the seat is moved forwardly and the spring is compressed.
Figure 10:
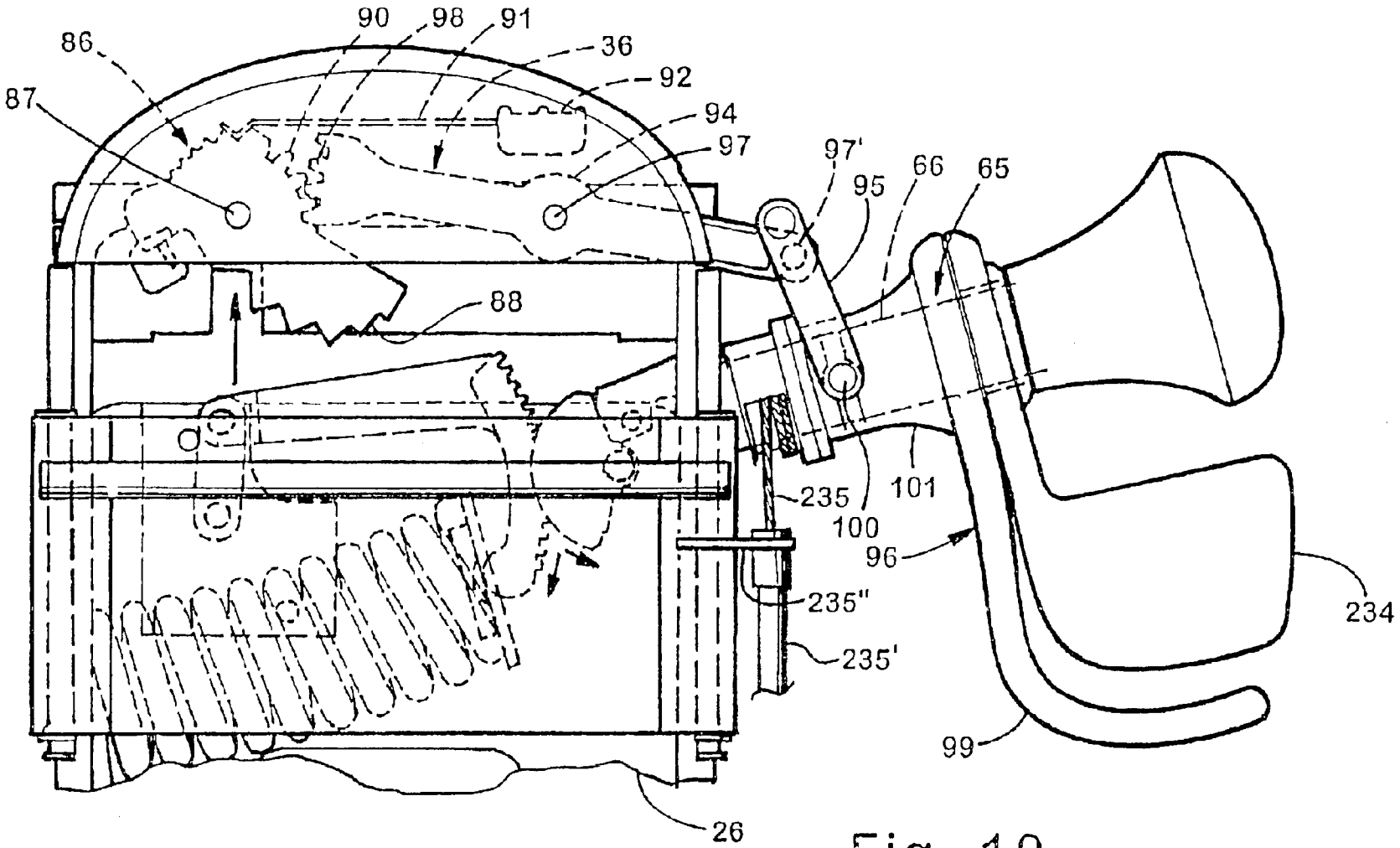
FIG. 10 is an enlarged top view of the control and primary energy mechanism shown in FIG. 8, including controls for operating the back-stop mechanism, the back-stop mechanism being shown in an off position.
Figure 11:
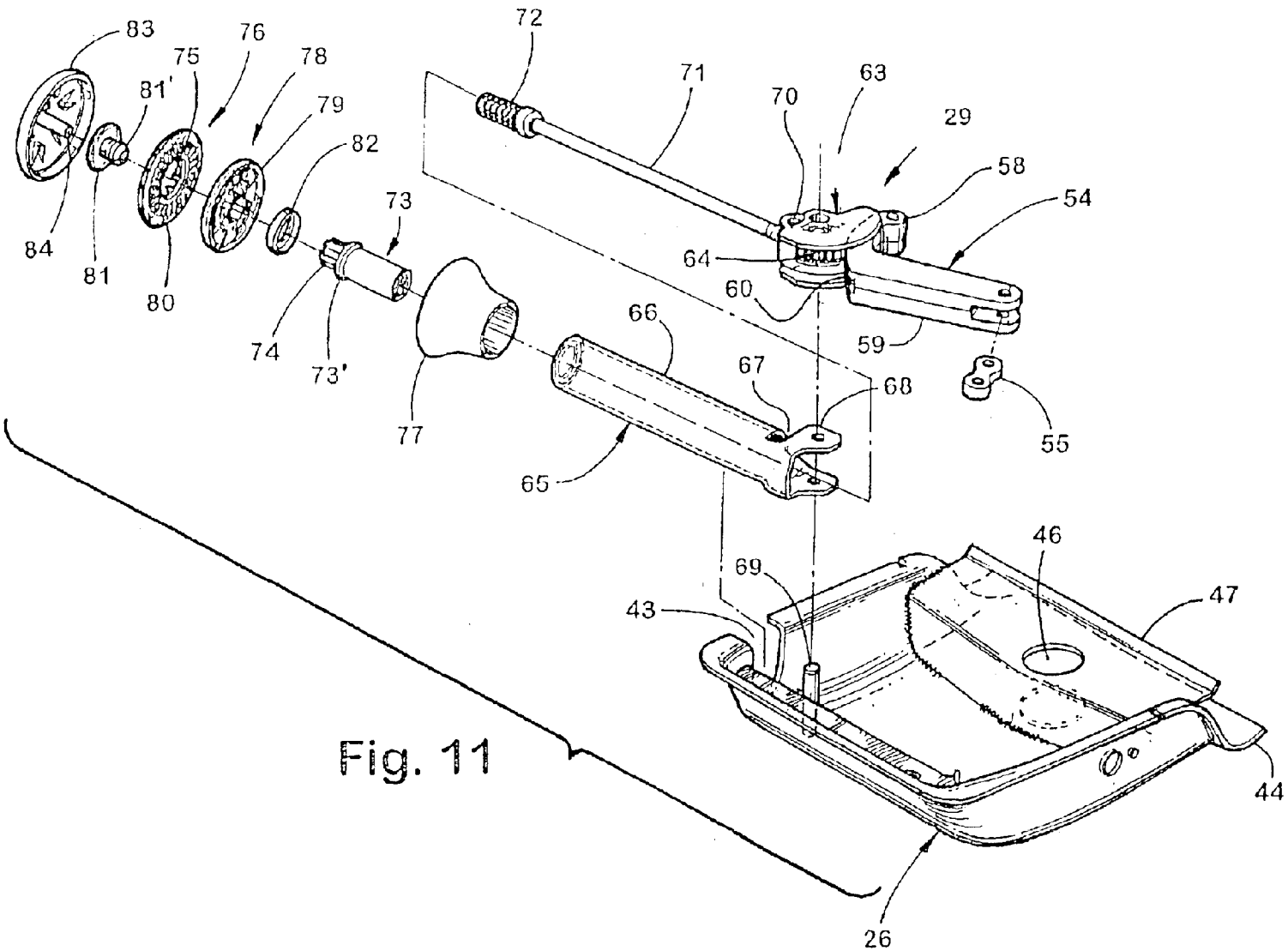
FIG. 11 is an exploded view of the mechanism for adjusting the primary energy mechanism, including the overtorque release mechanism for same.

It is noted that the housing 26 shown in FIGS. 9–9C and 10 is slightly longer and with different proportions than the housing of FIGS. 8, 8A, and 11, but the principles of operation are the same. The primary energy mechanism 27 (FIG. 8) is positioned in housing 26. The primary energy mechanism 27 includes the spring 28, which is operably connected to the seat 24 by an L-shaped torque member or bell crank 54, a link 55, and a seat-attached bracket 56. The spring 28 is a coil spring transversely positioned in housing 26, with one end supported against a side of housing 26 by a disc-shaped anchor 57. The anchor 57 includes a washer to support the end of the spring 28 to prevent noise, and further includes a protrusion that extends into a center of the end of the spring 28 to securely grip the spring 28, but that allows the spring 28 to be compressed and to tilt/flex toward a side while the torque member or bell crank 54 is being pivoted. The L-shaped torque member or bell crank 54 includes a short leg or lever 58 and a long leg 59. The short leg 58 has a free end that engages an end of the spring 28 generally proximate a left side of housing 26 with a washer and protrusion similar to anchor 57. Short leg 58 is arcuately shaped and includes an outer surface facing the adjacent sidewall of housing 26 that defines a series of teeth 60. Steel strips 61 are attached to the top and bottom sides of the short leg 58 and have an outer arcuate surface that provides a smooth rolling bearing surface on the leg 58, as described below. The arcuate surface of the strips 61 is generally located at about the apex or the pitch diameter of the gear teeth 60. The short leg 58 extends generally perpendicular to a longitudinal direction of spring 28 and the long leg 59 extends generally parallel the length of spring 28, but is spaced from the spring 28. Link 55 (FIG. 8) is pivoted to an end of long leg 59 and is also pivoted to the seat-attached bracket 56.

A crescent-shaped pivot member 63 (FIG. 11) includes art arcuate roller bearing surface that rollingly engages the curved surface of steel strips 61 on short leg 58 to define a moving fulcrum point. Pivot member 63 also includes a rack of teeth 64 configured to mateably engage the teeth 60 on short leg 58 to prevent any slippage between the interfacing roller bearing surfaces of leg 58 and pivot member 63. Pivot member 63 is attached to a side of the housing 26 at the notch 43. When the seat 24 is in a rearward position (Le., the back is in an upright position) (FIG. 9), the long leg 59 is located generally parallel and close to the spring 28 and the short leg 58 is pivoted so that the spring 28 has a relatively low amount of compression. In this position, the compression of spring 28 is sufficient to adequately bias the seat 24 rearwardly and in turn bias the back frame 30 to an upright position for optimal yet comfortable support to a seated user. As a seated user reclines, the seat 24 is moved forwardly (FIG. 9A). This causes the L-shaped torque member or bell crank 54 to roll on pivot member 63 at the fulcrum point in a manner compressing spring 28. As a result, spring 28 provides increasing force resisting the recline, which increasing force is needed to adequately support a person as they recline. Notably, the short leg 58 "walks" along the crescent-shaped pivot member 63 a short distance during recline, such that the actual pivot location changes slightly during recline. The generous curvilinear shapes of the short leg 58 and the pivot member 63 prevent any abrupt change in the support to the back during recline, but it is noted that the curvilinear shapes of these two components affect the spring compression in two ways. The "walking" of the short leg 58 on the pivot member 63 affects the length of the moment arm to the actual pivot point (i.e., the location where the teeth 60 and 64 actually engage at any specific point in time). Also, the "walking" can cause the spring 28 to be longitudinally compressed as the "walking" occurs. However, in a preferred form, we have designed the system so that the spring 28 is not substantially compressed during adjustment of the pivot member 63, for the reason that we want the adjustment to be easily accomplished. If adjustment caused the spring 28 to be compressed, the adjustment would require extra effort to perform the adjustment, which we do not prefer in this chair design.

As discussed below, the pivot member 63 is adjustable to change the torque arm over which the spring 28 operates. FIG. 9B shows the primary energy mechanism 27 adjusted to a high torque position with the seat 24 being in a rearward position (and the back frame 30 being in an upright position). FIG. 9C shows the primary energy mechanism 27 still adjusted to the high torque condition, but in the compressed condition with the seat 24 in a forward position (and the back frame 30 being in an upright position). Notably, in FIGS. 9B and 9C, the pivot member 63 has been adjusted to provide a longer torque arm on lever 58 over which the spring 28 acts.

Figure 9D:
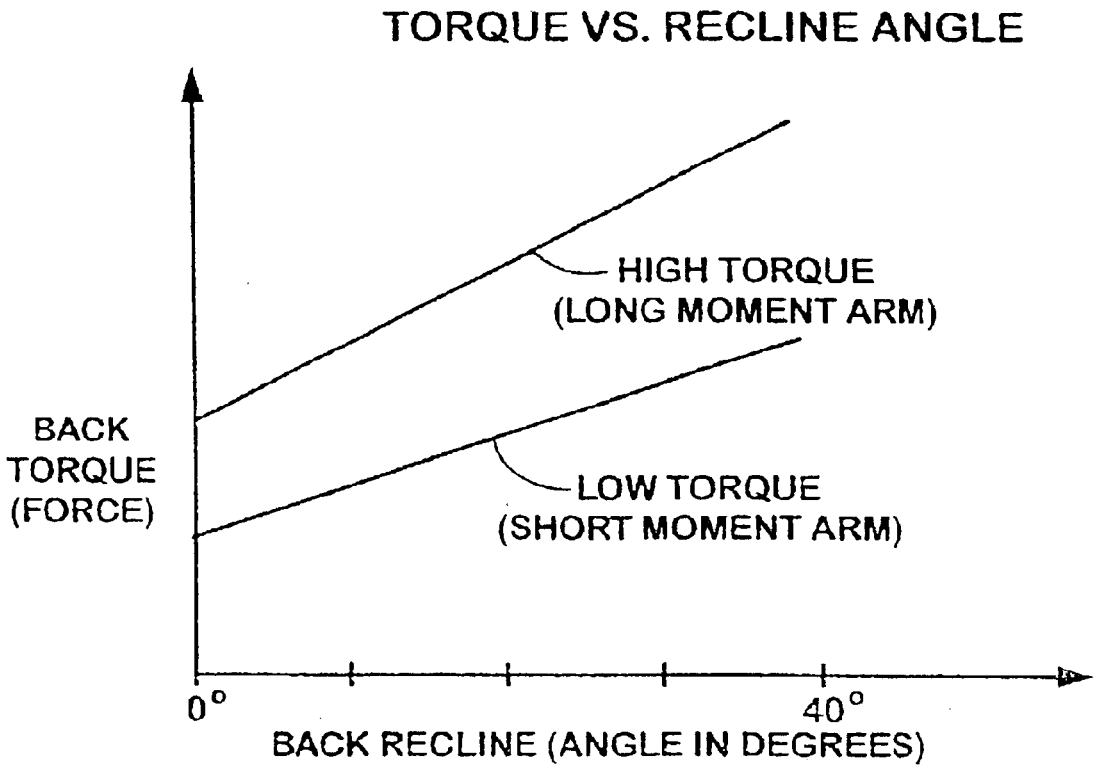
FIG. 9D is a graph showing torsional force versus angular deflection curves for the primary energy mechanism of FIGS. 9–9C, the curves including a top curve showing the forces resulting from the high torque (long moment arm engagement of the main spring) and a bottom curve showing the forces resulting from the low torque (short moment arm engagement of the main spring)

FIG. 9D is a graph illustrating the back torque generated by spring 28 as a function of the angle of recline. As apparent from the graph, the initial force of support can be varied by adjustment (as described below). Further, the rate of change of torsional force (i.e., the slope) varies automatically as the initial torsional force is adjusted to a higher force, such that a lower initial spring force results in a flatter slope, while a higher initial spring force results in a steeper slope. This is advantageous since lighter/smaller people not only require less support in the upright position of the chair, but also require less support during recline. Contrastingly, heavier/larger people require greater support when in upright and reclined positions. Notably, the desired slope of the high and low torque force/displacement curves can be designed into the chair by varying the shape of the short leg 58 and the pivot member 63.

The crescent-shaped pivot member 63 (FIG. 11) is pivotally supported on housing 26 by a bracket 65. The bracket 65 includes a tube section 66 and a configured end 67 with a juncture therebetween configured to mateably engage the notch 43 in the side of housing 26. The configured end 67 includes a pair of flanges 68 with apertures defining an axis of rotation 69 for the pivot member 63. The pivot member 63 is pivoted to the flanges 68 by a pivot pin and is rotatable around the axis 69. By rotating the pivot member 63, the engagement of teeth 60 and 64 and the related interfacing surfaces change in a manner causing the actual pivot point along short leg 58 of L-shaped torque member or bell crank 54 to change. (Compare FIGS. 9 and 9B.) As a result, the distance from the end of spring 28 to the actual pivot point changes. This results in a shortening (or lengthening) in the torque arm over which the spring 28 operates, which in turn results in a substantial change in the force/displacement curve (compare the top and bottom curves in FIG. 9D). The change in moment arm is relatively easily accomplished because the spring 28 is not compressed substantially during adjustment, since the interfacing surface on pivot member 63 defines a constant radius around its axis of rotation. Thus, adjustment is not adversely affected by the strength of spring 28. Nonetheless, the adjustment greatly affects the spring curve because of the resulting change in the length of the moment arm over which the spring 28 operates.

Pivoting of the pivot member 63 is accomplished through use of a pair of apertured flanges 70 (FIG. 11) on the pivot member 63 that are spaced from axis 69. An adjustment rod 71 extends through tube section 66 into configured end 67 and is pivoted to the apertured flanges 70. Rod 71 includes a threaded opposite end 72. An elongated nut 73 is threaded onto rod end 72. Nut 73 includes a washer 73' that rotatably engages an end of the tube section 66, and further includes a configured end 74 having longitudinally-extending ribs or slots shaped to mateably telescopingly engage mating ribs 75 on a driving ring 76. A handle 77 is rotatably mounted on tube section 66 and is operably connected to the driving ring 76 by an overtorque clutch ring 78. Clutch ring 78 includes resilient fingers 79 that operably engage a ring of friction teeth 80 on the driving ring 76. Fingers 79 are shaped to frictionally slip over teeth 80 at a predetermined torsional load to prevent damage to components of the chair 20. A retainer 81 includes resilient legs 81' that snappingly engage the end 74 of the nut 73 to retain the driving ring 76 and the clutch ring 78 together with a predetermined amount of force. A spacer/washer 82 rides on the end of the nut 73 to provide a bearing surface to better support the clutch ring 78 for rotation. An end cap 83 visually covers an end of the assembly. The end cap 83 includes a center protrusion 84 that snaps into the retainer 81 to forcibly keep the resilient legs of the retainer 81 engaged in the end of the nut 73.

In use, adjustment is accomplished by rotating the handle 77 on tube section 66, which causes nut 73 to rotate by means of clutch ring 78 and driving ring 76 (unless the force required for rotation of the nut 73 is so great that the clutch ring 78 slips on driving ring 76 to prevent damage to the components). As the nut 73 rotates, the rod 71 is drawn outwardly (or pressed inwardly) from the housing 26, causing the pivot member 63 to rotate. Pivoting the pivot member 63 changes the point of engagement (i.e. fulcrum point) of the pivot member 63 and the short leg 58 of the L-shaped torque member or bell crank 54, thus changing the moment arm over which the spring 28 acts.

Back-Stop Mechanism

The back-stop mechanism 36 (FIG. 8) includes a cam 86 pivoted to the housing 26 at location 87. The cam 86 includes stop surfaces or steps 88, detent depressions 89 that correspond to surfaces 88, and teeth 90. The steps 88 are shaped to mateably engage the seat-attached bracket 56 to limit the rearward rotation of the back frame 30 by limiting the rearward movement of the seat 24. This allows a seated user to limit the amount of recline to a desired maximum point. A leaf spring 91 (FIG. 10) is attached to the housing 26 by use of a U-shaped finger 92 that slips through a first hole and hooks into a second hole in the housing 26. The opposite end of the leaf spring includes a U-shaped bend 93 shaped to mateably slidably engage the detent depressions 89. The depressions 89 correspond to the steps 88 so that, when a particular step 88 is selected, a corresponding depression 89 is engaged by spring 91 to hold the cam 86 in the selected angular position. Notably, the steps 88 (and the depressions 89) are located angularly close together in the area corresponding to chair positions close to the upright position of the back frame 30, and are located angularly farther apart in the area corresponding to more fully reclined chair positions. This is done so that seated users can select from a greater number of back-stopping positions when near an upright position. It is noted that seated users are likely to want multiple back-stopping positions that are close together when near an upright position, and are less likely to select a back-stopping position that is near the fully reclined chair position.

The cam 86 is rotated through use of a control that includes a pivoting lever 94, a link 95, and a rotatable handle 96. The pivoting lever 94 is pivoted generally at its middle to the housing 26 at location 97. One end of the pivoting lever 94 includes teeth 98 that engage teeth 90 of cam 86. The other end of lever 94 is pivoted to rigid link 95 at location 97'. Handle 96 includes a body 101 that is rotatably mounted on tube section 66 of MAS pivot bracket 65, and further includes a flipper 99 that provides easy grasping to a seated user. A protrusion 100 extends from the body and is pivotally attached to link 95.

To adjust the back-stop mechanism 36, the handle 96 is rotated, which rotates cam 86 through operation of link 95 and lever 94. The cam 86 is rotated to a desired angular position so that the selected step 87 engages the seat-attached bracket 56 to prevent any further recline beyond the defined back-stop point. Since the seat 24 is attached to the back frame 30, this limits recline of the back 22.

Figures 11A, 11B, 11C:
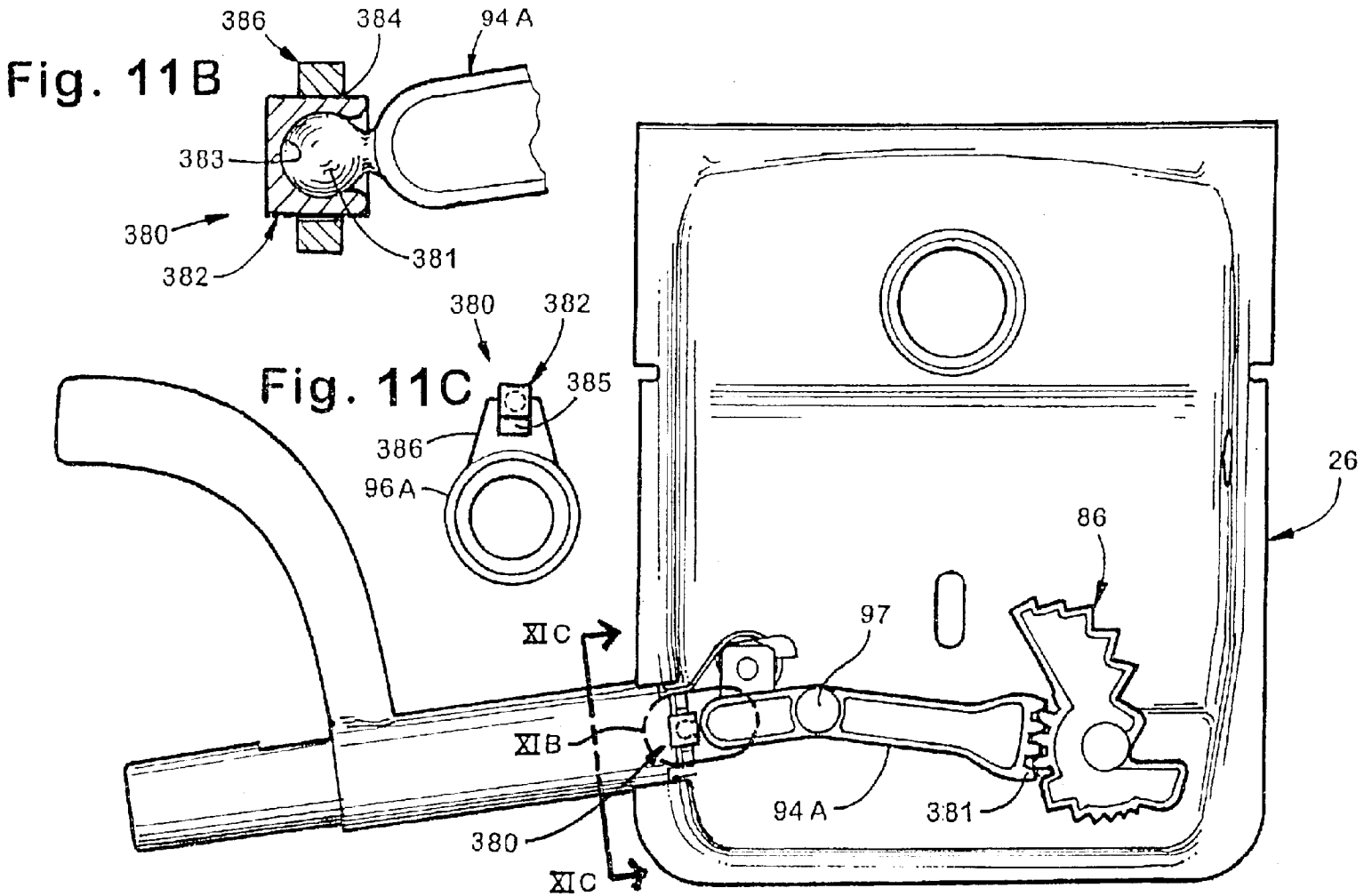
FIG. 11A is a plan view of a modified back-stop control and related linkages.
FIG. 11B is an enlarged fragmentary view, partially in cross-section, of the circled area in FIG. 11A.
FIG. 11C is a cross-sectional view taken along the line XIC—XIC in FIG. 11A.

A modified control for operating the back-stop cam 86 is shown in FIG. 11A. The modified control includes a pivoting lever 94A and rotatable handle 96A connected to the handle 96A by a rotary pivot/slide joint 380. The lever 94A includes teeth 381 that engage cam 86 and is pivoted to housing 26 at pivot 97, both of which are like lever 94. However, in the modified control, link 95 is eliminated and replaced with the single joint 380. Joint 380 includes a ball 381 (FIG. 11B) that extends from the lever 94A. A snap-on "car" or bearing 382 includes a socket 383 for pivotally engaging ball 381 to define a ball-and-socket joint. The bearing 382 includes outer surfaces 384 that slidably engage a slot 385 in a radially-extending arm 386 on handle 96A (FIG. 11C). The joint 380 operably connects the handle 96A to the lever 94A, despite the complex movement resulting from rotation of the handle 96A about a first axis, and from rotation of the lever 94A about a second axis that is skewed relative to the first axis.

Advantageously, the modified control provides an operable interconnection with few parts, and with parts that are partially inside of the control housing 26, such that the parts are substantially hidden from view to a person standing beside the chair.

Back Construction

The back frame 30 and back shell 31 (FIG. 12) form a compliant back support for a seated user that is particularly comfortable and sympathetic to back movements of the seated user, particularly in the lumbar area of the back 22.

Adjustment features on the assembly provide further comfort and allow a seated user to customize the chair to meet his/her particular needs and preferences in the upright through reclined positions.

The back frame 30 (FIG. 12A) is curvilinearly shaped and forms an arch across the back area of the chair 20. A variety of constructions are contemplated for back frame 30, and accordingly, the present invention should not be improperly limited to only a particular one. For example, the back frame 30 could be entirely metal, plastic, or a combination thereof. Also, the rigid internal reinforcement 102 described below could be tubular, angle iron, or a stamping. The illustrated back frame 30 includes a looping or arch-shaped internal metal reinforcement 102 and an outer molded-on polymeric skin or covering 103. (For illustrative purposes, the covering 103 is shown as if it is transparent (FIG. 12A), so that the reinforcement 102 is easily seen.) The metal reinforcement 102 includes a looping intermediate rod section 104 (only half of which is shown in FIG. 12A) having a circular cross-section. Reinforcement 102 further includes configured ends/brackets 105 welded onto the ends of the intermediate section 104. One or two of ° F-shaped top pivot connectors 107 are attached to intermediate section 104 near a top portion thereof. Notably, a single top connector 107, when used, allows greater side-to-side flexibility than with two top connectors, which may be desired in a chair where the user is expected to often twist his/her torso and lean to a side in the chair. A pair of spaced-apart top connectors 107 provide a stiffer arrangement. Each connector 107 (FIG. 12B) includes a stem 108 welded to intermediate section 104 and includes a transverse rod section 109 extended through stem 108. The rod section 109 is located outboard of the skin or shell 103 and is adapted to snap-in frictionally and pivotally engage a mating recess in the back shell 31 for rotation about a horizontal axis, as described below. The present invention is contemplated to include different back frame shapes. For example, the inverted U-shaped intermediate section 104 of back frame 30 can be replaced with an inverted T-shaped intermediate section having a lower transverse member that is generally proximate and parallel the belt bracket 132, and a vertical member that extends upwardly therefrom. In a preferred form, each back frame of the present chair defines spaced-apart lower connections or apertures 113 that define pivot points and a top connection(s) 107 forming a triangular tripod-like arrangement. This arrangement combines with the semi-rigid resiliently-flexible back shell 31 to posturally flexibly support and permit torsional flexing of a seated user's torso when in the chair. In an alternative form, the lower connections 113 could occur on the seat instead of the back of the chair.

Figure 12A:
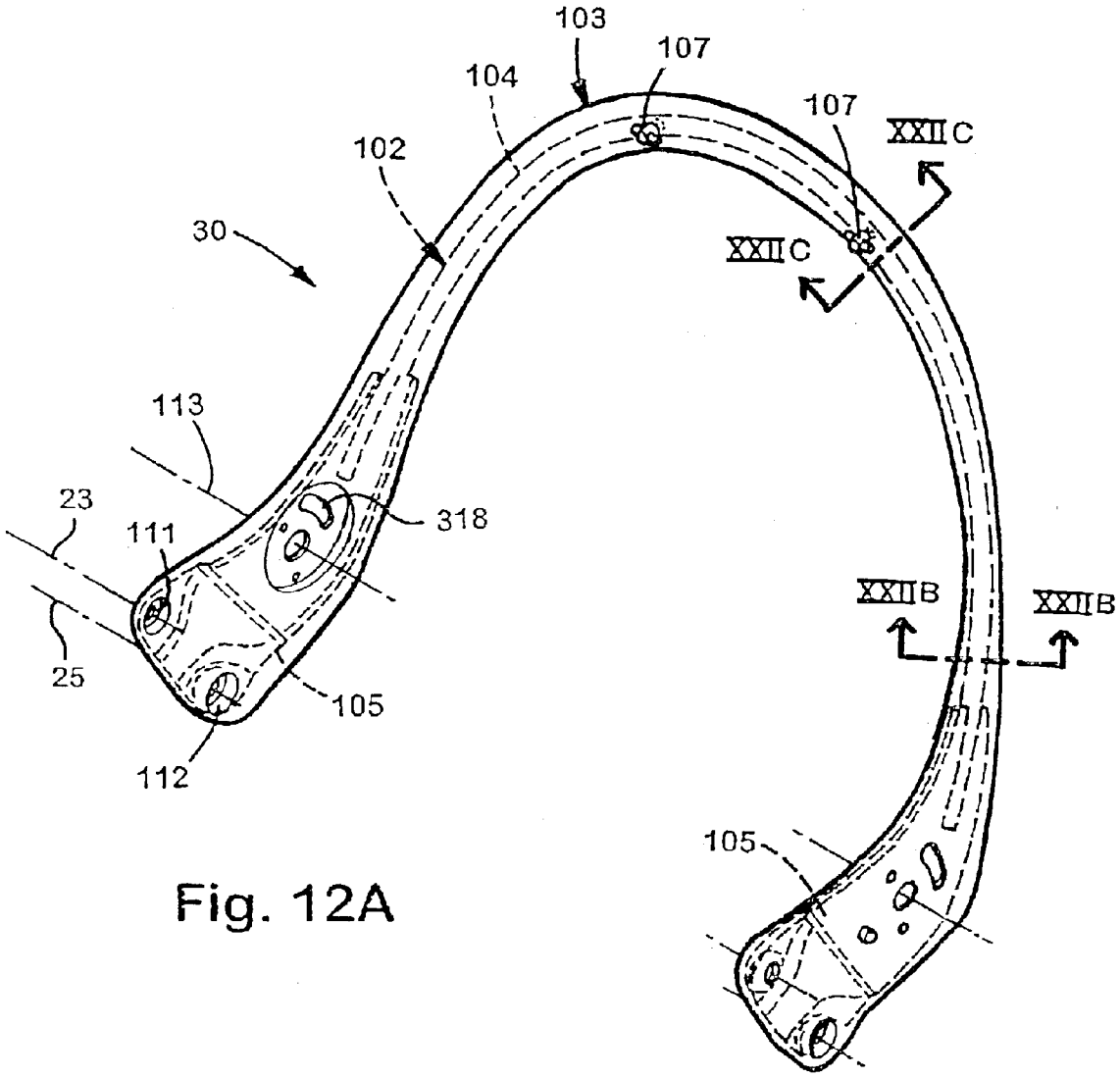
FIG. 12A is an enlarged perspective view of the back frame shown in FIG. 4A, the back frame being shown as if the molded polymeric outer shell is transparent so that the reinforcement can be easily seen.
Figure 13:
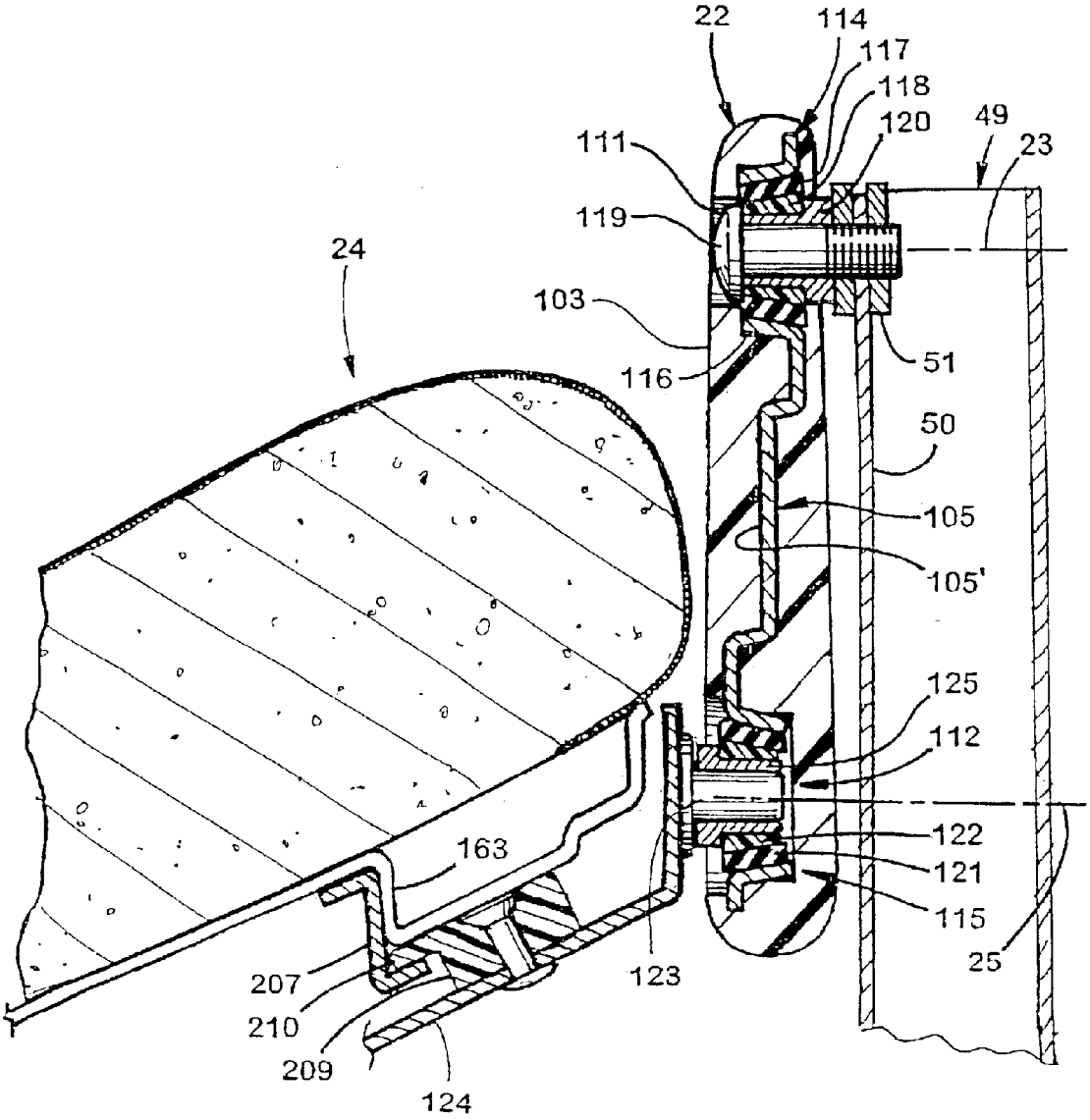
FIG. 13 is a cross-sectional side view taken along lines XIII—XIII showing the pivots that interconnect the base frame to the back frame and that interconnect the back frame to the seat frame.

The configured ends 105 include an inner surface 10' (FIG. 13) that may or may not be covered by the outer shell 103. In the illustrated back frame 30 of FIGS. 12A and 4A, the reinforcement 102 is substantially covered by the shell 103, but a pocket is formed on an inside surface at configured ends 105 at apertures 111–113. The configured ends 105 include extruded flanges forming apertures 111–113 which in turn define the back-tilt axis 23, the seat-tilt axis 25, and a bottom pivotal connection for the back shell 31, respectively. The apertures 111 and 112 (FIG. 13) include frustoconically-shaped flanges 116 defining pockets for receiving multi-piece bearings 114 and 115, respectively. Bearing 114 includes an outer rubber bushing 117 engaging the flanges 116 and an inner lubricous bearing element 118. A pivot stud 119 includes a second lubricous bearing element 120 that matingly slidingly engages the first bearing element 118. The stud 119 is extended through bearing 114 in an outward direction and threaded into welded nut 51 on side arms 49 of the base frames 26, 45, and 49. The bearing element 118 bottoms out on the nut 51 to prevent over-tightening of the stud 119. The head of the stud 119 is shaped to slide through the aperture 111 to facilitate assembly by allowing the stud to be threaded into nut 51 from the inboard side of the side arm 49. It is noted that the head of stud 119 can be enlarged to positively capture the configured end 105 to the side arm 49 if desired. The present arrangement including the rubber bushings 117 allows the pivot 23 to flex and compensate for rotation that is not perfectly aligned with the axis 23, thus reducing the stress on the bearings and reducing the stress on components of the chair such as on the back frame 30 and the side arms 49 where the stud 119 is misaligned with its axis.

The lower seat-to-back frame bearing 115 is similar to bearing 114 in that bearing 115 includes a rubber bushing 121 and a lubricous bearing element 122, although it is noted that the frustoconical surface faces inwardly. A welded stud 123 extends from seat carrier 124 and includes a lubricous bearing element 125 for rotatably and slidably engaging the bearing element 122. It is noted that in the illustrated arrangement, the configured end 105 is trapped between the side arms 49 of base frames 26, 45, and 49 and the seat carrier 124, such that the bearings 114 and 115 do not need to be positively retained to the configured ends 105. Nonetheless, a positive bearing arrangement could be readily constructed on the pivot 112 by enlarging the head of the stud 119 and by using a similar headed stud in place of the welded stud 123.

Figure 13A:
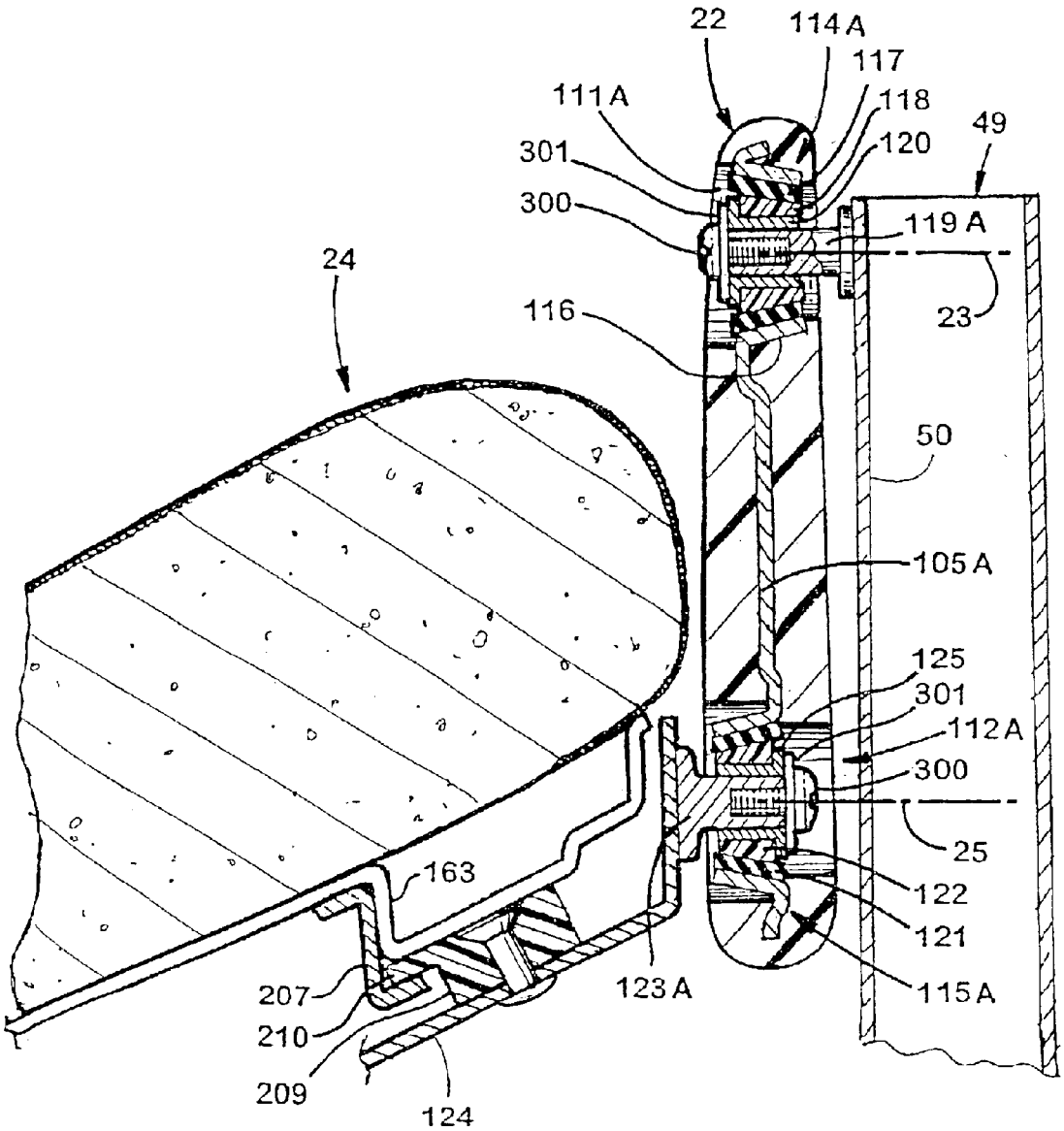
FIG. 13A is a cross-sectional side view of modified pivots similar to FIG. 13, but showing an alternative construction.

A second configuration of the configured end of back frame 30 is shown in FIG. 13A. Similar components arc identified by identical numbers, and modified components are identified with the same numbers and with the addition of the letter "A." In the modified configured end 105A, the frustoconical surfaces of pivots 111A and 112A face in opposite directions from pivots 111 and 112. Pivot 112A (including a welded-in stud 123A that pivotally supports the seat carrier 124 on the back frame 30) includes a threaded axial hole in its outer end. A retainer screw 300 is extended into the threaded hole to positively retain the pivot assembly together. Specifically, a washer 301 on screw 300 engages and positively retains the bearing sleeve 125 that mounts the inner bearing element 122 on the pivot stud 123A. The taper in the pocket and on the bearing outer sleeve 121 positively holds the bearing 115A together. The upper pivot 111A that pivotally supports the back frame 30 on the side arms 50 of the base frame is generally identical to the lower pivot 112, except that the pivot 111A faces in an opposite inboard direction. Specifically, in upper pivot 111A, a stud 119A is welded onto side arm 50. The bearing is operably mounted on the stud 119A in the bearing pocket defined in the base frame 30 and held in place with another washered screw 300. For assembly, the back frame 30 is flexed apart to engage bearing 115, and the configured ends 105A are twisted and resiliently flexed, and thereafter are released such that they spring back to an at-rest position. This arrangement provides a quick assembly procedure that is fastenerless, secure, and readily accomplished.

Figure 12:
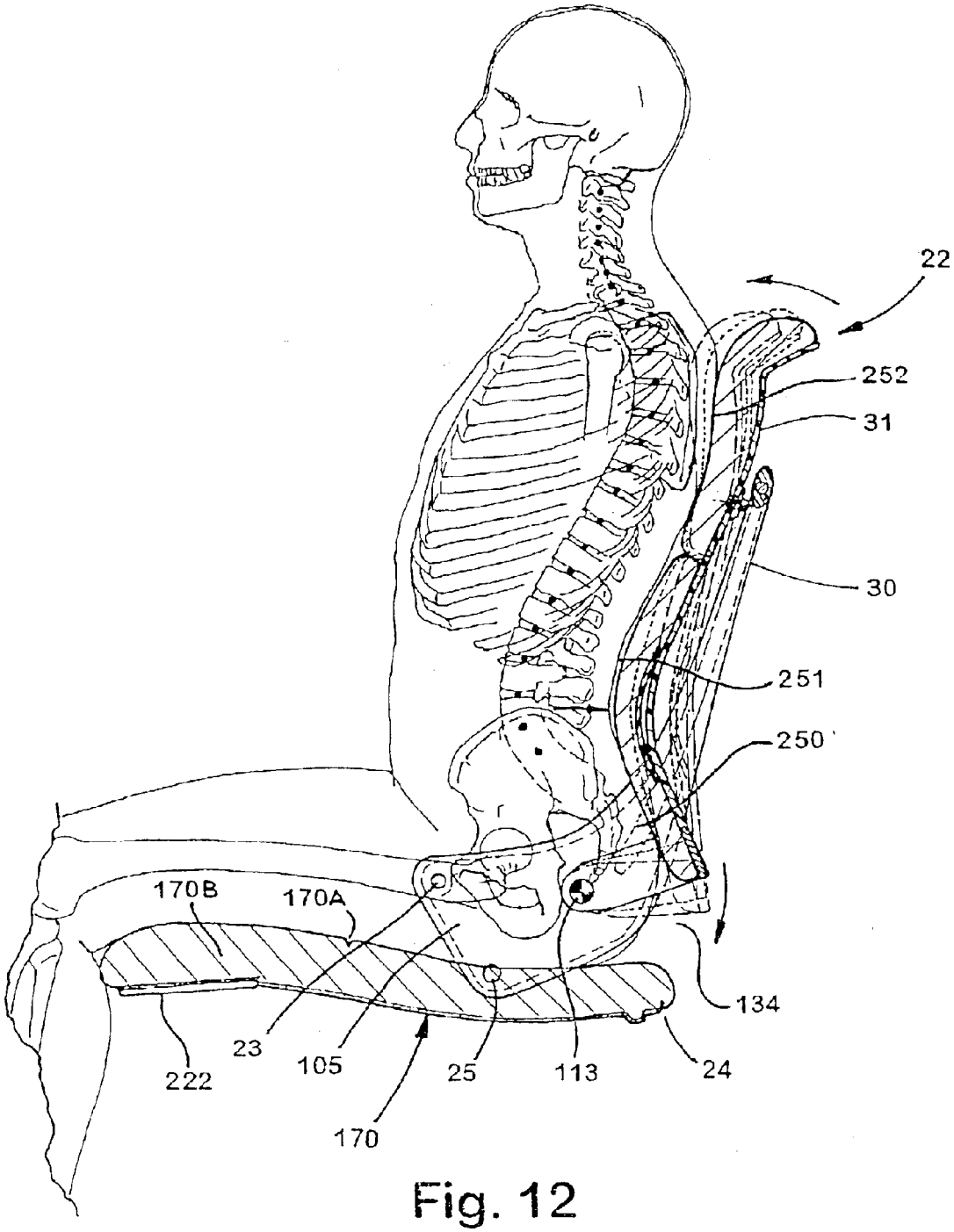
FIG. 12 is a side view of the back assembly shown in FIG. 1 including the back frame and the flexible back shell and including the skeleton and flesh of a seated user, the back shell being shown with a forwardly-convex shape in solid lines and being shown in different flexed shapes in dashed and dotted lines.
Figure 12B:
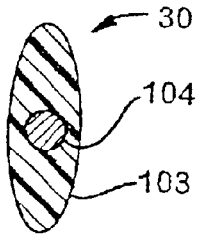
FIGS. 12B and 12C are cross-sections taken along lines XXIIB—XXIIB and XXIIC—XXIIC in FIG. 12A.
Figure 12C:
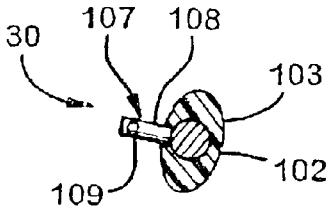
Figure 12D:
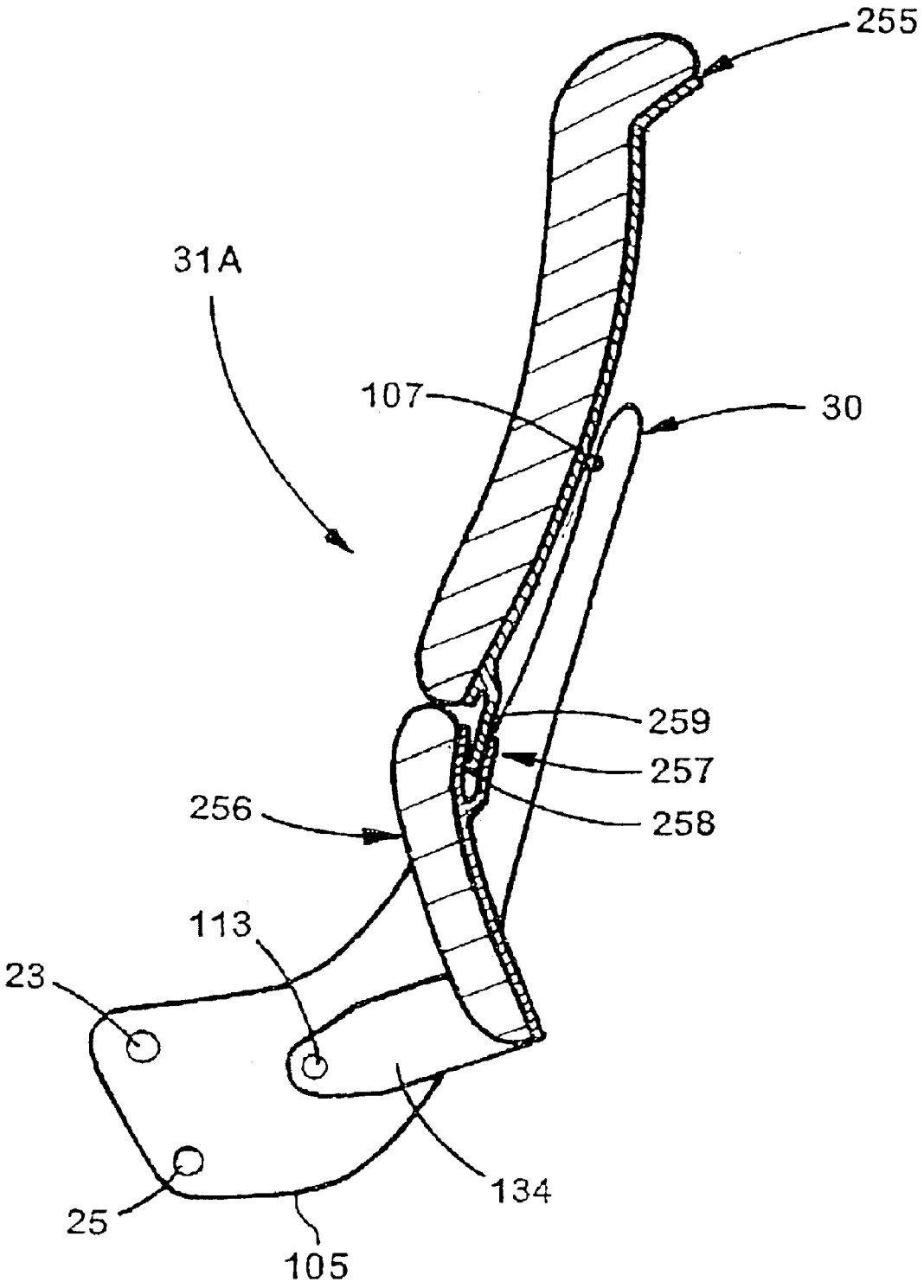
FIGS. 12D–12I are views showing additional embodiments of flexible back shell constructions adapted to move sympathetically with a seated user's back.
Figure 12E:
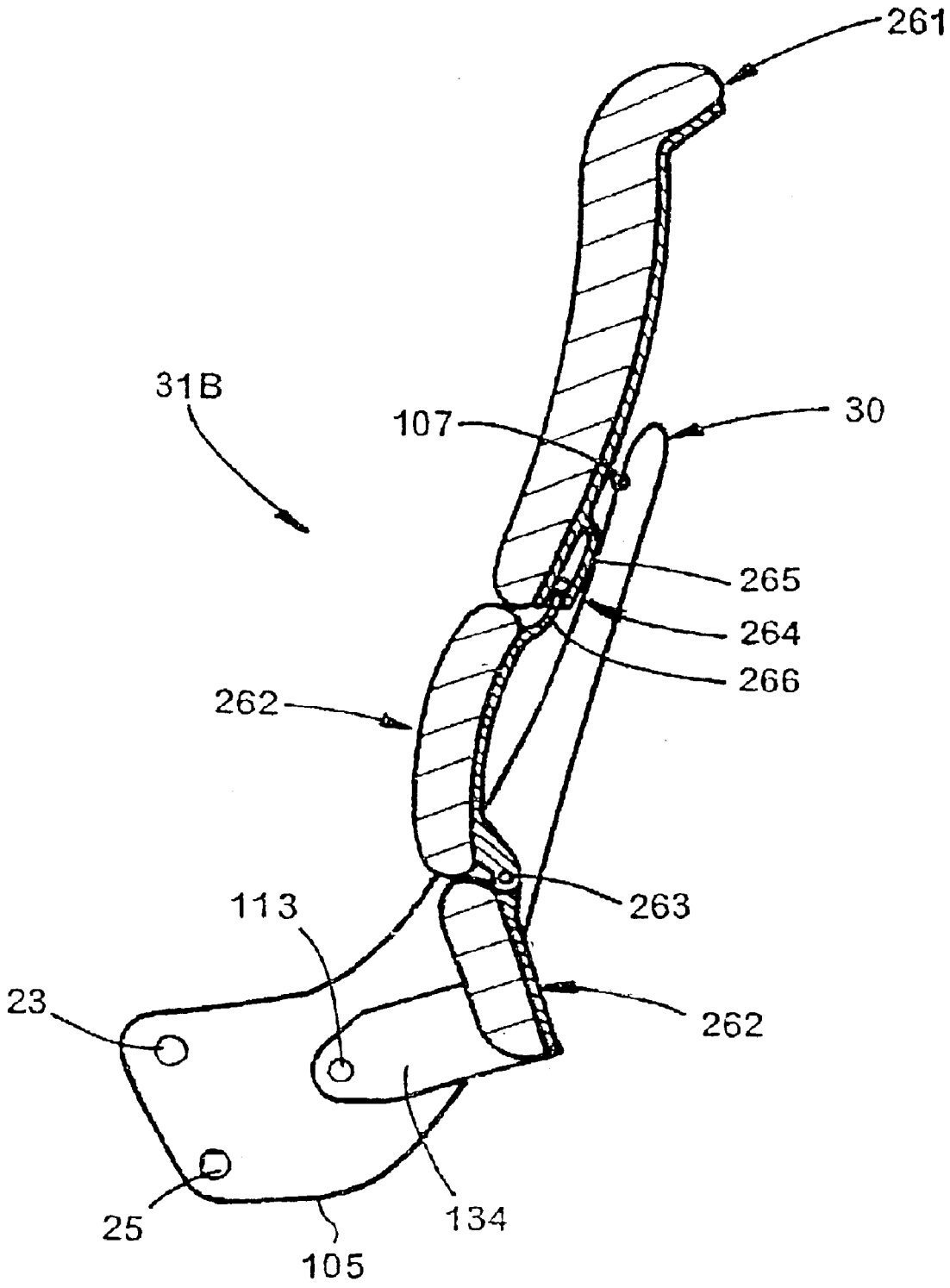
Figure 12G:
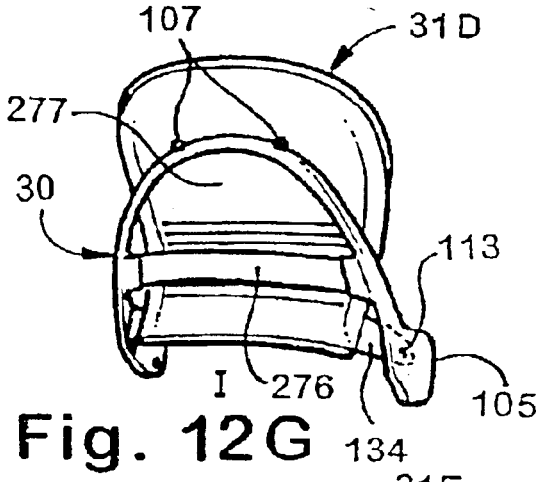
Figure 12H:
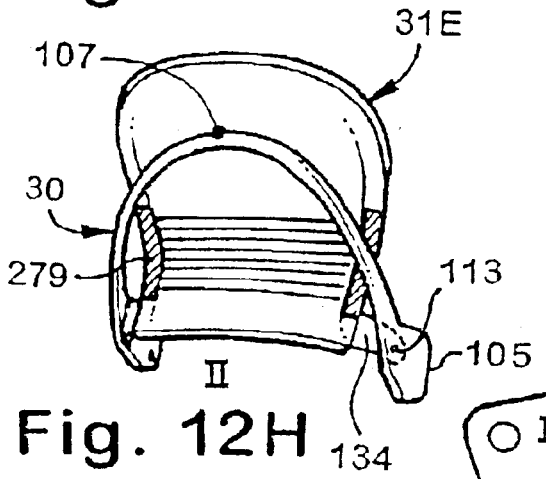
Figure 12I:
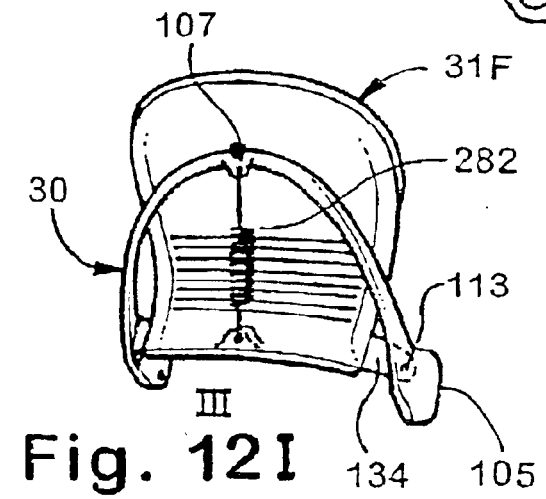
Figure 12F:
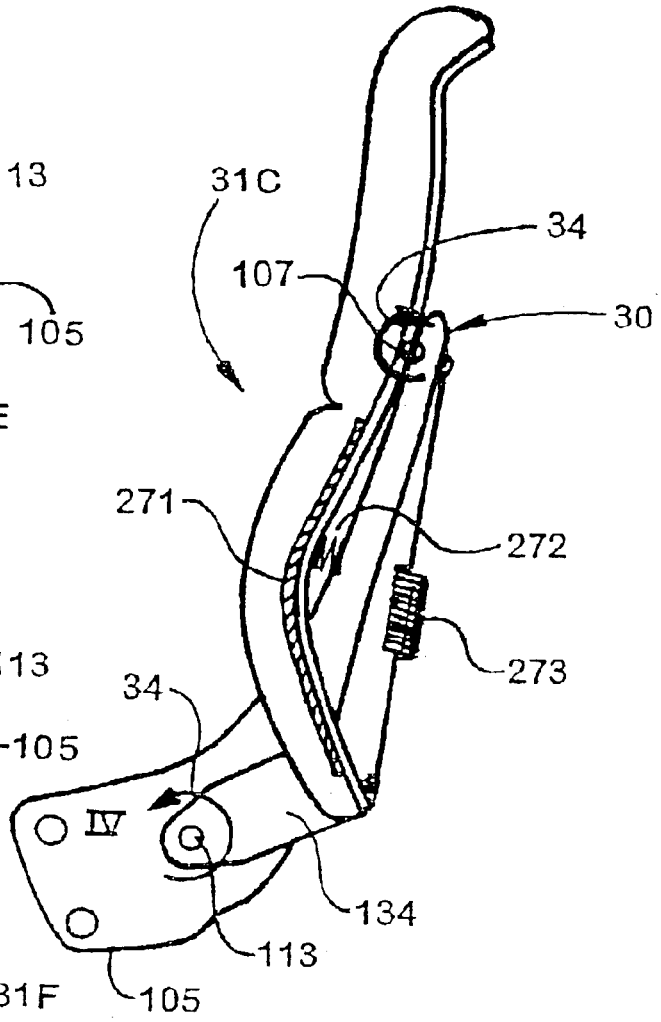
Figures 12, 12J:
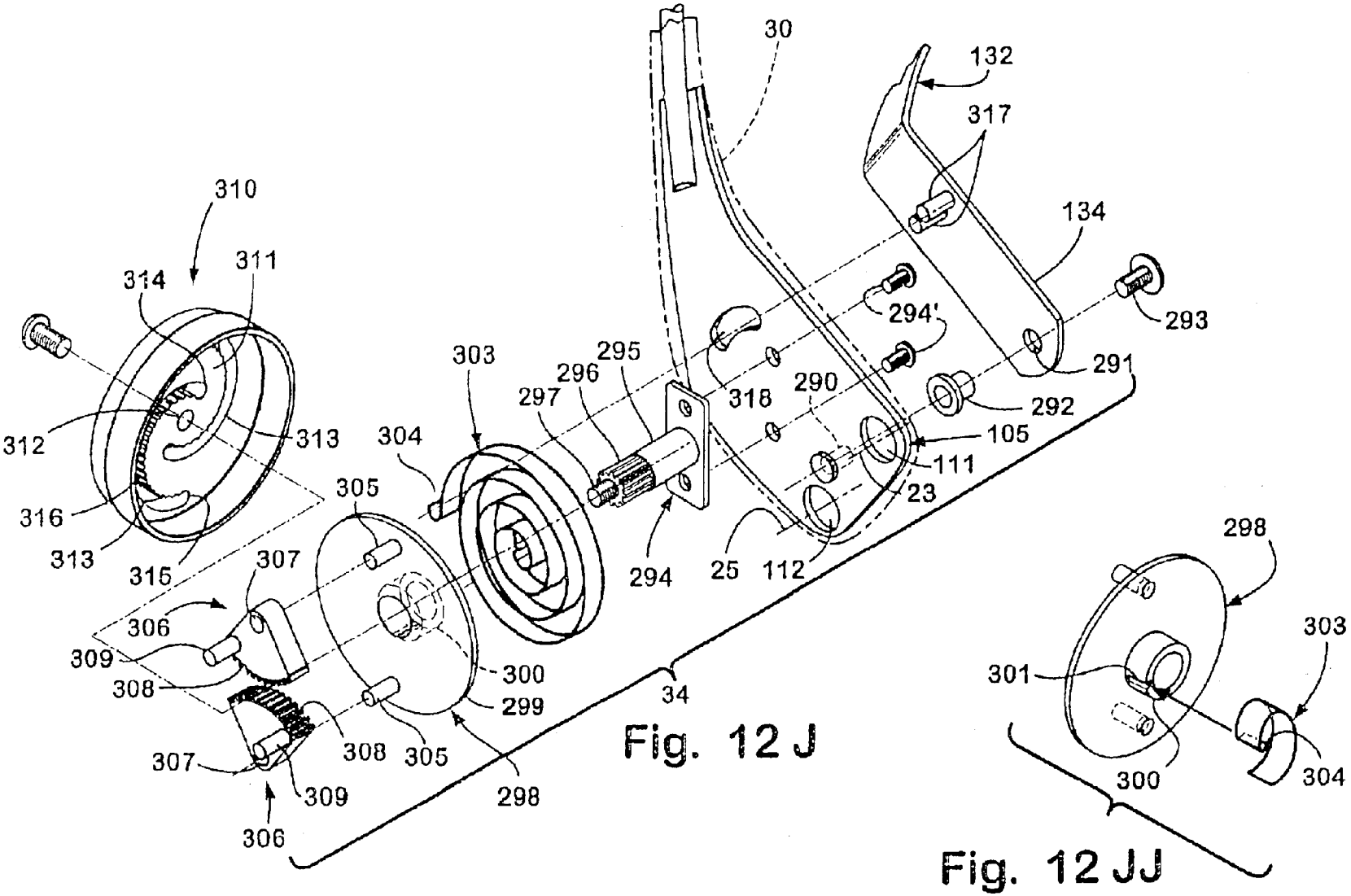
FIG. 12J is an exploded perspective view of the torsionally-adjustable lumbar support spring mechanism shown in FIG. 4A, and FIG. 12JJ is an exploded view of the hub and spring connection of FIG. 12J taken from an opposite side of the hub.
Figure 15:
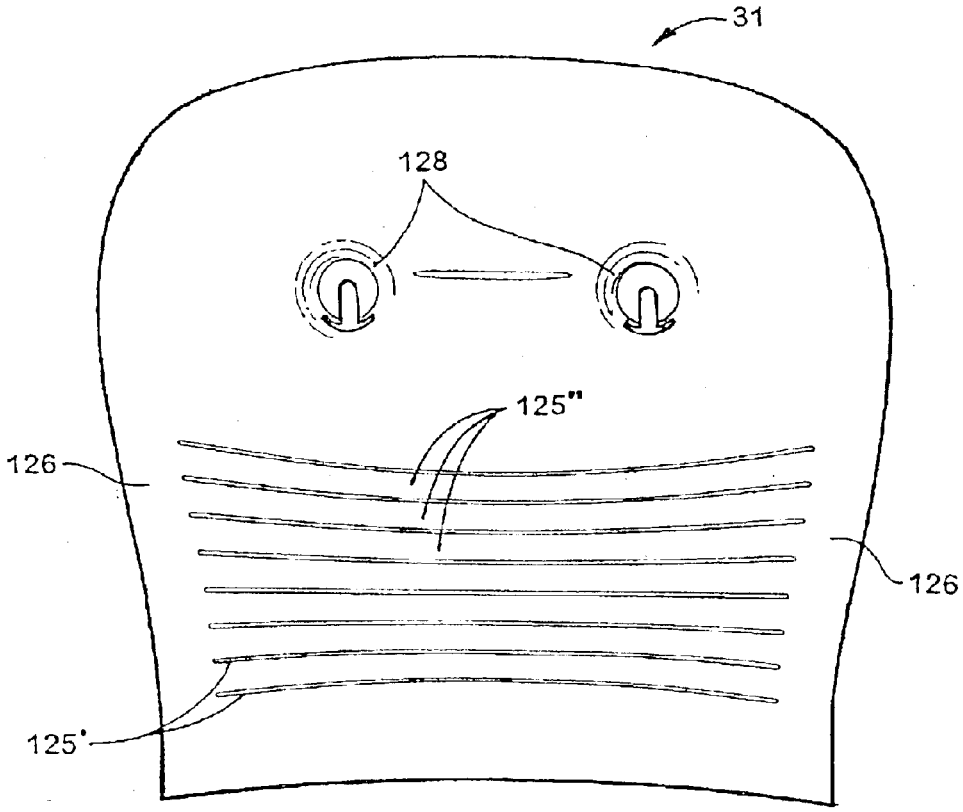
FIG. 15 is a rear view of the back shell shown in FIG. 4A.
Figure 16:
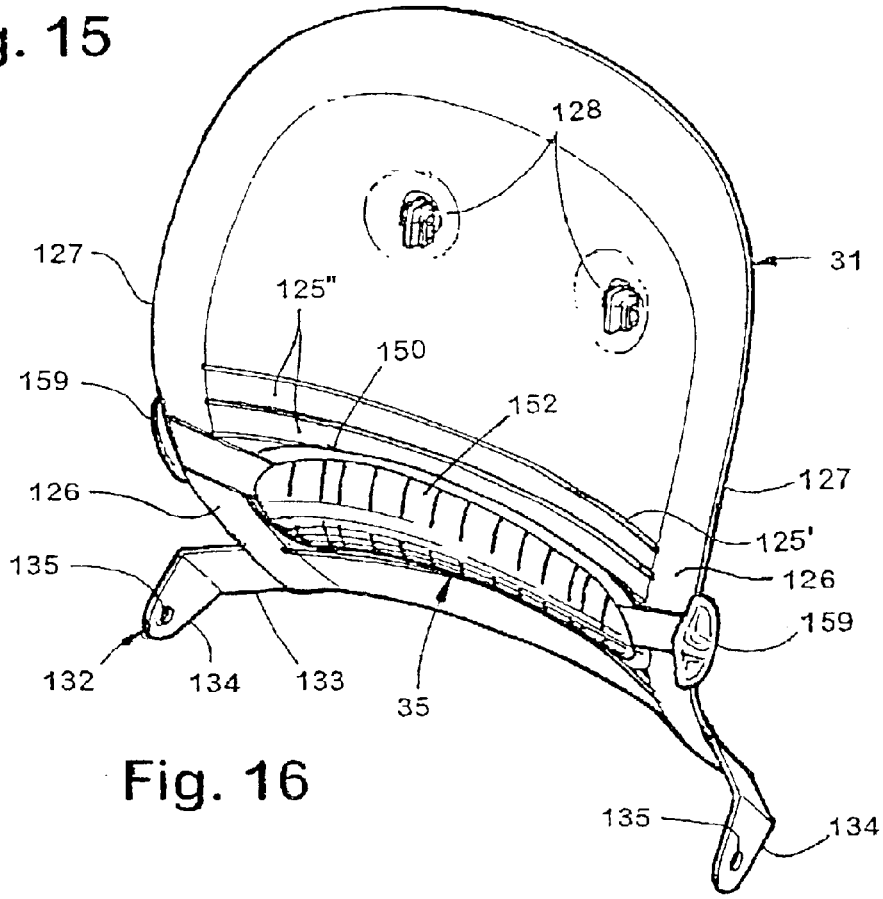
FIG. 16 is a perspective view of the back including the vertically-adjustable lumbar support mechanism shown in FIG. 4A.

The present back shell system shown in FIGS. 12, 15, and 16 (and the back systems of FIGS. 12D—12I) is compliant and designed to work sympathetically with the human back. The word "compliant" as used herein is intended to refer to the flexibility of the present back especially in the lumbar area (see FIGS. 12 and 12F—12I) or a back structure that provides the equivalent of that flexibility (see FIGS. 12D and 12E), and the word "sympathetically" is intended to mean that the back moves in close harmony with a seated user's back as the chair back 22 is reclined and when a seated user flexes his/her lower back and posturally supports the seated user's back. The back shell 31 has three specific regions, as does the human back, those being the thoracic region, the lumbar region, and the pelvic region.

The thoracic "rib cage" region of a human's back is relatively stiff. For this reason, a relatively stiff upper shell portion (FIG. 12) is provided that supports the relatively stiff thoracic (rib cage) region 252 of a seated user. It carries the weight of a user's torso. The upper pivot axis is strategically located directly behind the average user's upper body center of gravity, balancing his/her back weight for good pressure distribution.

The lumbar region 251 of a human's back is more flexible. For this reason, the shell lumbar region of back shell 31 includes two curved, vertical-living hinges 126 at its side edges (FIG. 15) connected by a number of horizontal "cross straps" 125". These straps 125" are separated by widthwise slots 125' allowing the straps to move independently. The slots 125' may have radiused ends or teardrop-shaped ends to reduce concentration of stress. This shell area is configured to comfortably and posturally support the human lumbar region. Both side straps 125" are flexible and able to substantially change radius of curvature from side to side. This shell region automatically changes curvature as a user changes posture, yet maintains a relatively consistent level of support. This allows a user to consciously (or subconsciously) flex his/her back during work, temporarily moving stress off of tiring muscles or spinal disc portions onto different ones. This frequent motion also "pumps" nutrients through the spine, keeping it nourished and more healthy. When a specific user leans against the shell 31, he/she exerts unique relative pressures on the various lumbar "cross straps." This causes the living hinges to flex in a unique way, urging the shell to conform with a user's unique back shape. This provides more uniform support over a larger area of the back improving comfort and diminishing "high pressure points." The cross straps can also flex to better match a user's side-to-side shape. The neutral axis of the human spine is located well inside the back. Correspondingly, the "side straps" are located forward of the central portion of the lumbar region (closer to the spine neutral axis), helping the shell flexure mimic human back flexure.

The pelvic region 250 is rather inflexible on human beings. Accordingly, the lowest portion of the shell 31 is also rather inflexible so that it posturally/mateably supports the inflexible human pelvis. When a user flexes his/her spine rearward, the user's pelvis automatically pivots about his/her hip joint and the skin on his/her back stretches. The lower shell/back frame pivot point is strategically located near but a bit rearward of the human hip joint. Its nearness allows the shell pelvic region to rotate sympathetically with a user's pelvis. By being a bit rearward, however, the lumbar region of the shell stretches (the slots widen) somewhat less than the user's back skin, enough for good sympathetic flexure, but not so much as to stretch or bunch up clothing.

Figure 4A:
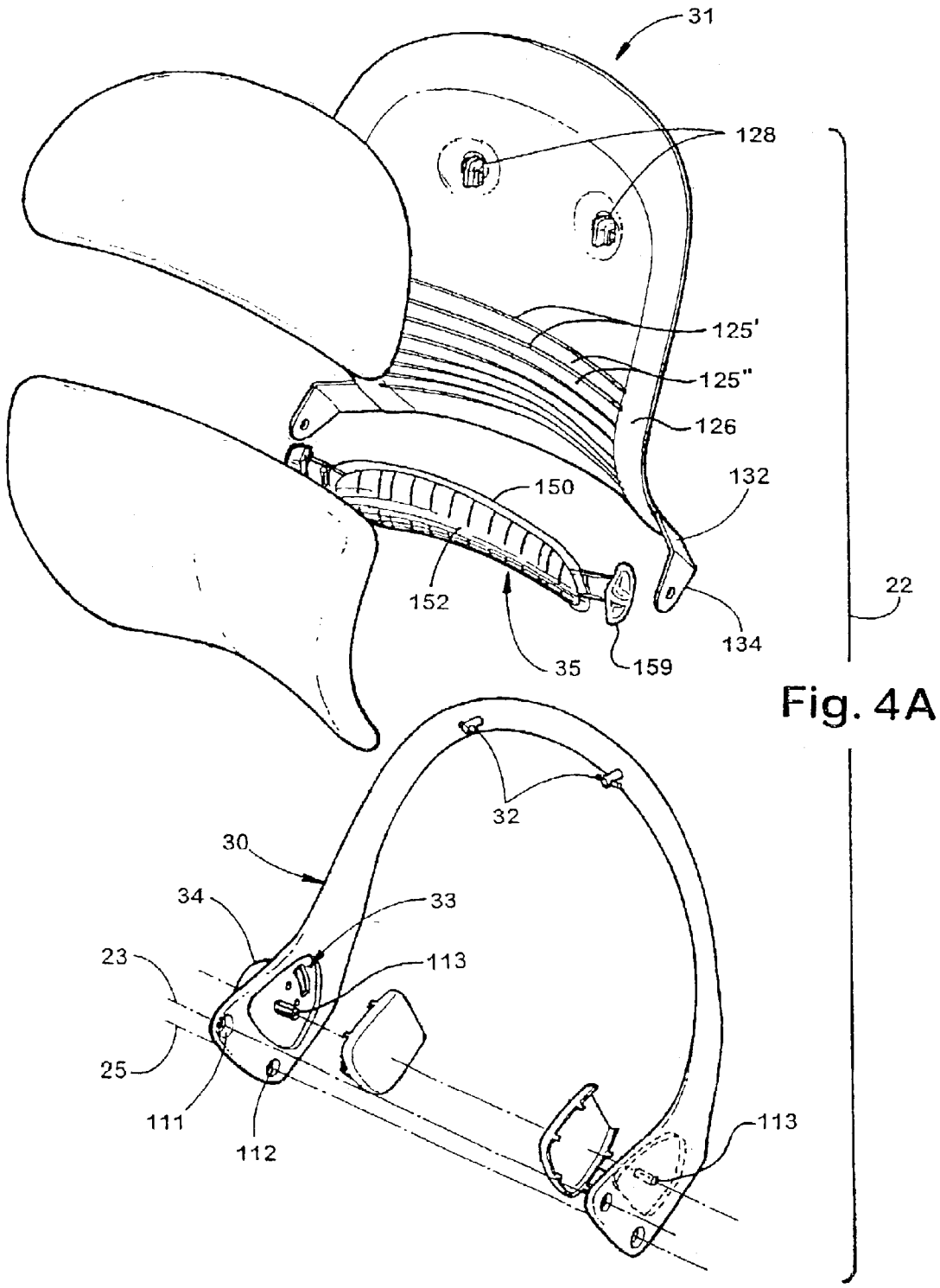
FIGS. 4A and 4B are exploded perspective views of upper and lower portions of the chair shown in FIG. 1.
Figure 14A:
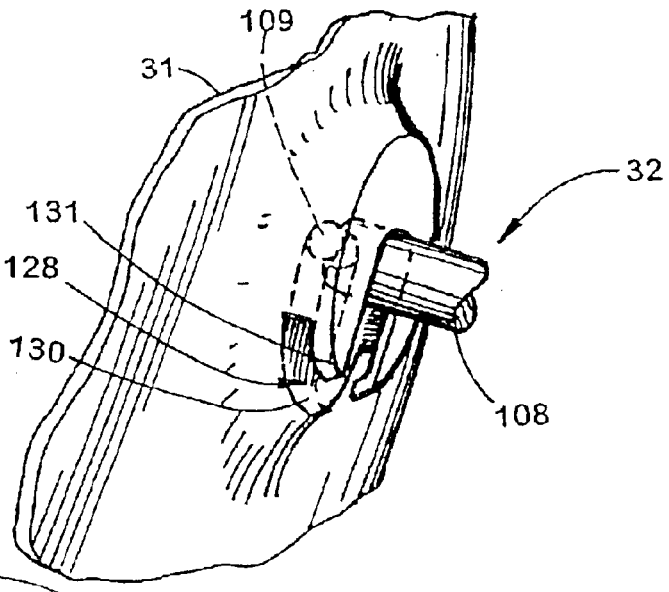
FIGS. 14A and 14B are perspective and front views of the top connector connecting the back shell to the back frame.
Figure 14B:
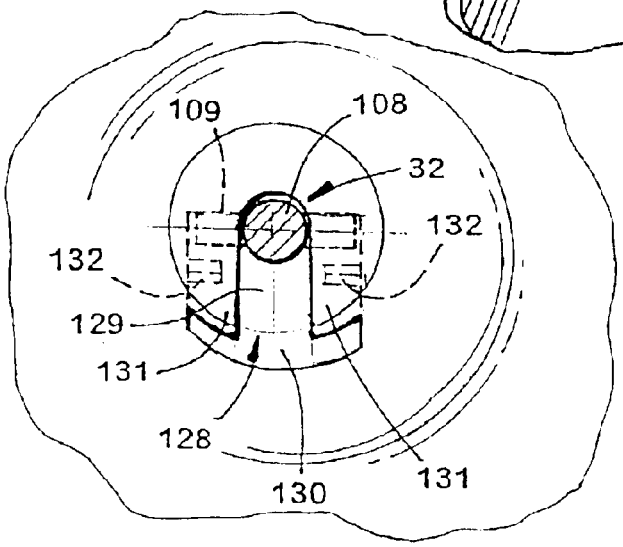

Specifically, the present back shell construction 31 (FIG. 4A) comprises a resiliently-flexible molded sheet made from polymeric material such as polypropylene, with top and bottom cushions positioned thereon (see FIG. 4A). The back shell 31 (FIG. 16) includes a plurality of horizontal slots 125' in its lower half that are located generally in the lumbar area of the chair 20. The slots 125' extend substantially across the back shell 31, but terminate at locations spaced from the sides so that resilient vertical bands of material 126 are formed along each edge. The bands of material or side straps 126 are designed to form a naturally forwardly-convex shape, but are flexible so that they provide an optimal lumbar support and shape to a seated user. The bands 126 allow the back shell to change shape to conform to a user's back shape in a sympathetic manner, side to side and vertically. A ridge 127 extends along the perimeter of the shell 31. A pair of spaced-apart recesses 128 are formed generally in an upper thoracic area of the back shell 31 on its rearward surface. The recesses 128 (FIGS. 14A and 14B) each include a T-shaped entrance with the narrow portion 129 of the recesses 128 having a width for receiving the stem 108 of the top connector 32 on the back frame 30 and with the wider portion 130 of the recesses 128 having a width shaped to receive the transverse rod section 109 of the top connector 32. The recesses 128 each extend upwardly into the back shell 31 such that opposing flanges 131 formed adjacent the narrow portion 129 pivotally capture the rod section 109 of the T-top connector 107 as the stem 108 slides into the narrow portion 129. Ridges 132 in the recesses 128 frictionally positively retain the top connectors 107 and secure the back shell 31 to the back frame 30, yet allow the back shell 31 to pivot about a horizontal axis. This allows for the back shell 31 to flex for optimal lumbar support without undesired restriction.

A belt bracket 132 (FIG. 16) includes an elongated center strip or strap 133 that matches the shape of the bottom edge of the back shell 31 and that is molded into a bottom edge of the back shell 31. The strip 133 can also be an integral part of the back shell or can be attached to back shell 31 with screws, fasteners, adhesive, frictional tabs, insert-molding techniques, or in other ways of attaching known in the art. The strip 133 includes side arms/flanges 134 that extend forwardly from the ends of strip 133 and include apertures 135. The torsional adjustment lumbar mechanism 34 engages the flanges 134 and pivotally attaches the back shell 31 to the back frame at location 113 (FIG. 4A). The torsional adjustment lumbar spring mechanism 34 is adjustable and biases the back shell 31 to a forwardly-convex shape to provide optimal lumbar support for a seated user. The torsional adjustment lumbar spring mechanism 34 cooperates with the resilient flexibility of the back shell 31 and with the shape-changing ability of the vertically-adjustable lumbar support 35 to provide a highly-adjustable and comfortable back support for a seated user.

The pivot location 113 is optimally chosen to be at a rear of the hip bone and somewhat above the seat 24. (See FIG. 12.) Optimally, the fore/aft distance from pivot location 113 to strip 133 is approximately equal to the distance from a seated user's hip joint/axis to his/her lower spine/tail bone region so that the lower back 250 moves similarly and sympathetically to the way a sealed user's lower back moves during flexure about the seated user's hip joint. The location 113 in combination with a length of the forwardly-extending side flanges 133 causes back shell 31 to flex in the following sympathetic manner. The pelvic supporting area 250 of the back shell construction 31 moves sympathetically rearwardly and downwardly along a path selected to match a person's spine and body movement as a seated user flexes his/her back and presses his/her lower back against the back shell construction 31. The lumbar support area 251 simultaneously flexes from a forwardly-concave shape toward a more planar shape. The thoracic support area 252 rotates about top connector 107 but does not flex a substantial amount. The total angular rotation of the pelvic and thoracic supporting areas 250 and 252 are much greater than in prior art synchrotilt chairs, which provides substantially increased comfort. Notably, the back shell construction 31 also flexes in a horizontal plane to provide good postural support for a seated user who twists his/her torso to reach an object. Notably, the back frame 30 is oriented at about a 5° rearward angle from vertical when in the upright position, and rotates to about a 30° rearward angle from vertical when in the fully reclined position. Concurrently, the seat-tilt axis 25 is rearward and at an angle of about 60° below horizontal from the back-tilt axis 23 when the back frame 30 is in the upright position, and pivots to almost vertically below the back-tilt axis 23 when the back frame 30 is in the fully reclined position.

Back constructions 31A–31F (FIGS. 12D–12I, respectively) are additional constructions adapted to provide a sympathetic back support similar in many aspects to the back shell construction 31. Like back construction 31, the present invention is contemplated to include attaching the back constructions 31A–31F to the seat or the base frame at bottom connections.

Specifically, the illustrated constructions 31A–31F are used in combination with back frame 30 to provide a specific support tailored to thoracic, lumbar, and pelvic regions of a seated user. Each of the back constructions 31A–31F are pivoted at top and bottom pivot connections 107 and 113, and each include side arms 134 for flexing about a particularly located lever pivot axis 113.

However, the back constructions 31A–31F achieve their sympathetic back support in slightly different ways.

Back construction 31A (FIG. 12D) includes a cushioned top back support 255 pivoted at top pivot connection 107, and further includes a cushioned bottom back support 256 pivoted at bottom location 113 by the belt bracket 132 including side flanges 134. Top and bottom back supports 255 and 256 are joined by a pivot/slide connection 257. Pivot/slide connection 257 comprises a bottom pocket formed by a pair of flanges 258, and top flange 259 that both slides and pivots in the pocket. A torsional lumbar support spring mechanism 34 is attached at bottom pivot location 113 and, if desired, also at connection 107 to bias top and bottom back supports 255 and 256 forwardly. The combination provides a sympathetic back support that moves with a selected user's back to match virtually any user's back shape, similar to the back shell construction 31 described above.

Back construction 31B (FIG. 12E) includes a top back support 261 pivoted at top connection 107, a bottom back support 262 pivoted at lower connection 113 on belt bracket side flange 134, and an intermediate back support 262 operably positioned therebetween.

Intermediate back support 262 is pivoted to bottom back support 262 at pivot 263, and is slidably pivoted to top back support 261 at pivot/slide joint 264. Pivot/slide joint 264 is formed by top flanges 265 defining a pocket, and another flange 266 with an end that pivots and slides in the pocket. Springs are positioned at one or more joints 107, 113, and 264 to bias the back construction 260 to a forwardly-concave shape.

Back construction 31C (FIG. 12F) is similar to back shell construction 31 in that it includes a sheet-like flexible shell with transverse lumbar slits. The shell is pivoted at top and bottom connections 107 and 113 to back frame 30. The shell of back construction 31C is biased toward a forwardly-convex shape by a torsional lumbar support spring mechanism 34 at bottom pivot 113 and at top pivot 107, by a curvilinear leaf spring 271 in the lumbar area of the shell, by a spring 272 that presses the shell forwardly off of an intermediate section of back frame 30, and/or by a vertical spring 273 that extends from top connection 107 to a rear pivot on belt bracket side flange 134.

Back construction 31D (FIG. 12G) includes a transverse leaf spring 276 that spans between the opposing sides of back frame 30, and that biases the lumbar area of its back shell 277 forwardly, much like spring 272 in the back construction 270. Back construction 31E (FIG. 12H) includes vertical leaf springs 279 embedded in its back shell 280 that bias the lumbar area of back shell 280 forwardly, much like springs 271 in back construction 270. Notably, back construction 278 includes only a single top pivot connection 107. Back construction 31F (FIG. 12I) includes a vertical spring 282 connected to a top of the back frame 30, and to belt bracket 132 at a bottom of its back shell 283. Since the back shell 283 is forwardly convex, the spring 282 biases the shell 283 toward an even more convex shape, thus providing additional lumbar support. (Compare to spring 273 on back construction 31C, FIG. 12F.)

It is contemplated that the torsional lumbar support spring mechanism 34 (FIG. 12I) can be designed in many different constructions, but includes at least a spring operably connected between the back frame 30 and the back shell 31. Optionally, the arrangement includes a tension adjustment device having a handle and a friction latch to provide for tension adjustment. The spring biases the belt bracket 132 rotationally forward so that the back shell 31 defines a forwardly-convex shape optimally suited for lumbar support to a seated user. By rotating the handle to different latched positions, the tension of the spring is adjusted to provide an optimal forward lumbar force. As a seated user presses against the lumbar area of back shell 31, the back shell 31 flexes "sympathetically" with a movement that mirrors a user's spine and body flesh. The force of the bands of material 126 in the shell 31 provide a relatively constant force toward their natural curvilinear shape, but when combined with the torsional lumbar support spring mechanism 34, they provide a highly-adjustable bias force for lumbar support as the user leans against the lumbar area. It is noted that a fixed non-adjustable spring biasing the back belt of the back shell flex zone directly could be used, or that an adjustable spring only adjustable during installation could be used. However, the present adjustable device allows the greatest adjustment to meet varying needs of seated users. Thus, a user can assume a variety of well-supported back postures.

In the present torsional lumbar support spring mechanism 34 (FIG. 12I), belt bracket 132 is pivoted to back frame 30 by a stud 290 that extends inboard from back frame 30 through a hole 291 in belt bracket side flange 134. A bushing 292 engages the stud 290 to provide for smooth rotation, and a retainer 293 holds the stud 290 in hole 291. A base 294 is screwed by screws 294' or welded to back frame 30, and includes a protrusion 295 having a sun gear 296 and a protruding tip 297 on one end. A hub 298 includes a plate 299 with a sleeve-like boss 300 for receiving the protrusion 295. The boss 300 has a slot 301 for receiving an inner end 302 of a spiral spring 303. The body of spring 303 wraps around protrusion 295, and terminates in a hooked outer end 304. Hub 298 has a pair of axle studs 305 that extend from plate 299 in a direction opposite boss 300. A pair of pie-shaped planet gears 306 are pivoted to axle studs 305 at pivot holes 307. A plurality of teeth 308 are located in an arch about pivot holes 307 on the planet gears 306, and a driver pin 309 is located at one end of the arc. A cup-shaped handle 310 is shaped to cover gears 306, hub 298, spring 303, and base 294. The handle 310 includes a flat end panel 311 having a centered hole 312 for rotatably engaging the protruding tip 297 of base 294. A pair of opposing spirally-shaped recesses or channels 313 are formed in the end panel 311. The recesses 313 include an inner end 314, an outer end 315, and an elongated portion having a plurality of detents or scallops 316 formed between the ends 314 and 315. The recesses 313 mateably receive (he driver pins 309. The hooked outer end 304 engages fingers 317 on belt bracket 132, which fingers 317 extend through an arcuate slot 318 in the configured end 105 of back frame 30.

Handle 310 is rotated to operate torsional lumbar support spring mechanism 34. This causes recesses 313 to engage driver pins 309 on planet gears 306. The planet gears 306 are geared to sun gear 296, such that planet gears 306 rotate about sun gear 296 as the driver pins 309 are forced inwardly (or outwardly) and the planet gears 306 are forced to rotate on their respective pivots/axles 305. In turn, as planet gears 306 rotate, they force hub 298 to rotate. Due to the connection of spiral spring 303 to hub 298, spiral spring 303 is wound tighter (or unwound). Thus, the tension of spring 303 on belt bracket 132 is adjustably changed. The detents 316 engage the driver pins 309 with enough frictional resistance to hold the spring 303 in a desired tensioned condition. Due to the arrangement, the angular winding of spiral spring 303 is greater than the angular rotation of handle 310.

Figure 12K:
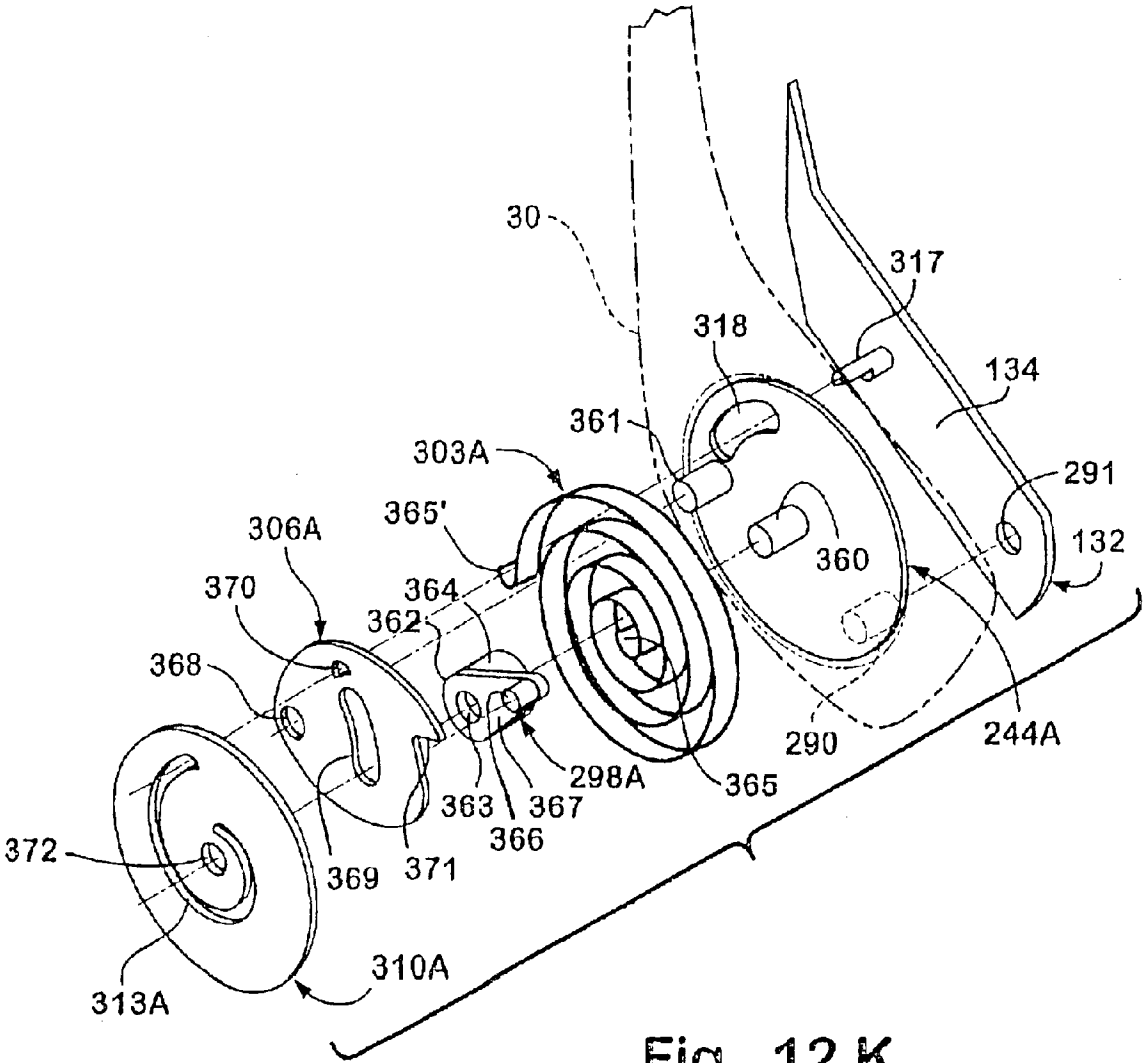
FIG. 12K is an exploded perspective view of a modified torsionally-adjustable lumbar support spring mechanism.

In a modified torsional lumbar support spring mechanism 34A (FIG. 12K), a base bracket 244A is attached to configured end 105A of back frame 30. A lever 306A and driver 298A are operably mounted on base bracket 244A to wind a spiral spring 303A as a handle 310A is rotated. Specifically, the base bracket 244A includes a pivot pin 290 that pivotally engages hole 291 in belt bracket 132. A second pin 317 extends through arcuate slot 318 in configured end 105A, which slot 318 extends around pivot pin 290 at a constant radius. Two pins 360 and 361 extend from base bracket 244A opposite pivot pin 290. The driver 298A includes an apertured end 362 with a hole 363 for rotatably engaging center pin 360. The end 362 includes an outer surface 364 with a slot therein for engaging an inner end 365 of spiral spring 303A. The outer end 365 is hook-shaped to securely engage pin 317 on the belt bracket 132. A finger-like stud 366 extends laterally from the outer end 367 of driver 298A.

Lever 306A includes a body with a hole 368 for pivotally engaging pin 361, and a slot 369 extending arcuately around hole 368. A pin 370 extends from lever 306A for engaging a spiral cam slot 313A on an inside surface of cup-shaped handle 310A. A tooth 371 on lever 306A is positioned to engage stud 366 on driver 298A. Hole 372 on handle 310A rotatably engages the pivot pin 360 on base bracket 244A.

Figure 12M:
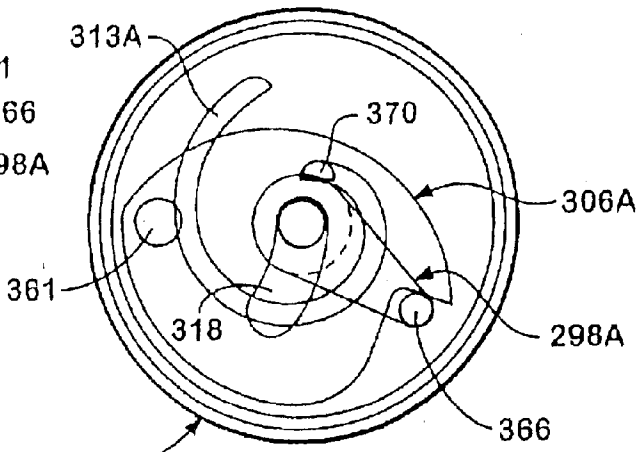
FIGS. 12L and 12LL are side views of the mechanism shown in FIG. 12K adjusted to a low torque position, and FIGS. 12M and 12MM are side views of the mechanism adjusted to a high torque position, FIGS. 12L and 12M highlighting the spring driver, and FIGS. 12LL and 12MM highlighting the lever.
FIG. 12N is a fragmentary cross-sectional side view of the back construction shown in FIG. 12.
Figure 12L:
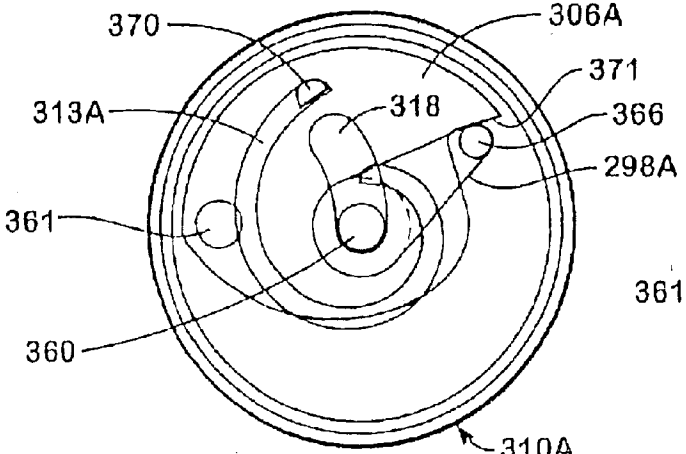
Figure 12:
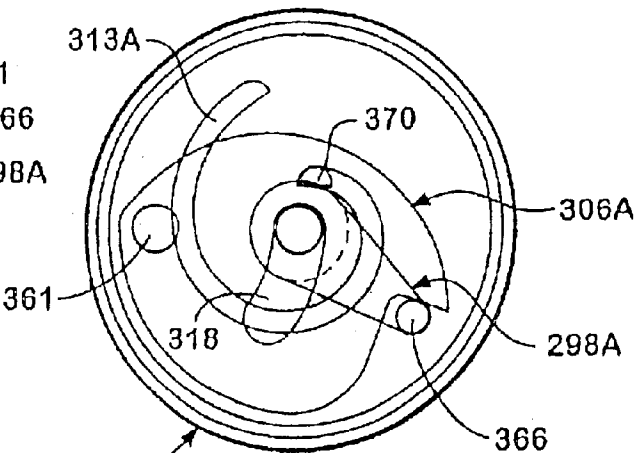
Figure 12:
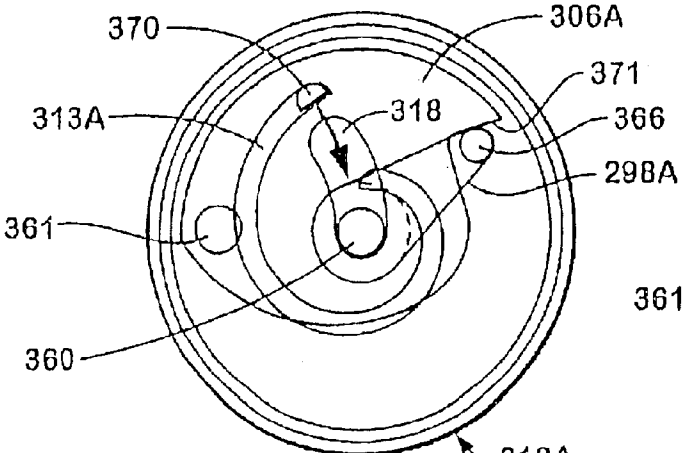
Figure 12N:
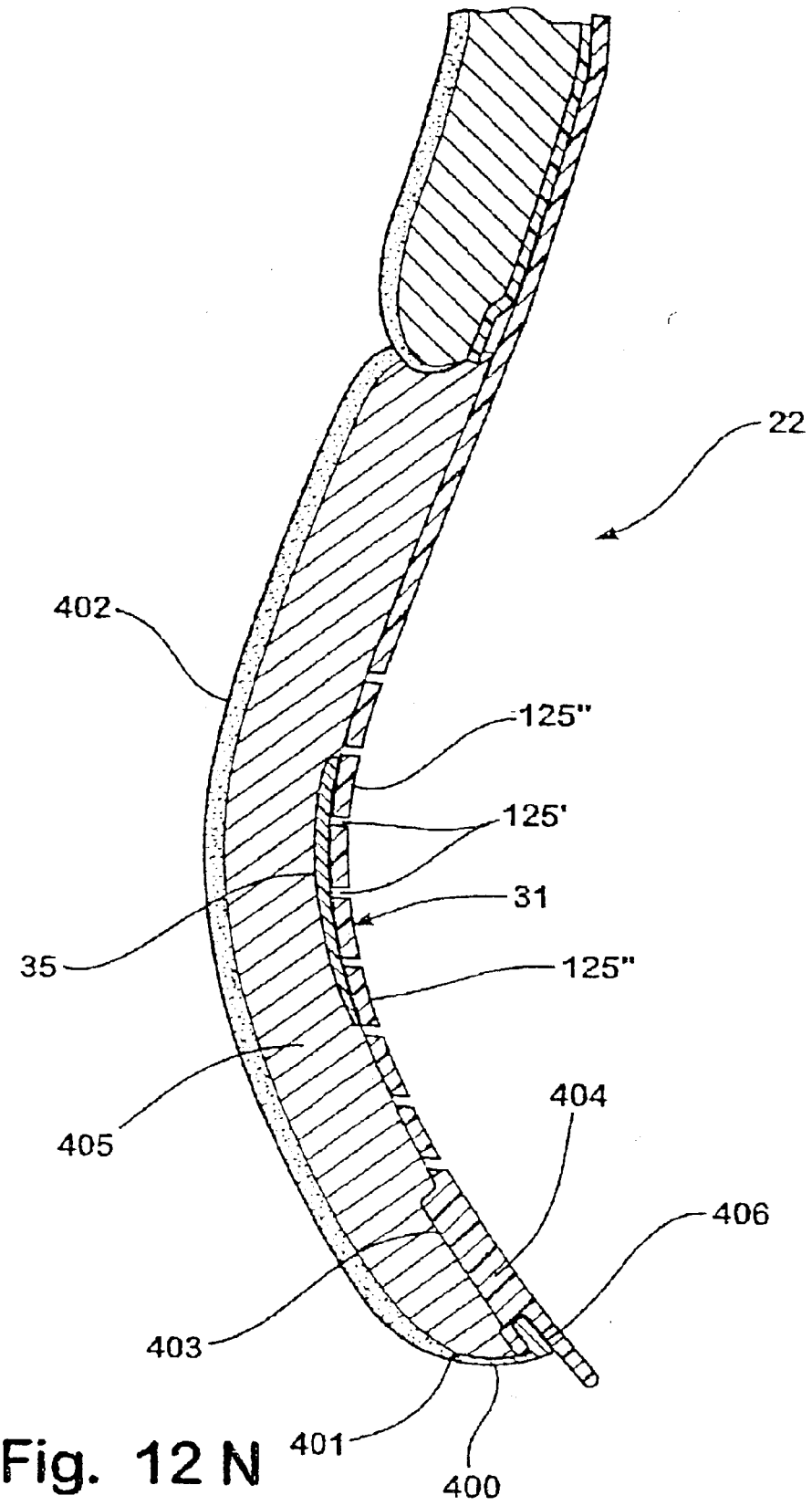

Handle 310A is rotatable between a low tension position (FIGS. 12L and 12LL) and a high tension position (FIGS. 12M and 12MM). Specifically, as handle 310A is rotated, pin 370 rides along slot 313A causing lever 306A to rotate about hole 368 and pivot pin 361. As lever 306A rotates, tooth 371 engages pin 366 to rotate driver 298A about pin 360. Rotation of driver 298A causes the inside end 365 of spring 303A to rotate, thus winding (or unwinding) spring 303A. The arrangement of driver 298A, lever 360A, and handle 310A provide a mechanical advantage of about 4:1, so that the spiral spring 303A is adjustably wound with a desired amount of adjustment force on the handle 310A. In the illustration, a rotation of about 330° of the handle 310A produces a spring tension adjustment winding of about 80°.

Figure 19:
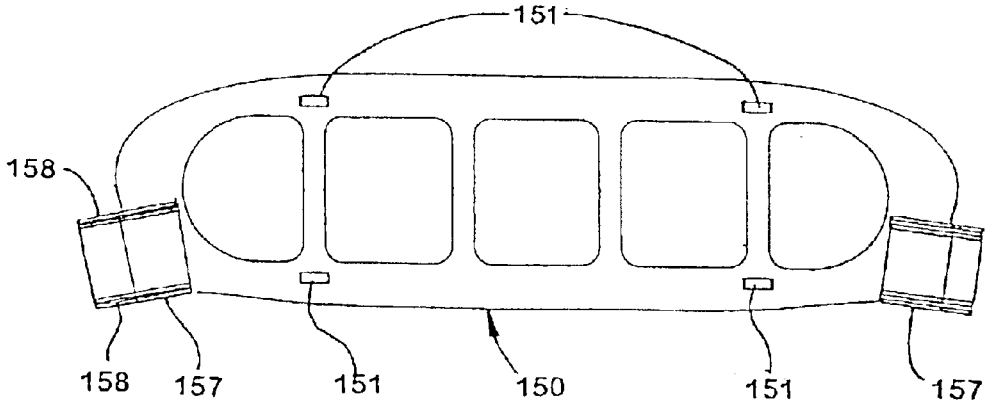
FIG. 19 is a front view of the slide frame of the vertically-adjustable lumbar support mechanism shown in FIG. 18.

Optionally, for maximum adjustability, a vertical adjustable lumbar system 35 (FIG. 16) is provided that includes a slide frame 150 (FIG. 19) that is generally flat and that includes several hooked tabs 151 on its front surface. A concave lumbar support sheet 152 (FIG. 16) of flexible material such as spring steel includes a plurality of vertical slots that form resilient leaf-spring-like fingers 153 along the top and bottom edges of the sheet 152. The (optional) height adjustable back support sheet 152 is basically a radiused sheet spring that can, with normal back support pressures, deflect until it matches the shape of the back shell beneath it. In doing so, it provides a band of higher force across the back. This provides a user with height-adjustable localized back support, regardless of the flexural shape of the user's back. Thus, it provides the benefits of a traditional lumbar height adjustment without forcing a user into a particular rigid back posture. Further, the fabric or upholstery on the back is always held taunt, such that wrinkles are eliminated. Stretch fabric can also be used to eliminate wrinkles.

A user may also use this device for a second reason, that reason being to more completely adapt the back shell shape to his/her own unique back shape. Especially in the lower lumbar/pelvic region, humans vary dramatically in back shape. Users with more extreme shapes will benefit by sliding the device into regions where their back does not solidly contact the shell. The device will effectively change its shape to exactly "fill in the gap" and provide good support in this area. No other known lumbar height adjuster does this in the manner described below.

Figure 17:
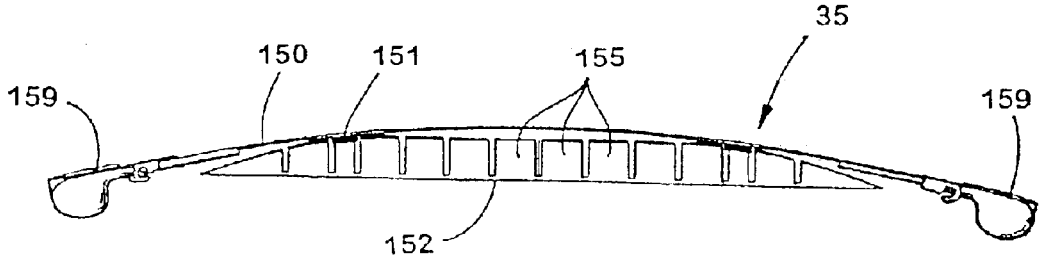
FIGS. 17 and 18 are front and top views of the vertically-adjustable lumbar support mechanism shown in FIG. 16.
Figure 18:
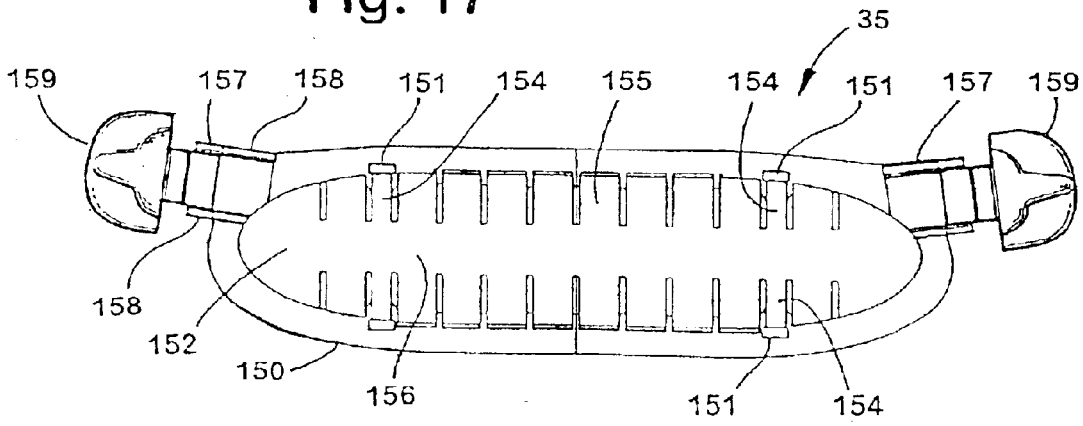
Figure 20:
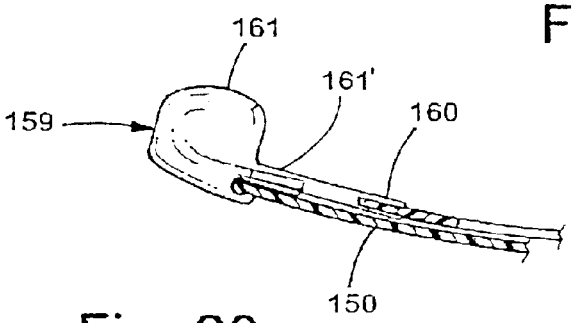
FIG. 20 is a top view, partially in cross-section, of the laterally-extending handle of the vertically-adjustable lumbar support mechanism shown in FIG. 17 and its attachment to the slide member of the lumbar support mechanism.

Four tips 154 on fingers 153 form retention tabs that are particularly adapted to securely engage the hooked tabs 151 to retain the sheet 152 to the slide frame 150. The remaining tips 155 of the fingers 153 slidably engage the slide frame 150 and hold the central portion 156 of the concave sheet forwardly and away from the slide frame 150. The slide frame 150 is vertically adjustable on the back shell 31 (FIG. 16) and is positioned on the back shell 31 between the back shell 31 and the back cushion. Alternatively, it is contemplated that the slide frame 150 could be located between the back cushion and under the upholstery covering the back 22, or even on a front face of the back 22 outside the upholstery sheet covering the back 22. By adjusting the slide vertically, this arrangement allows a seated user to adjust the shape of the lumbar area on the back shell 31, thus providing a high degree of comfort. A laterally-extending guide 157 (FIG. 19) is formed at each of the ends of the slide frame 150. The guides 157 include opposing flanges 158 forming inwardly-facing grooves. Molded handles 159 (FIG. 20) each include a leg 160 shaped to mateably telescopingly engage the guides 157 (FIGS. 17 and 18). The handles 159 further include a C-shaped lip 160 shaped to snappingly engage and slide along the edge ridge 127 along the edge of back shell 31. It is contemplated that other means can be provided for guiding the vertical movement of the slide frame 150 on back shell 31, such as a cord, a track molded along but inward of the edge of the back shell, and the like. An enlarged flat end portion 161 of handle 159 extends laterally outwardly from molded handle 159. Notably, the end portion 161 is relatively thin at a location 161 - immediately outboard of the lip 160, so that the handle 159 can be extended through a relatively thin slot along the side edge of the back 22 when a cushion and upholstery sheet are attached to the back shell 31.

The illustrated back 22 of FIG. 12 includes a novel construction incorporating stretch fabric 400 sewn at location 401 to a lower edge of the upholstery sheet 402 for covering a front of the back 22. The stretch fabric 400 is further sewn into a notch 406 in an extrusion 403 of structural plastic, such as polypropylene or polyethylene.

The extrusion 403 is attached to a lower portion 404 of the back shell 31 by secure means, such as snap-in attachment, hook-in attachment, rivets, screws, other mechanical fasteners, or other means for secure attachment. The foam cushion 405 of the back 22 and the vertically-adjustable lumbar support device 35 are positioned between the sheet 402 and back shell 31. It is contemplated that the stretch fabric will have a stretch rate of at least about 100%, with a recovery of at least 90% upon release. The stretch fabric 400 and sheet 402 are sewn onto the back 22 in a tensioned condition, so that the sheet 402 does not wrinkle or pucker despite the large flexure of the lumbar region 251 toward a planar condition. The stretch fabric 400 is in a low visibility position, but can be colored to the color of the chair if desired. It is noted that covering 402 can be extended to cover the rear of back 22 as well as its front.

Primary Seat Movement, Seat Undercarriage/ support Frame and Bearing Arrangement The seat 24 (FIG. 4B) is supported by an undercarriage that includes a seat front slide 162 and the seat carrier 124. Where seat depth adjustment is desired, a manually depth-adjustable seat frame 163 is slidably positioned on the seat carrier 124 (as is shown in FIGS. 4B and 21–30). Where seat depth adjustment is not desired, the features of the seat frame 163 and seat rear carrier 124 can be incorporated into a single component, such as is illustrated in FIG. 29 by frame member 163'. A seat shell 164 (FIG. 4B) includes a buttock-supporting rear section 165 that is positioned on the seat carrier 124. The buttock-supporting rear section 165 carries most of the weight of the seated user, and acts somewhat like a perch in this regard. The seat shell 164 further includes a thigh-supporting front section 166 that extends forwardly of the seat frame 163. Front section 166 is connected to rear section 165 by a resilient section 167 strategically located generally under and slightly forward of a seated user's hip joint. The resilient section 167 has a plurality of transverse slots 168 therein. The slots 168 are relatively short and are staggered across the seat shell 164, but are spaced from the edges of the seat shell 164, such that the band of material 169 at the edges of the seat shell 164 remains intact and uninterrupted. The bands 169 securely connect the front and rear sections 166 and 165 together and bias them generally toward a planar condition. A seat cushion 170 is positioned on seat frame 163 and is held in place by upholstery sheet and/or adhesive or the like.

Slide 162 (FIG. 4B) includes a top panel 171 with C-shaped side flanges 172 that extend downwardly and inwardly. A linear lubricous cap 173 is attached atop each sidewall of housing 26 and a mating bearing 174 is attached inside of C-shaped side flanges 172 for slidably engaging the lubricous cap 173. In this way, the slide 162 is captured on the housing 26 for fore-to-aft sliding movement. The seat-attached bracket 56 is attached under the top panel 171 and is located to operate with the back-stop mechanism 36. An axle 174' is attached atop the top panel 171 and includes ends 175 that extend laterally from the slide 162.

Seat carrier 124 (FIG. 4B) is T-shaped in plan view. Seat carrier 124 is stamped from sheet metal into a "T" shape, and includes a relatively wide rear section 176 and a narrower front section 177. Embossments such as elongated embossments 178, 179, and 180 are formed in sections 176 and 177 along with side-down flanges 181 and side-up flanges 182 to stiffen the component. Two spaced-apart stop tabs 183 and a series of latch apertures 184 are formed in the front section 177 for reasons discussed below. The welded studs 123 are attached to side-up flanges 182 and extend laterally. As discussed above, the studs 123 define the seat-tilt axis 25 at this location.

Seat frame 163 (FIG. 4B) is T-shaped, much like the seat carrier 124, but seat frame 163 is shaped more like a pan and is generally larger than the seat carrier 124 so that it is better adapted to support the seat shell 164 and seat cushion 170. Seat frame 163 includes a front portion 185 and a rear portion 186. The front portion 185 includes a top panel 187 with down flanges 188 at its sides. Holes 189 at the front of down flanges 188 form a pivot axis for the active thigh flex device 190 described below. Other holes 191 spaced rearwardly of the holes 189 support an axle that extends laterally and supports a multi-functional control 192 for controlling the seat depth adjustment and for controlling the active thigh flex device 190. The center of front portion 185 is raised and defines a sidewall 193 (FIG. 23) having three apertures 194–196 that cooperate to pivotally and operably support a depth latch 197. A depression 198 is formed in the center of front portion 185 and a slot 200 is cutout in the center of the depression 198. A T-shaped stop limiter 199 (FIG. 26) is positioned in the depression 198 and screw-attached therein, with the stein 201 of the limiter 199 extending downwardly through the slot 200 (FIGS. 26 and 26A). An inverted U-shaped bracket 203 is attached to the wide rear section 176. The U-bracket 203 (FIG. 28) includes apertures for pivotally supporting one end of a gas spring 204 used in the active thigh flex support device 190 described below. The rear section 176 (FIG. 23) includes a U-shaped channel section 205 that extends around its perimeter and an outermost perimeter flange 206, both of which serve to stiffen the rear section 176. Flat areas 205' are formed on opposing sides of the rear section 176 for slidably engaging the top of rear bearings 209.

Seat Depth Adjustment

A pair of parallel elongated brackets 207 (FIG. 4B) are attached under the forwardly-extending outer sides of the U-shaped channel section 205 for slidingly supporting the seat frame 163 on the seat carrier 124. The elongated Z-brackets 207 form inwardly-facing C-shaped guides or tracks (FIG. 21) that extend fore-to-aft under the seat frame 163. A bearing member is attached inside the guides of bracket 207 to provide for smooth operation if desired. Two spaced-apart front bearings 208 (FIG. 4B) and two spaced-apart rear bearings 209 are attached atop the seat carrier 124, front bearings 208 being attached to front section 177, and rear bearings 209 being attached to rear section 176. The rear bearings 209 are configured to slidably engage the guides in brackets 207, and further include a tongue 210 that extends inwardly into the C-shaped portion of the C-shaped guides. The tongue 210 captures the seat frame 163 so that the seat frame 163 cannot be pulled upwardly away from the seat carrier 124. The front bearings 208 slidably engage the underside of the front section 187 at spaced-apart locations. The front bearings 208 can also be made to capture the front portion of the seat frame 163; however, this is not deemed necessary due to the thigh flex device, which provides this function.

The depth adjustment of seat 24 is provided by manually sliding seat frame 163 on bearings 208 and 209 on seat carrier 124 between a rearward position for minimum seat depth (see FIG. 24) and a forward position for maximum seat depth (see FIG. 25). The stem 201 (FIG. 26A) of limiter 199 engages the stop tabs 183 in seat carrier 124 to prevent the seat 24 from being adjusted too far forwardly or too far rearwardly. The depth latch 197 (FIG. 23) is T-shaped and includes pivot tabs 212 and 212' on one of its arms that pivotally engages apertures 194 and 195 in seat frame 163. The depth latch 197 further includes a downwardly-extending latching tooth 213 on its other arm that extends through aperture 195 in seat frame 163 into a selected one of the series of slots 214 (FIG. 26) in the seat carrier 124. A "stem" of the depth latch 197 (FIG. 23) extends laterally outboard and includes an actuation tab 215. Multi-function control 192 includes an inner axle 217 that supports the main components of the multi-function control. One of these components is an inner sleeve 218 rotatably mounted on axle 217. The handle 219 is connected to an outer end of the inner sleeve 218 and a protrusion 220 is connected to an inner end of the inner sleeve 218. The protrusion 220 is connected to the actuation tab 215, such that rotation of the handle 219 moves the protrusion 220 and pivots the latch 197 about latch pivots 194 and 195 in an up and down disconnection. The result is that the latching tooth 213 is released from the series of slots 214, so that the seat 24 can be adjusted to a new desired depth. A spring on inner sleeve 218 biases the latch 197 to a normally engaged position. It is contemplated that a variety of different spring arrangements can be used, such as by including an internal spring operably connected to inner sleeve 218 or to latch 197.

Seat Active Thigh Angle Adjustment (with Infinitely Adjustable Gas Spring)

A front reinforcement plate 222 (FIG. 28) is attached to the underside of the thigh-supporting front section 166 of seat shell 164. A Z-shaped bracket 221 is attached to plate 222 and a bushing 223 is secured between the bracket 221 and the plate 222. A bent rod axle 224 is rotatably supported in bushing 223 and includes end sections 225 and 226 that extend through and are pivotally supported in apertures 190 of down flanges 189 of seat frame 163. The end section 226 includes a flat side, and a U-shaped bracket 227 is non-rotatably attached to the end section 226 for supporting an end of gas spring 204. The U-shaped bracket 227 is oriented at an angle to a portion of the bent rod axle 224 that extends toward bushing 223, such that the U-shaped bracket 227 acts as a crank to raise and lower the thigh-supporting front portion 166 of seat shell 164 when the gas spring 204 is extended or retracted. Specifically, the gas spring 204 is operably mounted between brackets 227 and 203, so that when extended, the front thigh-supporting section 166 of seat shell 164 is moved upwardly to provide additional thigh support. Notably, the thigh-supporting section 166 provides some flex even when the gas spring 204 is locked in a fixed extension, so that a person's thighs are comfortably supported at all times. Nonetheless, the infinite adjustability of this active thigh support system provides an improved adjustability that is useful, particularly to people with shorter legs.

Figure 3:
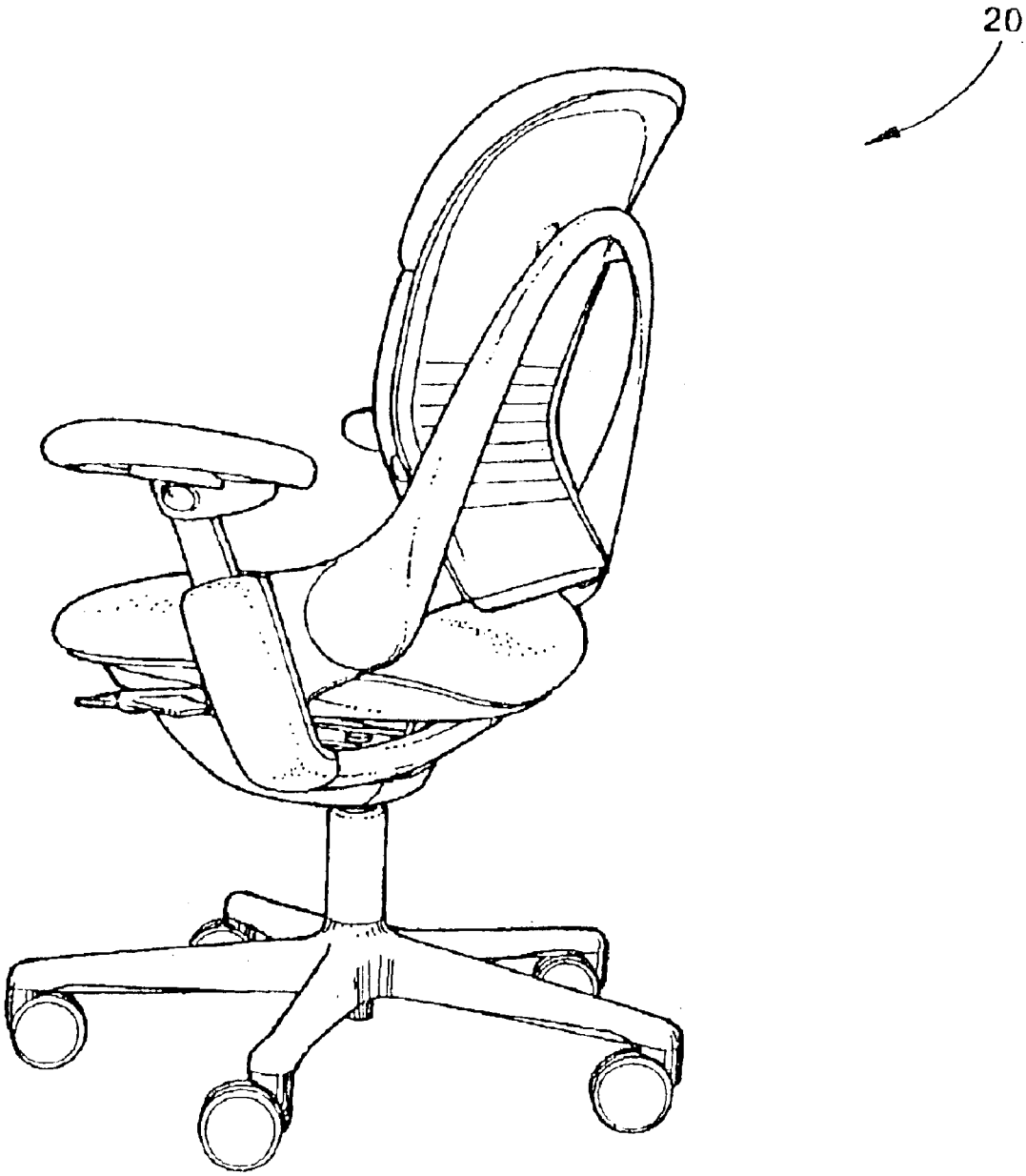

The gas spring 204 (FIG. 28) is self-locking and includes a release button 233 at its rear end that is attached to the bracket 203 for releasing the gas spring 204 so that its extendable rod is extendable or retractable. Such gas springs 204 are well-known in the art. The multi-functional control 192 (FIG. 3) includes an actuator for operating the release button 233. Specifically, the multi-functional control 192 includes a rotatably outer sleeve 229 (FIG. 23) operably positioned on the inner sleeve 218 and a handle 230 for rotating the outer sleeve 229. A connector 231 extends radially from an inboard end of outer sleeve 229. A cable 232 extends from the connector 231 on outer sleeve 229 to the release button 233 (FIG. 28). The cable 232 has a length chosen so that when outer sleeve 229 is rotated, the cable 232 pulls on the release button 233 causing the internal lock of the gas spring 204 to release. The release button 233 is spring biased to a normally locked position. A seated user adjusts the active thigh flex support system by operating the handle 230 to release the gas spring 204. The seated user then presses on (or raises his/her legs away from) the thigh-supporting front portion 166 of the seat shell 164 causing the gas spring 230 to operate the bent rod axle 217 to re-adjust the thigh-supporting front portion 166. Notably, the active thigh support system 190 provides for infinite adjustment within a given range of adjustment.

Also shown on the control 192 (FIG. 10) is a second rotatable handle 234 operably connected to a pneumatic vertical height adjustment mechanism for adjusting chair height by a Bowden cable 235, sleeve 235', and side bracket 235". The details of chair height adjustment mechanisms are well known, such that they do not need to be discussed herein.

The seat shell 164 and its supporting structure (FIG. 4B) is configured to flexibly support a seated user's thighs. For this reason, the seat cushion 170 includes an indentation 170A located slightly forwardly of the seated user's hip joint (FIG. 12). The upholstery covering the seat cushion 170B includes a tuck or fold at the indentation 170A to allow the material to expand or stretch during downward flexing of the thigh support region since this results in a stretching or expanding at the indentation due to the fact that the top surface of the upholstery is spaced above the hinge axis of flexure of the seat shell 164. Alternatively, a stretch fabric or separated front and rear upholstered cushions can be used.

Seat Passive/Flexible Thigh Support (without Gas Spring)

Figure 4B:
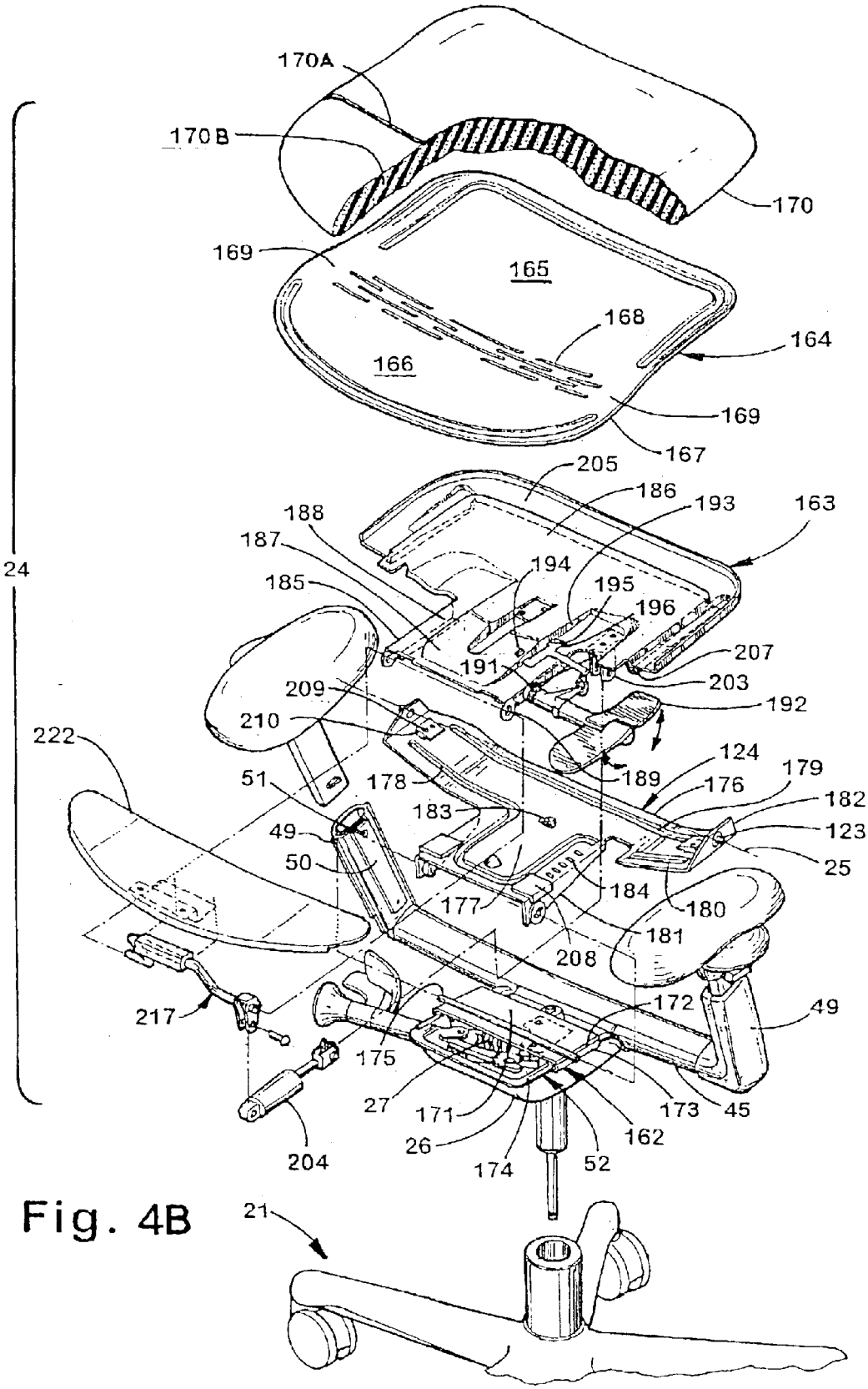
Figure 5:
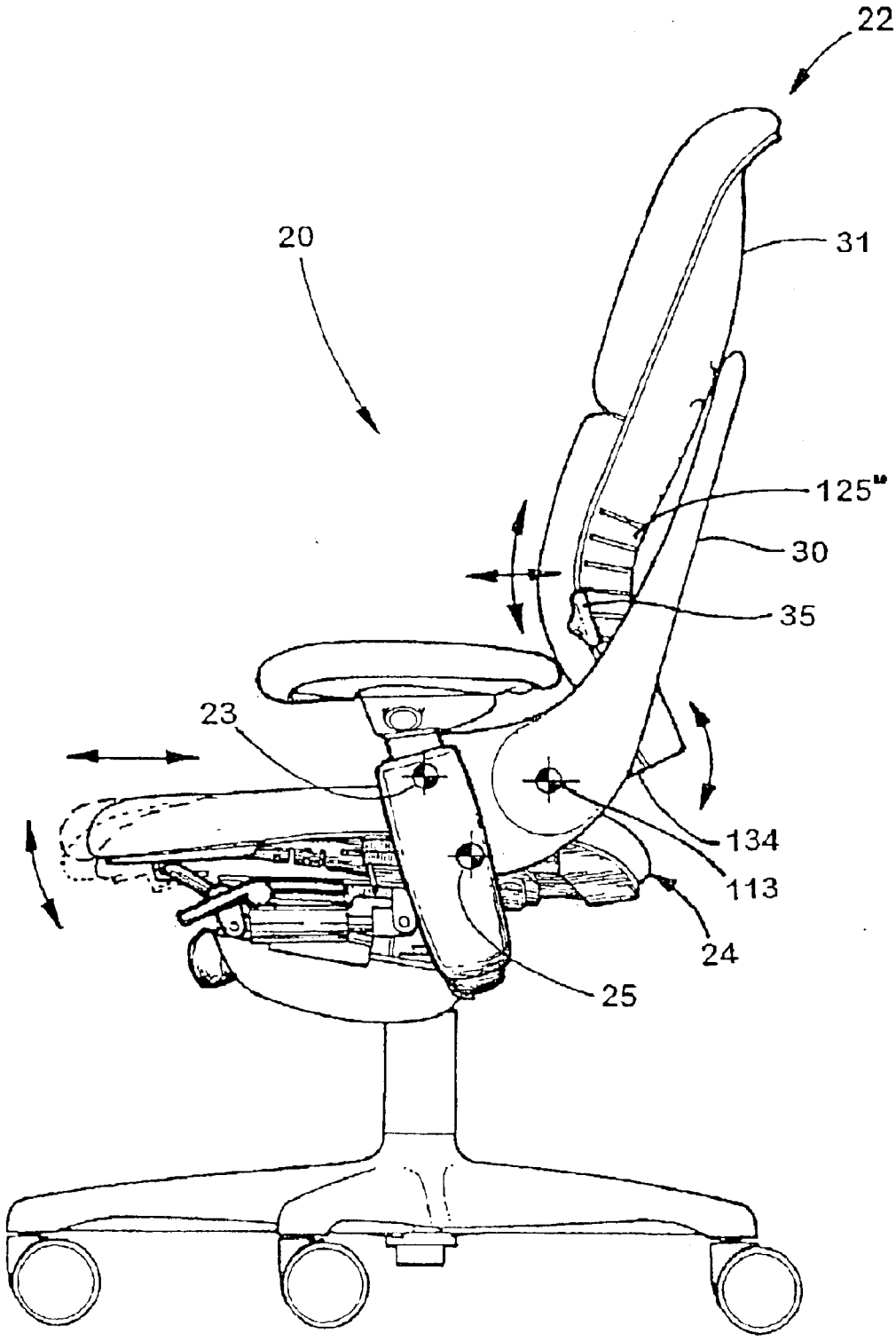
FIGS. 5 and 6 are side views of the chair shown in FIG. 1, FIG. 5 showing the flexibility and adjustability of the chair when in the upright position and FIG. 6 showing the movements of the back and seat during recline.

A passive thigh flex device 237 (FIG. 30) includes a reinforcing plate 238 attached to the underside of the thigh-supporting front portion 166 of seat shell 164 (FIG. 4B). A pair of L-shaped stop tabs 239 (FIG. 29) are bent downwardly from the body of the plate 238. The L-shaped tabs 239 include horizontal fingers 240 that extend rearwardly to a position where the fingers 240 overlap a front edge 241 of the seat frame 163. Bushings 242 are positioned inside the L-shaped tabs 239 and include a notch 243 engaging the front edge 241. A curvilinearly-shaped leaf spring 244 is positioned transversely under the reinforcing plate 238 with the ends 245 of the leaf spring 244 engaging recesses in the top of the bushings 242. The leaf spring 244 has a curvilinear shape so that it is in compression when in the present passive thigh flex device 237. When a seated user presses downwardly on the thigh-supporting front portion 166 with his/her thighs, the leaf spring 244 bends in the middle causing the reinforcing plate 238 to move toward the front edge 241 of the seat frame 163. When this occurs, the fingers 240 each move away from their respective bushings 242 (FIG. 31). When the seated user releases the downward pressure on the thigh-supporting front portion 166, the spring 244 flexes toward its natural bent shape causing the bushings 242 to move back into engagement with the fingers 240 (FIG. 30). Notably, this passive thigh flex device 237 allows the user to flex the lateral sides of the thigh-supporting front portion 166 of the seat shell 164 independently or simultaneously. The degree of flexure of the passive thigh flex device 237 is limited by the distance that bushings 242 can be moved in L-shaped tabs 239.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. A seating unit comprising:

a base;

a seat and a back operably pivoted to the base for simultaneous movement upon recline of the back;

a variable back stop adjustably engaging the seat for limiting the rearward tilt of the back;

a handle supported on one of the base and the seat for adjusting the back stop, the handle and the back stop being independently supported relative to the base ; and a connecting mechanism operably interconnecting the handle and the back stop so that a position of the back stop is adjusted upon movement of the handle.

2. The seating unit defined in claim 1, wherein the handle and back stop move along dissimilar paths but are interconnected for simultaneous coordinated movement by the connecting mechanism.

3. The seating unit defined in claim 2, wherein the connecting mechanism includes a rigid member.

4. The seating unit defined in claim 3, wherein said connecting mechanism includes a lever arm.

5. The seating unit defined in claim 4, wherein the connecting mechanism further includes a rigid link connecting said handle to said lever arm.

6. The seating unit defined in claim 4, wherein the connecting mechanism includes a ball and socket connection.

7. The seating unit defined in claim 2, wherein the connecting mechanism is rotatably attached to the base.

8. The seating unit defined in claim 1, wherein the handle is rotatable about an axis and includes a flat surface that in one dimension extends generally parallel to the axis but in another dimension extends radially away from the axis.

9. The seating unit defined in claim 1, wherein the handle is rotatable about an axis and includes a non-symmetrical surface elongated in a direction perpendicular to the axis.

10. The seating unit defined in claim 1, wherein the handle is rotatably supported for movement along an arcuate path, with one end of the arcuate path representing an upright position of the back, and another end of the arcuate path representing a fully reclined position of the back, and with intermediate positions of the arcuate path representing partial recline positions of the back.

11. The seating unit defined in claim 10, wherein the handle includes a circumferentially non-symmetrical surface.

12. The seating unit defined in claim 10, wherein the arcuate path is less than 90 degrees.

13. The seating unit defined in claim 10, wherein the connecting mechanism includes at least one linkage member.

14. The seating unit defined in claim 13, wherein the at least one linkage member is rigid.

15. The seating unit defined in claim 14, wherein the at least one rigid linkage member is pivoted to the base.

16. The seating unit defined in claim 13, wherein the variable back stop is pivoted to the base.

17. The seating unit defined in claim 13, wherein the connecting mechanism includes a detent to hold the back stop in a selected position.

18. The seating unit defined in claim 1, wherein the seat and back are operably supported for synchrotilt movement on the base, each being provided with different rates of angular movement upon recline.

19. The seating unit defined in claim 18, wherein the seat and back are separately pivoted to the base for synchronous movement, and wherein the seat is biased rearward to cause the back to move to an upright position.

20. The seating unit defined in claim 1, wherein the seat moves forward upon recline of the back.

21. The seating unit defined in claim 1, including a detent for holding the back stop in a selected position.

22. The seating unit defined in claim 21, wherein the detent includes a surface with recesses corresponding to detent positions, and including a spring engaging the recesses.

23. The seating unit defined in claim 1, wherein the back stop includes at least three steps.

24. The seating unit defined in claim 1, wherein the back stop includes a back stop member operably mounted on the base, and further includes multiple steps on one of the back stop member and the seat, and still further includes a stop surface on the other of the back stop member and seat, and also including a detent configured to hold the back stop member in a selected position.

25. The seating unit defined in claim 1, including a stalk control extending from one of the base and the seat; the stalk control including an axle-forming elongated member that is rotatable and that is adapted to control a first function on the seating unit and further wherein the handle is rotatable on the axle-forming elongated member, the handle including a radially-extending portion extending from an axis defined by the axle-forming elongated member.

26. A chair comprising:

a base assembly including a control housing;

an energy source located within the control housing;

a seat operably supported on the base assembly for generally horizontal movement between forward and rearward positions, with the seat operably interconnected to said energy source;

a back and a back frame wherein the back frame is pivotally coupled to the base assembly for movement of the back frame between upright and reclined positions, and wherein the back frame is pivotally coupled to the seat;

wherein the energy source biases the back frame into an upright position by urging the seat to move horizontally, said horizontal movement of the seat inducing the back frame to rotate to a generally upright position; and a variable back stop mechanism supported on the base assembly and operably engaging the seat, the variable back stop mechanism being configured to concurrently stop the seat and stop recline of the back frame at a plurality of selectable positions between the upright and reclined position.

27. The chair defined in claim 26, wherein the seat is supported on the base assembly for forward movement upon recline of the back.

28. The chair defined in claim 26, wherein said variable back stop mechanism includes a handle and a back stop adjustably engaging the seat for limiting the rearward tilt of the back, said handle and said back stop move along dissimilar paths but are interconnected for simultaneous coordinated movement by a connecting mechanism.

29. The chair defined in claim 28, wherein the connecting mechanism includes a rigid member.

30. The chair defined in claim 28, wherein the handle is rotatable about an axis and includes a flat surface that in one dimension extends generally parallel to the axis but in another dimension extends radially away from the axis.

31. The chair defined in claim 28, wherein the connecting mechanism includes at least one linkage member.

32. The chair defined in claim 28, wherein the connecting mechanism includes a detent to hold the back stop in a selected position.

33. The chair defined in claim 26, wherein said variable back stop mechanism includes a back stop with at least three steps defining three different back-stopped positions.

34. The chair defined in claim 33, wherein said back stop is rotatably positioned within said control housing.

35. The chair defined in claim 34, wherein the variable back stop mechanism further includes a detent to hold the back stop in a selected position.

36. The chair defined in claim 35, further including a stalk control extending from one of the base and the seat; the stalk control including an axle-forming elongated member that is rotatable and that is adapted to control a first function on the chair and further wherein a handle is rotatable on the axle-forming elongated member, the handle including a radially-extending portion extending from an axis defined by the axle-forming elongated member.

37. A chair comprising:

a base assembly;

a back frame pivoted to the base assembly for movement between a plurality of positions including upright and reclined positions;

a seat pivoted to the back frame, the seat being slidably supported at a front portion of the base assembly for generally horizontal movement, the back frame and the seat being interconnected and arranged to move the seat generally forwardly and also move a rear portion of the seat downwardly with a synchronous pivoting motion as the back frame is reclined;

the base assembly including a control housing with an energy mechanism positioned therein that operably engages one of the back frame and the seat for biasing the back frame to the upright position; and a back stop mechanism attached to the control housing and configured to selectively engage the seat to limit forward movement of the seat and accordingly selectively limit recline of the back frame.

38. The chair defined in claim 37, wherein the back stop mechanism includes a rigid member.

39. The chair defined in claim 37, wherein the back stop mechanism includes at least one linkage member.

40. The chair defined in claim 37, wherein the back stop mechanism includes a detent to hold the back stop mechanism in a selected position.

41. The chair defined in claim 40, wherein said detent can hold the back stop mechanism in at least three steps.

42. The chair defined in claim 37, further including a stalk control extending from one of the base assembly and the seat; the stalk control including an axle-forming elongated member that is rotatable and that is adapted to control a first function on the chair and further wherein the handle is rotatable on the axle-forming elongated member, the handle including a radially-extending portion extending from an axis defined by the axle-forming elongated member.

43. A seating unit comprising:

a base;

a seat and a back operably pivoted to the base for simultaneous movement upon recline of the back;

an adjustable variable back stop supported on the base and adjustably engaging the seat for adjustably limiting a rearward tilt of the back;

a handle supported on the base for adjusting the back stop and including a flattened surface, the handle and the back stop being separately supported; and a connecting device having one end operably connected to the handle and another end connected to the back stop so that the back stop is adjusted upon movement of the handle;

the handle being rotatable with one end of the rotation representing an upright position of the back and another end of the rotation representing a fully reclined position of the back, and intermediate positions of the rotation representing partial recline positions of the back; and a detent to hold the back stop in a selected one of the positions.

44. The seating unit defined in claim 43, wherein the connecting device includes at least one linkage member.

45. The seating unit defined in claim 44, wherein the connecting device includes a rigid member.

46. The seating unit defined in claim 45, wherein said connecting device includes a lever arm.

47. The seating unit defined in claim 46, wherein the rigid member includes a rigid link connecting said handle to said lever arm.

48. The seating unit of claim 46 wherein the connecting device further includes a ball and socket connection.

49. The seating unit defined in claim 45, wherein the connecting device is rotatably attached to the base.

50. The seating unit defined in claim 43, wherein the handle is rotatable about an axis and includes a flat surface that in one dimension extends generally parallel to the axis but in another dimension extends radially away from the axis.

51. The seating unit defined in claim 43, wherein the handle is rotatable about an axis and includes a non-symmetrical surface elongated in a direction perpendicular to the axis.

52. The seating unit defined in claim 43, wherein the variable back stop is pivoted to the base.

53. The seating unit defined in claim 43, wherein the seat and back are operably supported for synchrotilt movement on the base, each being provided with different rates of angular movement upon recline.

54. The seating unit defined in claim 53, wherein the seat moves forward upon recline of the back.

55. The seating unit defined in claim 43, wherein the back stop includes at least three steps.

56. The seating unit defined in claim 43, including a stalk control extending from one of the base and the seat; the stalk control including an axle-forming elongated member that is rotatable and that is adapted to control a first function on the seating unit and further wherein the handle is rotatable on the axle-forming elongated member, the handle including a radially-extending portion extending from an axis defined by the axle-forming elongated member.

57. A variable back stop apparatus for a seating unit having a base, a seat, and a back, the seat and back being operably pivoted to the base for simultaneous movement including recline of the back, comprising:

an adjustable variable back stop adapted to adjustably engage the seat for adjustably limiting a rearward tilt of the back;

a handle adapted to be supported on one of the base and the seat for adjusting the back stop, the handle and the back stop being supported for independent movement; and a connecting mechanism operably interconnecting the handle and the back stop so that the back stop is adjusted upon movement of the handle.

58. The apparatus defined in claim 57, wherein the connecting mechanism includes at least one linkage member.

59. The apparatus defined in claim 58, wherein the connecting mechanism includes a rigid member.

60. The apparatus defined in claim 59, wherein said connecting mechanism includes a lever arm.

61. The apparatus defined in claim 60, wherein the rigid member includes a rigid link connecting said handle to said lever arm.

62. The apparatus of claim 60, wherein the connecting mechanism further includes a ball and socket connection.

63. The apparatus defined in claim 59, wherein the connecting mechanism is rotatably attached to the base.

64. The apparatus defined in claim 57, wherein the handle is rotatable about an axis and includes a flat surface that in one dimension extends generally parallel to the axis but in another dimension extends radially away from the axis.

65. The apparatus defined in claim 57, wherein the handle is rotatable about an axis and includes a non-symmetrical surface elongated in a direction perpendicular to the axis.

66. The apparatus defined in claim 57, wherein the variable back stop includes a pivot adapted to be pivoted to the base.

67. The apparatus defined in claim 57, wherein the seat moves forward upon recline of the back.

68. The apparatus defined in claim 57, further including a stalk control with an axle-forming elongated member that is rotatable and that is adapted to control a first function on the seating unit and further wherein the handle is rotatable on the axle-forming elongated member, the handle including a radially-extending portion extending from an axis defined by the axle-forming elongated member.

* * * * *